US008814347B2

(12) United States Patent
Sugaya et al.

(10) Patent No.: US 8,814,347 B2
(45) Date of Patent: Aug. 26, 2014

(54) INKJET RECORDING DEVICE

(75) Inventors: Toyoaki Sugaya, Hachioji (JP); Mitsuru Obata, Sagamihara (JP); Hiroya Kimoto, Tokyo (JP); Takashi Muramatsu, Hachioji (JP); Masakazu Date, Hino (JP); Akio Maeda, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/993,043

(22) PCT Filed: Dec. 8, 2011

(86) PCT No.: PCT/JP2011/078366
§ 371 (c)(1),
(2), (4) Date: Jun. 10, 2013

(87) PCT Pub. No.: WO2012/077736
PCT Pub. Date: Jun. 14, 2012

(65) Prior Publication Data

US 2013/0265359 A1 Oct. 10, 2013

(30) Foreign Application Priority Data

Dec. 10, 2010 (JP) ..... 2010-275533

(51) Int. Cl.
*B41J 2/01* (2006.01)

(52) U.S. Cl.
USPC ..... 347/102

(58) Field of Classification Search
CPC ..... B41J 11/002
USPC ..... 347/102
See application file for complete search history.

(56) References Cited

U.S. PATENT DOCUMENTS 5,502,476 A 3/1996 Neal et al.
6,428,160 B2 * 8/2002 Roy et al. ..... 347/102

(Continued)

FOREIGN PATENT DOCUMENTS

JP 07-276621 A 10/1995
JP 09-507806 A 8/1997

(Continued)

OTHER PUBLICATIONS

International Preliminary Report on Patentability (IPRP) dated Jun. 12, 2013 (and English translation thereof) in parent International Application No. PCT/JP2011/078366.

(Continued)

*Primary Examiner* — Julian Huffman
(74) *Attorney, Agent, or Firm* — Holtz Holtz Goodman & Chick PC

(57) ABSTRACT

An inkjet recording device includes an image forming drum, a recording medium supplying section, a recording head which ejects ink onto a recording medium, a first heating unit which heats the recording medium held on the drum before image recording, a second heating unit which heats the drum downstream of the position at which the recording medium is outputted after image recording and upstream of the supplying section, a heating-unit temperature detector, a drum temperature detector, and a heating control section. The heating control section performs heat control of the first heating unit such that the temperature detected by the heating-unit temperature detector falls within a predetermined set temperature range, and performs heat control of the second heating unit such that the temperature detected by the drum temperature detector falls within a predetermined set temperature range.

22 Claims, 48 Drawing Sheets

(56) References Cited

U.S. PATENT DOCUMENTS

| | | | |
|---|---|---|---|
| 7,237,872 | B1 | 7/2007 | Spehrley, Jr. et al. |
| 7,690,779 | B2 | 4/2010 | Spehrley, Jr. et al. |
| 2009/0290008 | A1 | 11/2009 | Fukui |

FOREIGN PATENT DOCUMENTS

| | | | |
|---|---|---|---|
| JP | 10-138517 | A | 5/1998 |
| JP | 10-157093 | A | 6/1998 |
| JP | 2001-213005 | A | 8/2001 |
| JP | 2009-279795 | A | 12/2009 |
| JP | 2010-076138 | A | 4/2010 |

OTHER PUBLICATIONS

International Search Report (ISR) dated Mar. 13, 2012 (and English translation thereof) issued in International Application No. PCT/JP2011/078366.

* cited by examiner

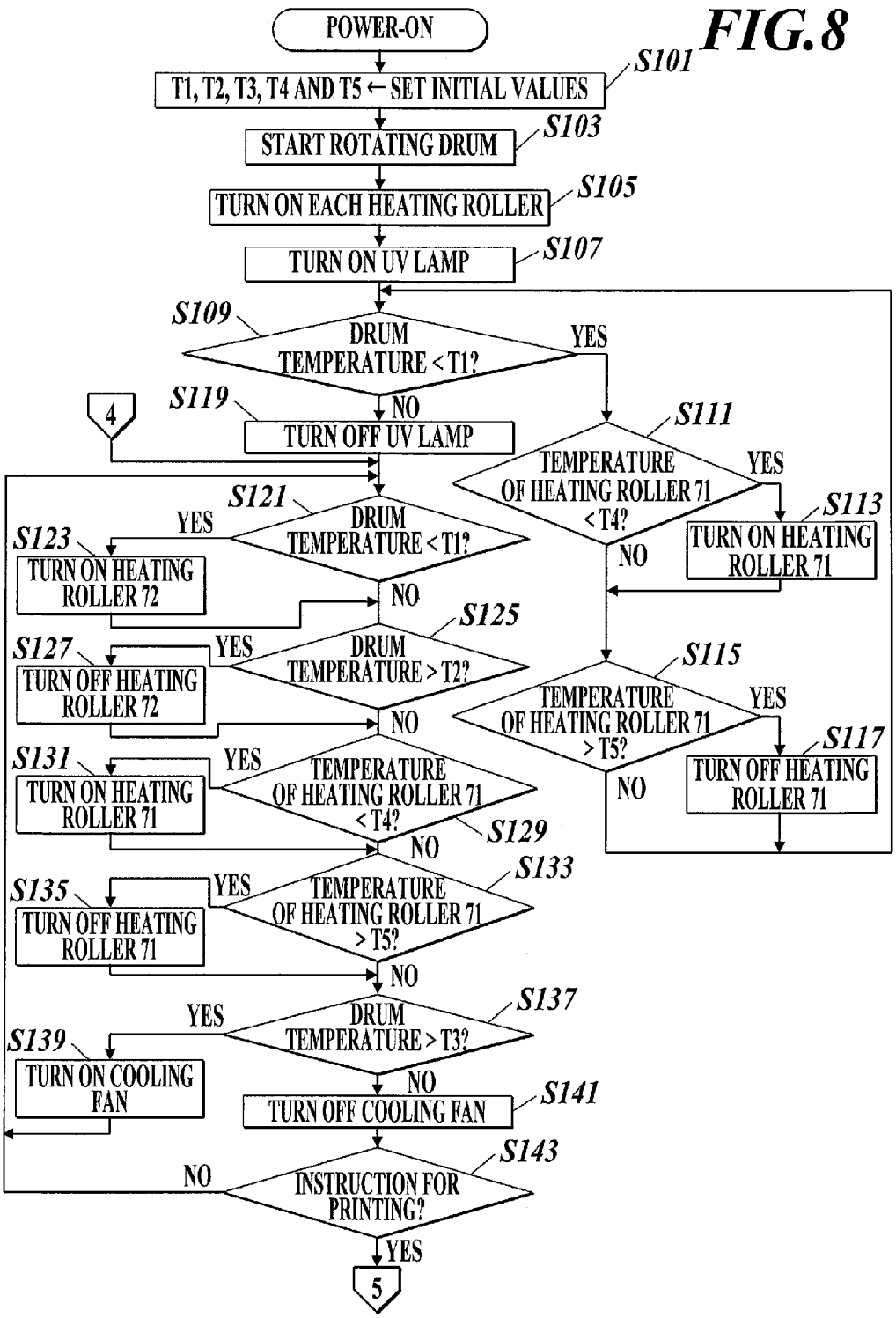
FIG.8
POWER-ON
T1, T2, T3, T4 AND T5 ← SET INITIAL VALUES
S101
START ROTATING DRUM
S103
TURN ON EACH HEATING ROLLER
S105
TURN ON UV LAMP
S107
S109
DRUM TEMPERATURE < T1?
YES
NO
S119
TURN OFF UV LAMP
4
S111
TEMPERATURE OF HEATING ROLLER 71 < T4?
YES
NO
S113
TURN ON HEATING ROLLER 71
S121
DRUM TEMPERATURE < T1?
YES
NO
S123
TURN ON HEATING ROLLER 72
S125
DRUM TEMPERATURE > T2?
YES
NO
S127
TURN OFF HEATING ROLLER 72
S115
TEMPERATURE OF HEATING ROLLER 71 > T5?
YES
NO
S117
TURN OFF HEATING ROLLER 71
S131
TURN ON HEATING ROLLER 71
TEMPERATURE OF HEATING ROLLER 71 < T4?
YES
NO
S129
S133
TEMPERATURE OF HEATING ROLLER 71 > T5?
YES
NO
S135
TURN OFF HEATING ROLLER 71
S137
DRUM TEMPERATURE > T3?
YES
NO
S139
TURN ON COOLING FAN
TURN OFF COOLING FAN
S141
S143
INSTRUCTION FOR PRINTING?
NO
YES
5

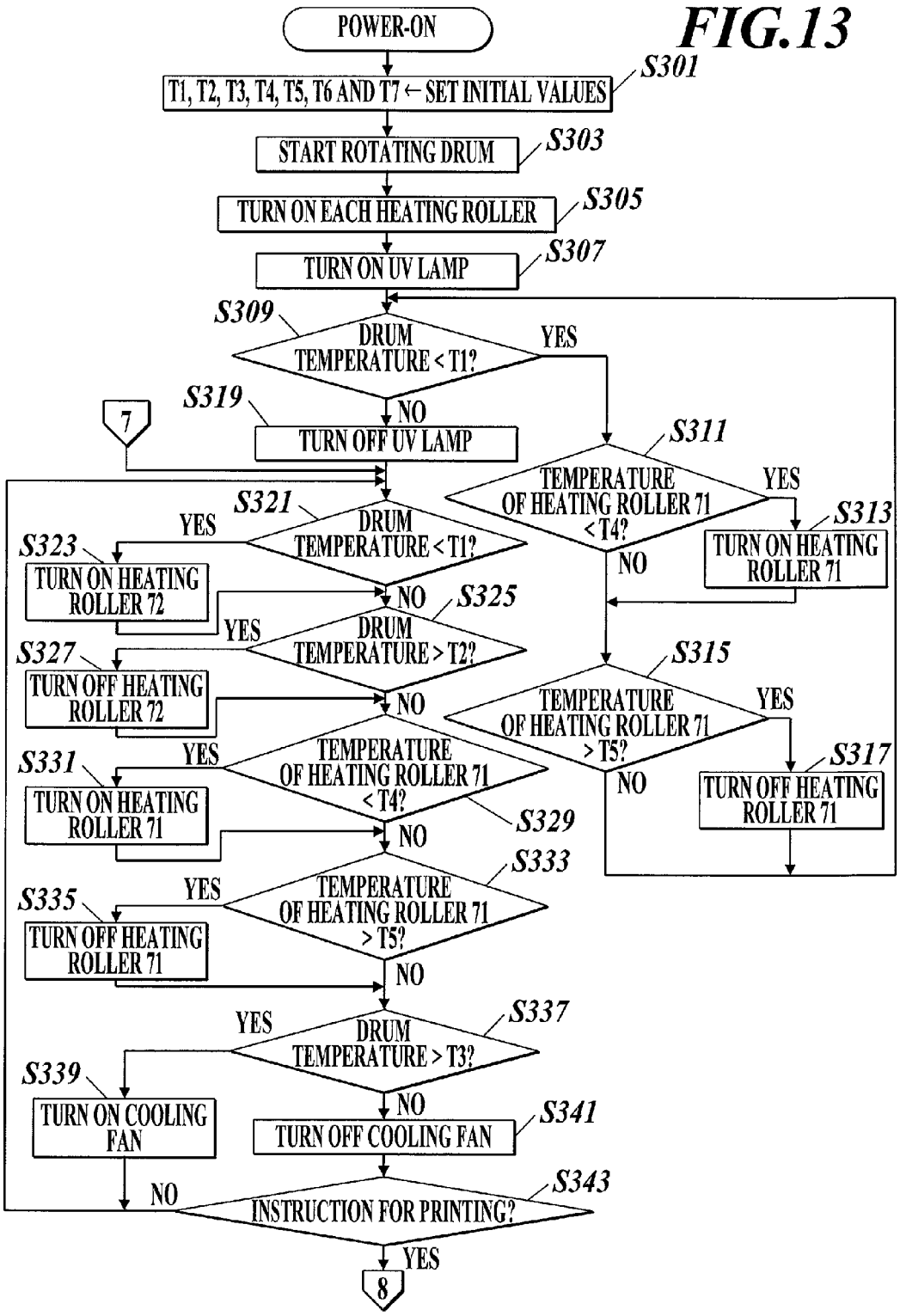
FIG.13
POWER-ON
T1, T2, T3, T4, T5, T6 AND T7 ← SET INITIAL VALUES
S301
START ROTATING DRUM
S303
TURN ON EACH HEATING ROLLER
S305
TURN ON UV LAMP
S307
S309
DRUM TEMPERATURE < T1?
YES
NO
S319
TURN OFF UV LAMP
7
S311
TEMPERATURE OF HEATING ROLLER 71 < T4?
YES
NO
S313
TURN ON HEATING ROLLER 71
S321
DRUM TEMPERATURE < T1?
YES
NO
S323
TURN ON HEATING ROLLER 72
S325
DRUM TEMPERATURE > T2?
YES
NO
S327
TURN OFF HEATING ROLLER 72
S315
TEMPERATURE OF HEATING ROLLER 71 > T5?
YES
NO
S317
TURN OFF HEATING ROLLER 71
S331
TURN ON HEATING ROLLER 71
TEMPERATURE OF HEATING ROLLER 71 < T4?
YES
NO
S329
S333
TEMPERATURE OF HEATING ROLLER 71 > T5?
YES
NO
S335
TURN OFF HEATING ROLLER 71
S337
DRUM TEMPERATURE > T3?
YES
NO
S339
TURN ON COOLING FAN
S341
TURN OFF COOLING FAN
S343
INSTRUCTION FOR PRINTING?
NO
YES
8

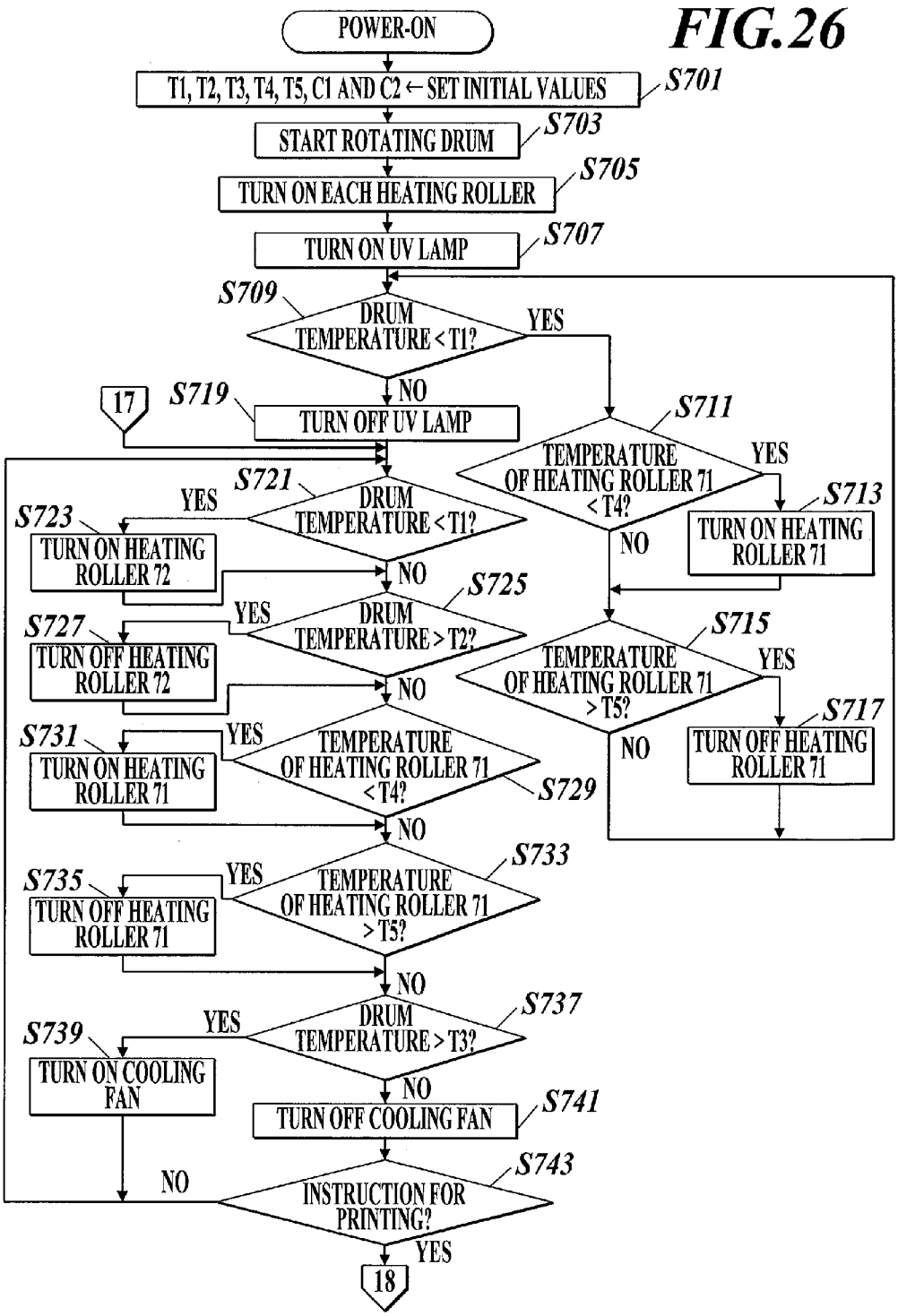
FIG.26
POWER-ON
T1, T2, T3, T4, T5, C1 AND C2 ← SET INITIAL VALUES
S701
START ROTATING DRUM
S703
TURN ON EACH HEATING ROLLER
S705
TURN ON UV LAMP
S707
S709
DRUM TEMPERATURE < T1?
YES
NO
17
S719
TURN OFF UV LAMP
S711
TEMPERATURE OF HEATING ROLLER 71 < T4?
YES
NO
S713
TURN ON HEATING ROLLER 71
S721
DRUM TEMPERATURE < T1?
YES
S723
TURN ON HEATING ROLLER 72
NO
S725
DRUM TEMPERATURE > T2?
YES
S727
TURN OFF HEATING ROLLER 72
NO
S715
TEMPERATURE OF HEATING ROLLER 71 > T5?
YES
NO
S717
TURN OFF HEATING ROLLER 71
S731
TURN ON HEATING ROLLER 71
YES
TEMPERATURE OF HEATING ROLLER 71 < T4?
S729
NO
S733
TEMPERATURE OF HEATING ROLLER 71 > T5?
YES
S735
TURN OFF HEATING ROLLER 71
NO
S737
DRUM TEMPERATURE > T3?
YES
S739
TURN ON COOLING FAN
NO
TURN OFF COOLING FAN
S741
S743
INSTRUCTION FOR PRINTING?
NO
YES
18

INKJET RECORDING DEVICE

TECHNICAL FIELD

The present invention relates to an inkjet image recording device which ejects energy-ray curable ink onto a recording medium to record images.

BACKGROUND ART

In recent years, it has been possible to form high-definition images with an inkjet recording system having a relatively-simple structure. Such an inkjet recording system has become more and more versatile.

Such an inkjet recording system, however, has difficulty ejecting ink whose viscosity is not low. As a result, when image formation is performed on a recording medium that does not absorb ink well, the phenomena called bleed and beading occur. The bleed is a phenomenon where inks are mixed between dots of different colors, and the beading is a phenomenon where the shades of the same color look like beads.

In view of this, the problems have been solved with an image forming device including a head to eject ink whose viscosity is lowered at a high temperature, a transfer drum on which surface image formation is performed when the ink is ejected, a heater to heat the transfer drum, a roller to nip a recording medium with the transfer drum so as to apply pressure to the recording medium, and a heater to heat a recording medium before the medium contacts the transfer drum (see Patent Literature 1, for example).

In this image forming device, when ink is ejected onto the transfer drum, the transfer drum cools the ink dots, which leads to an increase in the viscosity of the ink and leads to prevention of bleed and beading. The ink dots which form an image on the surface of the transfer drum are heated with the heater by the time the ink dots come into contact with a recording medium. A formed image of ink is transferred to a recording medium at the position where the recording medium is pressed against the transfer drum when the recording medium is heated with the heater.

PRIOR ART DOCUMENTS

Patent Documents

Patent Literature 1: Japanese Unexamined Patent Application Publication No. 7-276621

DISCLOSURE OF INVENTION

Problems to be Solved by the Invention

The conventional image forming device, however, has a problem of a deterioration in image quality owing to a slippage between the transfer drum and a recording medium because the device employs an intermediate transfer method where the ink is ejected onto the drum to form an image thereon, and after that, the image is transferred to a recording medium from the drum. Further, the conventional image forming device needs a cleaning section to remove residual ink on the transfer drum, which results in an increase in complexity of the device and cost.

The present invention intends to form images of high quality with an inkjet recording system, and further to decrease complexity of the device.

Means for Solving Problems

In order to solve the above-mentioned problems, an inkjet recording device according to the present invention is an inkjet recording device which ejects ink to perform recording on a recording medium, the inkjet recording device including: an image forming drum which holds the recording medium on an outer peripheral surface thereof; a recording medium supplying section which supplies the recording medium to the image forming drum; a recording head which ejects the ink onto the recording medium supplied to the image forming drum to perform image formation; a first heating unit which heats the recording medium held on the image forming drum, the first heating unit heating the recording medium before the recording is performed thereon by the recording head; a second heating unit which heats the outer peripheral surface of the image forming drum downstream of the position at which the recording medium is outputted after the recording is performed on the recording medium by the recording head and upstream of the recording medium supplying section in a rotation direction of the image forming drum; a heating-unit temperature detector which detects the temperature of the first heating unit; a drum temperature detector which detects the temperature of the image forming drum; and a heating control section which controls each of the first heating unit and the second heating unit, wherein the heating control section performs heat control of the first heating unit such that the temperature detected by the heating-unit temperature detector falls within a predetermined range of heating-unit set temperature; and wherein the heating control section performs heat control of the second heating unit such that the temperature detected by the drum temperature detector falls within a predetermined range of image-forming-drum set temperature.

In addition to the above-described configuration, the present invention may be configured so that the first heating unit includes a plurality of heating bodies; so that the heating-unit temperature detector includes a plurality of detecting units each of which detects the temperature of a heating body of the heating bodies; and so that the heating control section performs heat control of each of the heating bodies such that the temperature detected by the detecting unit falls within the range of heating-unit set temperature predetermined for the heating body.

In addition to the above-described configuration, the present invention may be configured so that the second heating unit includes a plurality of heating bodies; and so that the heating control section performs heat control of each of the heating bodies of the second heating unit such that the temperature detected by the drum temperature detector falls within the predetermined range of image-forming-drum set temperature.

In addition to the above-described configuration, the present invention may further include a recording medium thickness acquiring section which acquires the thickness of the recording medium, and may be configured so that the heating control section determines the range of heating-unit set temperature according to the thickness of the recording medium acquired by the recording medium thickness acquiring section.

In addition to the above-described configuration, the present invention may further include a recording medium type acquiring section which acquires the type of the recording medium, and may be configured so that the heating control section determines the range of heating-unit set temperature according to the type of the recording medium acquired by the recording medium type acquiring section.

In addition to the above-described configuration, the present invention may further include a first recording medium temperature detector which detects the temperature of the recording medium heated by the first heating unit, the first recording medium temperature detector detecting the temperature of the recording medium before the recording is performed thereon by the recording head, and may be configured so that the heating control section changes the range of heating-unit set temperature of the first heating unit on the basis of the temperature detected by the first recording medium temperature detector.

In addition to the above-described configuration, the present invention may further include a second recording medium temperature detector which detects the temperature of the recording medium after the recording is performed thereon by the recording head, and may be configured so that the heating control section changes at least one of the range of heating-unit set temperature of the first heating unit and the range of image-forming-drum set temperature on the basis of the temperature detected by the second recording medium temperature detector.

In addition to the above-described configuration, the present invention may further include a dot diameter measuring section which measures the dot diameter of the ink recorded on the recording medium by the recording head, and may be configured so that the heating control section changes at least one of the range of heating-unit set temperature and the range of image-forming-drum set temperature on the basis of the dot diameter measured by the dot diameter measuring section.

In addition to the above-described configuration, the present invention may further include a gloss measuring section which measures the gloss of an image recorded on the recording medium by the recording head, and may be configured so that the heating control section changes at least one of the range of heating-unit set temperature and the range of image-forming-drum set temperature on the basis of the gloss measured by the gloss measuring section.

In addition to the above-described configuration, the present invention may further include a gloss adjustment input section with which the degree of gloss of an image to be recorded on the recording medium is inputted to be set by an operator, and may be configured so that the heating control section changes at least one of the range of heating-unit set temperature and the range of image-forming-drum set temperature on the basis of the gloss set with the gloss adjustment input section.

The present invention may be an inkjet recording device which ejects ink to perform recording on a recording medium, the inkjet recording device including: an image forming drum which holds the recording medium on an outer peripheral surface thereof; a recording medium supplying section which supplies the recording medium to the image forming drum; a recording head which ejects the ink onto the recording medium supplied to the image forming drum to perform image formation; a first heating unit which electrically heats the recording medium held on the image forming drum, the first heating unit heating the recording medium before the recording is performed thereon by the recording head; a second heating unit which heats the outer peripheral surface of the image forming drum downstream of the position at which the recording medium is outputted after the recording is performed on the recording medium by the recording head and upstream of the recording medium supplying section in a rotation direction of the image forming drum; a drum temperature detector which detects the temperature of the image forming drum; at least one of a recording medium thickness acquiring section which acquires the thickness of the recording medium, and a recording medium type acquiring section which acquires the type of the recording medium; and a heating control section which controls each of the first heating unit and the second heating unit, wherein the heating control section controls one of an electrical power, an electrical voltage and an electrical current which are supplied to the first heating unit according to at least one of the thickness of the recording medium acquired by the recording medium thickness acquiring section and the type of the recording medium acquired by the recording medium type acquiring section; and wherein the heating control section performs heat control of the second heating unit such that the temperature detected by the drum temperature detector falls within a predetermined range of image-forming-drum set temperature.

In addition to the above-described configuration without a heating-unit temperature detector, the present invention may further include a first recording medium temperature detector which detects the temperature of the recording medium heated by the first heating unit, the first recording medium temperature detector detecting the temperature of the recording medium before the recording is performed thereon by the recording head, and may be configured so that the heating control section changes at least one of (i) the electrical power, (ii) the electrical voltage and (iii) the electrical current which are supplied to the first heating unit and (iv) the range of image-forming-drum set temperature on the basis of the temperature detected by the first recording medium temperature detector.

In addition to the above-described configuration without a heating-unit temperature detector, the present invention may further include a second recording medium temperature detector which detects the temperature of the recording medium after the recording is performed thereon by the recording head, and may be configured so that the heating control section changes at least one of (i) the electrical power, (ii) the electrical voltage and (iii) the electrical current which are supplied to the first heating unit and (iv) the range of image-forming-drum set temperature on the basis of the temperature detected by the second recording medium temperature detector.

In addition to the above-described configuration without a heating-unit temperature detector, the present invention may further include a dot diameter measuring section which measures the dot diameter of the ink recorded on the recording medium by the recording head, and may be configured so that the heating control section changes at least one of (i) the electrical power, (ii) the electrical voltage and (iii) the electrical current which are supplied to the first heating unit and (iv) the range of image-forming-drum set temperature on the basis of the dot diameter measured by the dot diameter measuring section.

In addition to the above-described configuration without a heating-unit temperature detector, the present invention may further include a gloss measuring section which measures the gloss of an image recorded on the recording medium by the recording head, and may be configured so that the heating control section changes at least one of (i) the electrical power, (ii) the electrical voltage and (iii) the electrical current which are supplied to the first heating unit and (iv) the range of image-forming-drum set temperature on the basis of the gloss measured by the gloss measuring section.

In addition to the above-described configuration without a heating-unit temperature detector, the present invention may further include a gloss adjustment input section with which the degree of gloss of an image to be recorded on the recording medium is inputted to be set by an operator, and may be configured so that the heating control section changes at least one of (i) the electrical power, (ii) the electrical voltage and (iii) the electrical current which are supplied to the first heating unit and (iv) the range of image-forming-drum set temperature on the basis of the gloss set with the gloss adjustment input section.

In addition to the above-described configuration, the present invention may further include a cooling section which cools the image forming drum, and may be configured so that the heating control section performs cooling control of the cooling section such that the temperature detected by the drum temperature detector falls within the predetermined range of image-forming-drum set temperature.

In addition to the above-described configuration, the present invention may be configured so that the heating control section performs heat control of the first heating unit so as to perform preheating of the image forming drum to which the recording medium is not supplied when a main power supply is turned on.

In addition to the above-described configuration, the present invention may be configured so that the ink is cured by being irradiated with energy rays; the present invention may further include an energy-ray irradiation section which irradiates the recording medium on the image forming drum with the energy rays, the recording medium having an image recorded thereon by the recording head; and the present invention may be configured so that the heating control section performs irradiation control of the energy-ray irradiation section so as to perform preheating of the image forming drum to which the recording medium is not supplied when a main power supply is turned on.

Effects of the Invention

The present invention maintains the temperature of an image forming drum at a predetermined range of image-forming-drum set temperature. Therefore, how the dots spread on a recording medium can be controlled, and a recorded image having a constant smoothness and gloss can be obtained. Further, a recording head performs image formation on a recording medium on the image forming drum, instead of transferring the image formed on a drum to a recording medium as in a conventional case. This avoids image deterioration owing to the transfer, and can maintain high image quality. Further, this eliminates the need for a cleaning section which is required at the time of transferring of an image.

Further, since the device includes a first heating unit which heats a recording medium and a second heating unit which heats the image forming drum, the temperature of a recording medium can be raised to an intended temperature in a short period of time.

When the first heating unit includes a plurality of heating bodies and heats a recording medium while the temperature of each heating body is maintained within a predetermined range of heating-unit set temperature in the present invention, the temperature of a recording medium can be raised to an intended temperature in a short period of time for recording media having various thicknesses and types.

When the second heating unit includes a plurality of heating bodies in the present invention, the temperature of the image forming drum can be raised to an intended temperature in a short period of time at the time of start-up. Further, the image forming drum can be maintained at an intended temperature during image recording even when the environmental temperature is low.

When the range of heating-unit set temperature is determined according to the thickness of a recording medium in the present invention, the temperature of a recording medium can be maintained at an intended temperature for recording media having various thicknesses. Further, how the dots spread on a recording medium can be controlled more effectively, and a recorded image having a constant smoothness and gloss can be obtained.

When the range of heating-unit set temperature is determined according to the type of recording medium in the present invention, the temperature of a recording medium can be maintained at an intended temperature for recording media having various heat characteristics. Further, how the dots spread on a recording medium can be controlled more effectively, and a recorded image having a constant smoothness and gloss can be obtained.

When the temperature of a recording medium heated by the first heating unit is detected before recording is performed on the medium by the recording head, and a first predetermined range of temperature is changed in the present invention, the temperature of a recording medium can be maintained at an intended temperature for various recording media. Further, how the dots spread on a recording medium can be controlled more effectively, and a recorded image having a constant smoothness and gloss can be obtained.

When the temperature of a recording medium is detected after recording is performed on the medium by the recording head, and at least one of the range of heating-unit set temperature and the range of image-forming-drum set temperature is changed in the present invention, the influence of temperature change during a recording period by the recording head is reduced. Further, the temperature of a recording medium can be maintained at an intended temperature, and how the dots spread on a recording medium can be controlled more effectively, and a recorded image having a constant smoothness and gloss can be obtained.

When the dot diameter of ink recorded on a recording medium is measured, and at least one of the range of heating-unit set temperature and the range of image-forming-drum set temperature is changed in the present invention, how the dots spread on a recording medium can be controlled more effectively, and a recorded image having a constant smoothness and gloss can be obtained.

When the gloss of an image which has been recorded by the recording head is measured, and at least one of the range of heating-unit set temperature and the range of image-forming-drum set temperature is changed in the present invention, a recorded image having a constant gloss can be obtained.

When an operator inputs the degree of gloss, and at least one of the range of heating-unit set temperature and the range of image-forming-drum set temperature is changed on the basis of the set gloss in the present invention, the operator can adjust the smoothness and gloss of a recorded image as he/she chooses.

When one of an electrical power, an electrical voltage and an electrical current which are supplied to the first heating unit is controlled according to at least one of the thickness of a recording medium acquired by a recording medium thickness acquiring section and the type of recording medium acquired by a recording medium type acquiring section, and the heat control of the second heating unit is performed such that the temperature detected by the drum temperature detector falls within a predetermined range of image-forming-drum set temperature, the temperature of the image forming drum is maintained at the predetermined range of image-forming-drum set temperature. Therefore, how the dots spread on a recording medium can be controlled, and a recorded image having a constant smoothness and gloss can be obtained. Further, since image formation on a drum is not performed, image deterioration owing to the transfer is avoided, and the need for a cleaning section required at the time of transferring of an image is eliminated.

Further, since the device includes a first heating unit which heats a recording medium and a second heating unit which heats the image forming drum, the temperature of a recording medium can be raised to an intended temperature in a short period of time.

When one of an electrical power, an electrical voltage and an electrical current which are supplied to the first heating unit is controlled according to the thickness of a recording medium, heating can be performed according to the thickness of a recording medium for recording media having various thicknesses. Further, how the dots spread on a recording medium can be controlled more effectively, and a recorded image having a constant smoothness and gloss can be obtained.

When one of an electrical power, an electrical voltage and an electrical current which are supplied to the first heating unit is controlled according to the type of recording medium, heating can be performed according to the type of recording medium for recording media having various heat characteristics. Further, how the dots spread on a recording medium can be controlled more effectively, and a recorded image having a constant smoothness and gloss can be obtained.

In the above-described configuration without a heating-unit temperature detector, when the temperature of a recording medium heated by the first heating unit is detected before recording is performed on the medium by the recording head, and one of an electrical power, an electrical voltage and an electrical current which are supplied to the first heating unit is changed, heating can be performed according to recording medium for various recording media. Further, how the dots spread on a recording medium can be controlled more effectively, and a recorded image having a constant smoothness and gloss can be obtained.

In the above-described configuration without a heating-unit temperature detector, when the temperature of a recording medium is detected after recording is performed on the medium by the recording head, and one of an electrical power, an electrical voltage and an electrical current which are supplied to the first heating unit is changed, the influence of temperature change during a recording period by the recording head is reduced. Further, heating can be performed according to the temperature change. Thus, how the dots spread on a recording medium can be controlled more effectively, and a recorded image having a constant smoothness and gloss can be obtained.

In the present invention without a heating-unit temperature detector, when the dot diameter of ink recorded on a recording medium is measured, and at least one of (i) an electrical power, (ii) an electrical voltage and (iii) an electrical current which are supplied to the first heating unit and (iv) the range of image-forming-drum set temperature is changed, how the dots spread on a recording medium can be controlled more effectively, and a recorded image having a constant smoothness and gloss can be obtained.

In the present invention without a heating-unit temperature detector, when the gloss of an image is measured after the image is recorded by the recording head, and at least one of (i) an electrical power, (ii) an electrical voltage and (iii) an electrical current which are supplied to the first heating unit and (iv) the range of image-forming-drum set temperature is changed, a recorded image having a constant gloss can be obtained.

In the present invention without a heating-unit temperature detector, when an operator inputs the degree of gloss, and at least one of (i) an electrical power, (ii) an electrical voltage and (iii) an electrical current which are supplied to the first heating unit and (iv) the range of image-forming-drum set temperature is changed on the basis of the set gloss, the operator can adjust the smoothness and gloss of a recorded image as he/she chooses.

When the device further includes a cooling section which cools the image forming drum in the present invention, the temperature of the image forming drum can be maintained at a predetermined range of temperature even when the image forming drum is overheated. Therefore, how the dots spread on a recording medium can be controlled more effectively, and a recorded image having a constant smoothness and gloss can be obtained.

When the first heating unit performs preheating of the image forming drum with no recording medium supplied after the main power supply is turned on in the present invention, the temperature of the image forming drum rises and the inkjet recording device is ready for image recording in a short period of time.

When the image forming drum is heated by being irradiated with energy rays after the main power supply is turned on in the present invention, the temperature of the image forming drum rises and the inkjet recording device is ready for image recording in a short period of time.

BRIEF DESCRIPTION OF DRAWINGS

FIG. 8 is a flowchart showing the operation control at the time of image formation of the first embodiment;

FIG. 13 is a flowchart showing the operation control at the time of image formation of the second embodiment of the present invention;

FIG. 26 is a flowchart showing the operation control at the time of image formation of the fourth embodiment of the present invention;

EMBODIMENTS FOR CARRYING OUT THE INVENTION

[First Embodiment]

Figure 1:
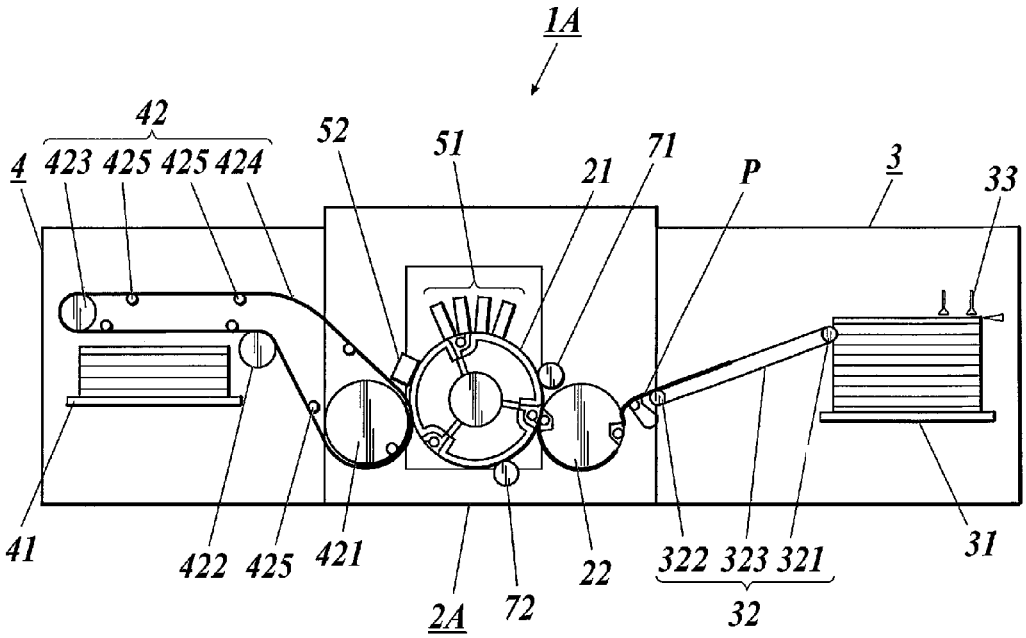
FIG. 1 is a typical view showing the internal configuration of an inkjet recording device of the first embodiment of the present invention.

The best modes to carry out the present invention are described below with reference to the drawings. Although various limitations which are technically preferable to carry out the present invention are added in the embodiments below, the scope of the invention is not limited to the embodiments below and the examples shown in the drawings.

[Entire Configuration]

FIG. 1 is a typical view of the internal configuration of an inkjet recording device as an image forming device of the first embodiment of the present invention. As shown in FIG. 1, an inkjet recording device 1A of the present embodiment includes an image forming unit 2A, a paper feed unit 3 which feeds paper to the image forming unit 2A, and an accumulation unit 4 which accumulates a recording medium P on which image formation has been performed at the image forming unit 2A.

[Paper Feed Unit]

The paper feed unit 3 includes a paper feed tray 31 for storing recording media P, a conveying unit 32 for paper feeding for conveying a recording medium P from the paper feed tray 31 to the image forming 2A, a supplying unit 33 which supplies a recording medium P in the paper feed tray 31 to the conveying unit 32. The conveying unit 32 includes a pair of conveying rollers 321 and 322 for paper feeding, and a conveying belt 323 for paper feeding is stretched between the conveying rollers 321 and 322. The conveying belt 323 carries a recording medium P supplied from the paper feed tray 31 by the supplying unit 33 to the image forming unit 2A.

[Accumulation Unit]

The accumulation unit 4 includes a storage tray 41 for storing a recording medium P on which image formation has been performed, and a conveying unit 42 for accumulation which conveys a recording medium P from the image forming unit 2A to the storage tray 41. The conveying unit 42 includes a plurality of conveying chain sprockets 421, 422 and 423 for accumulation. Among the plurality of conveying chain sprockets 421 to 423, one conveying chain sprocket 421 is disposed in the image forming unit 2, and the other conveying chain sprockets 422 and423 are disposed in the accumulation unit 4. A recording medium P on which image formation has been performed at the image forming unit 2A is conveyed, with the recording medium P held on the conveying belt 424 by nails 425 for accumulation. When the recording medium P comes to the position above the storage tray 41, the recording medium P is released from the nails 425 and put into the storage tray 41.

[Image Forming Unit]

Figure 2:
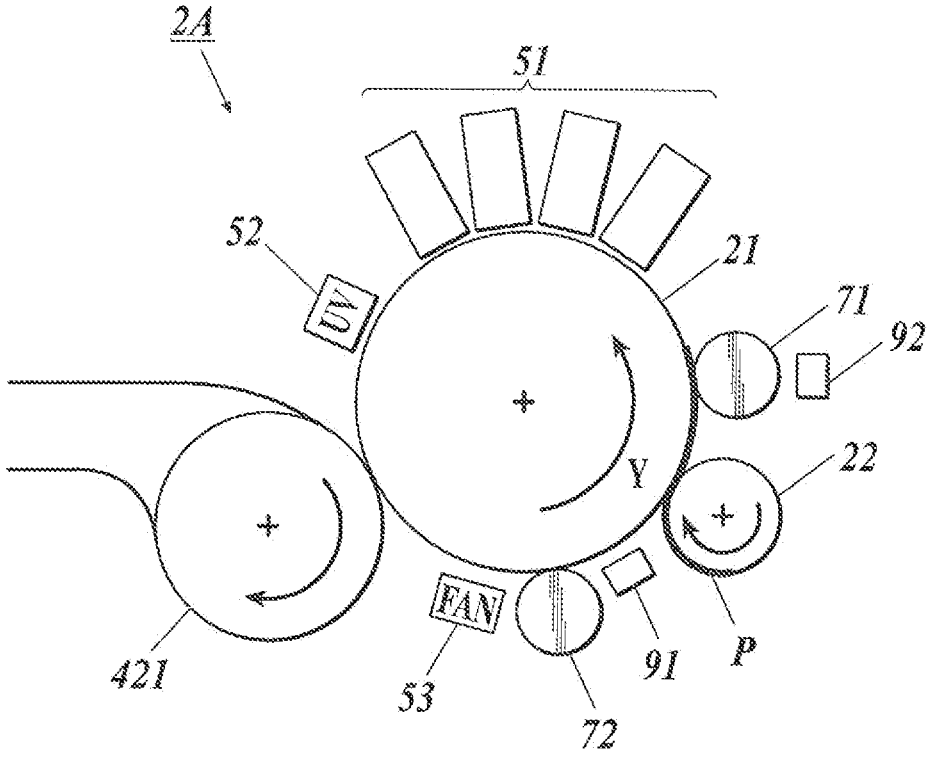
FIG. 2 is a typical view showing the internal configuration of an image forming unit of the first embodiment.

FIG. 2 is a typical view showing the internal configuration of the image forming unit 2A. As shown in FIG. 2, in order to perform image formation on a recording medium P, the image forming unit 2A includes an image forming drum 21 which holds a recording medium P on its surface, and a delivering drum 22 as a recording medium supplying section which delivers a recording medium P, which is carried from the paper feed unit 3, to the image forming drum 21.

The delivering drum 22 includes a plurality of nails 221 to catch one end portion of a recording medium P, and an adsorption section (not shown) to make a recording medium P stick to the outer peripheral surface of the delivering drum 22, so as to hold a recording medium P at the outer peripheral surface. The adsorption section makes a recording medium P to stick to the outer peripheral surface of the delivering drum 22 by an electrostatic adsorption or suction. A part of the outer periphery of the delivering drum 22 is adjacent to the image forming drum 21. The delivering drum 22 delivers a recording medium P to the image forming drum 21 at this adjacent part.

Figure 3:
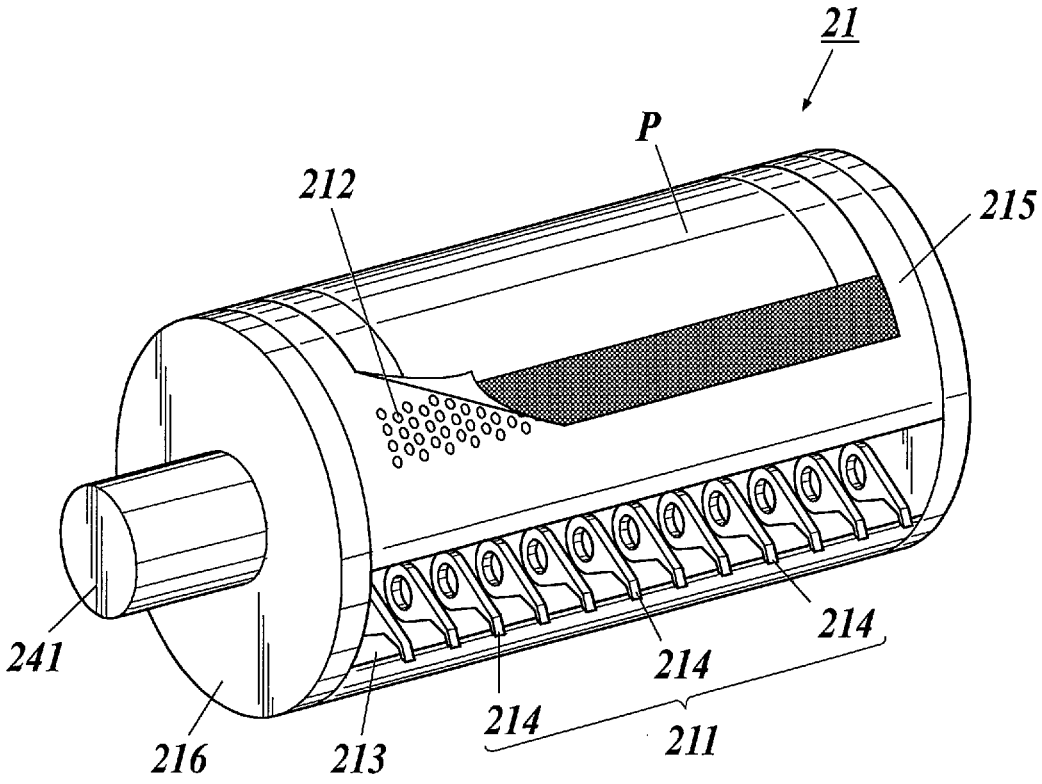
FIG. 3 is a perspective view showing the schematic configuration of an image forming drum of the first embodiment.
Figure 4:
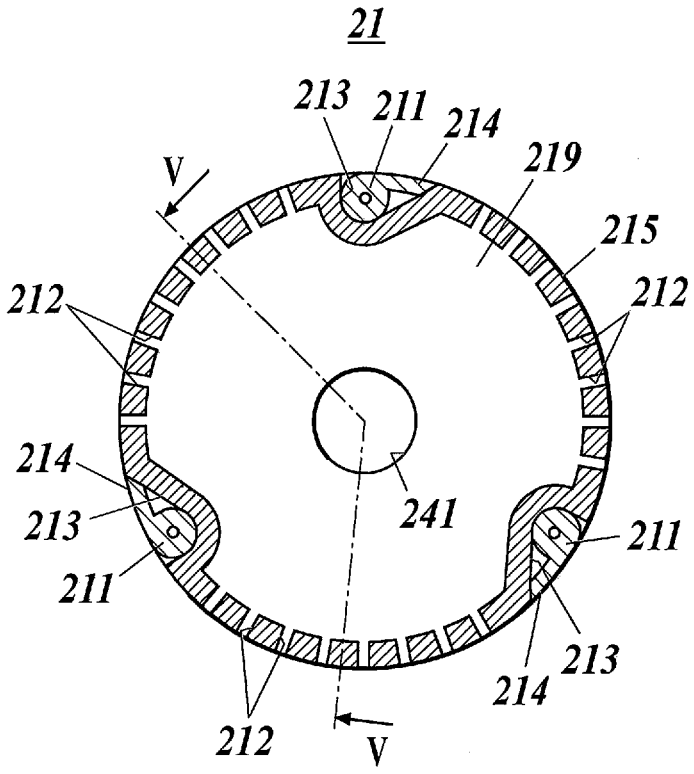
FIG. 4 is a cross-sectional view showing the schematic configuration of the image forming drum of FIG. 3, and is a cross-sectional view viewed from the cutting plane along the line IV-IV of FIG. 5.

FIG. 3 is a perspective view showing the schematic configuration of the image forming drum 21. FIG. 4 is a cross-sectional view showing the schematic configuration of the image forming drum 21, and is a cross-sectional view viewed from the cutting plane along the line IV-IV of FIG. 5.

Figure 5:
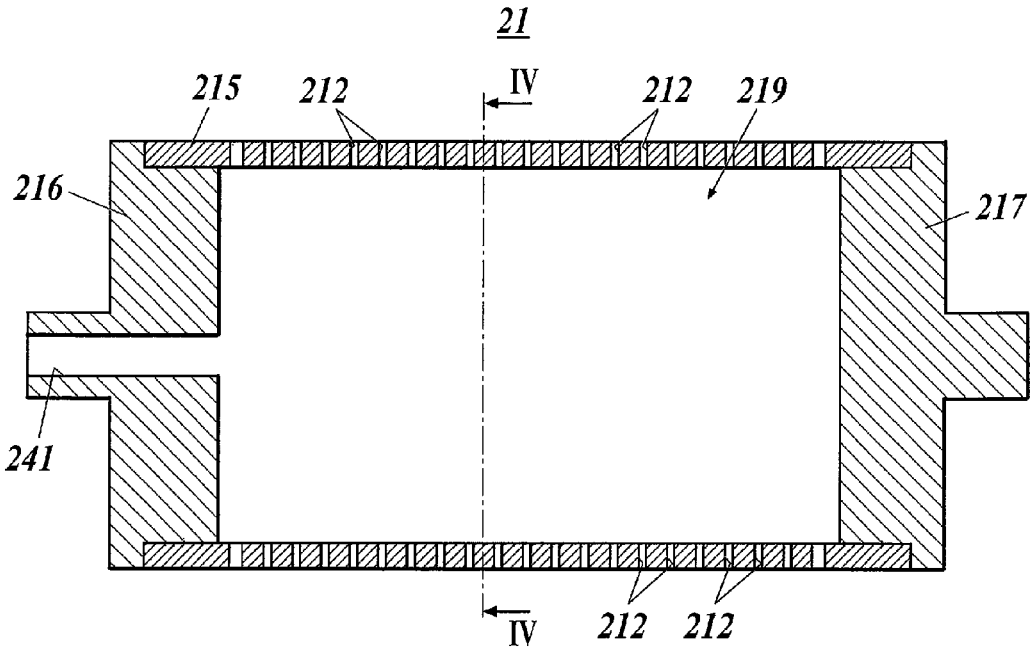
FIG. 5 is a cross-sectional view showing the schematic configuration of the image forming drum of FIG. 3, and is a cross-sectional view viewed from the cutting plane along the line V-V of FIG. 4.

FIG. 5 is a cross-sectional view showing the schematic configuration of the image forming drum 21, and is a cross-sectional view viewed from the cutting plane along the line V-V of FIG. 4. The image forming drum 21 is an inkjet image forming drum in accordance with the present invention. As show in FIGS. 3 to 5, the image forming drum 21 includes a main body section 215, which is a hollow cylinder; and a pair of supporting sections 216 and 217 which are separate from the main body section 215 and support the both ends of the main body section 215.

Around the main body section 215, a plurality of nails 211 to catch one end portion of a recording medium P are provided so that the main body section 215 holds a recording medium P on its outer peripheral surface. The nails 211 are contained along the axis direction in each of concave portions 213 formed on the outer peripheral surface of the main body section 215. The tips 214 of the nails 211 can touch and get out of touch with the outer peripheral surface of the image forming drum 21. A recording medium P is held on the outer peripheral surface of the image forming drum 21 in such a way that the tips 214 of the nails 211 and the outer peripheral surface of the image forming drum 21 catch the end portion of the recording medium P.

Around the main body section 215, a plurality of suction holes 212 are formed for a recording medium P to stick to the outer peripheral surface of the main body section 215.

The pair of supporting sections 216 and 217 stick to the main body section 215 over its entire circumference. Among the pair of supporting sections 216 and 217, one supporting section 216 has a communication opening 241 which communicates with the interior of the hollow portion 219 of the main body section 215. A suction pump (not shown), for example, is connected to the communication opening 241. The suction pump causes the hollow portion 219 of the image forming drum 21 to be at a negative pressure. When the hollow portion 219 is at a negative pressure, a recording medium P sticks to the outer peripheral surface of the main body section 215 through the suction holes 212.

The plurality of suction holes of the adsorption section 212 are arranged in a pattern having blue noise characteristics. Therefore, even when the marks of the suction holes are left on a recording medium P after image formation, the irregular patter makes the marks visually inconspicuous. Further, since the suction holes are disposed only in the area outside of the image formation area of a recording medium P, the marks of the suction holes are prevented from being left in the image formation area.

The image forming unit 2A uses an ink (described later in detail) which changes in phase from a gel form to a liquid form in accordance with temperature. At the time of image formation, temperature regulation is performed by heating a recording medium P so as to control the smoothness and the gloss of ink dots. Therefore, it is assumed that the image forming drum 21 is heated, and the outer peripheral surface of the image forming drum 21 has a multi-layer structure where a heat-storage layer is formed on a heat-insulating layer.

As shown in FIG. 2, the image forming unit 2A includes a plurality of recording heads 51, a UV lamp 52, a drum temperature sensor 91, heating rollers 71 and 72 and a cooling fan 53, which are disposed around the image forming drum 21.

The recording heads 51 are linear recording heads and are arranged in the circumferential direction of the image forming drum 21. Each recording head 51 extends over the entire length of the image forming drum 21. The inkjet recording device 1A in accordance with the present embodiment includes four recording heads 51 in all to eject inks of four colors of Black (K), Yellow (Y), Magenta (M) and Cyan (C). The number of recording heads may be increased or decreased according to the number of required colors.

The inks ejected from the recording heads 51 change in phase between a gel form or solid form and liquid form in accordance with temperature. The inks have a phase transition point at not less than 40° C. and less than 100° C. Among the inks ejected from the recording heads 51, an ink ejected at the upstream side in the conveyance direction Y has a higher phase transition temperature than an ink ejected at the downstream side in the conveyance direction Y. Specifically, when the recording heads 51 consist of a first recording head 51A, a second recording head 51B, a third recording head 51C and a fourth recording head 51D in the order named from the upstream side; and when the phase transition temperature of the ink ejected from the first recording head 51A is P1, the phase transition temperature of the ink ejected from the second recording head 51B is P2, the phase transition temperature of the ink ejected from the third recording head 51C is P3, and the phase transition temperature of the ink ejected from the fourth recording head 51D is P4, the relationship of P1>P2>P3>P4 holds.

The phase transition temperature of an ink can be adjusted by varying the type of gelling agent to be added to ink, the amount of added gelling agent, and the type of activating beam curable monomer. By performing such adjustments, the phase transition temperature of an ink ejected at the upstream side in the conveyance direction Y is set to be higher than that of an ink ejected at the downstream side in the conveyance direction Y, as described above. Specifically, among the recording heads 51, the phase transition temperature of the ink ejected from each recording head 51 is adjusted such that the difference between the phase transition temperatures of the inks ejected from a pair recording heads 51, respectively, adjacent to each other in the conveyance direction Y falls within the range of not less than 0.5° C. and not more than 10° C., and more preferably, in the range of not less than 1° C. and not more than 5° C. The details about ink are described later.

As shown in FIG. 2, a UV (ultraviolet) lamp 52 as an energy-ray irradiation section, which emits energy rays such as ultraviolet rays, is disposed immediately downstream of the recording heads 51 in the conveyance direction Y of a recording medium P. The UV lamp 52 extends over the entire length of the image forming drum 21, and irradiates a recording medium P on the image forming drum 21 with energy rays.

When ultraviolet rays are used as the energy rays, the examples of a source of ultraviolet irradiation include a fluorescent tube (low-pressure mercury lamp and a sterilization lamp); a cold-cathode tube; an ultraviolet laser; low-pressure, medium-pressure and high-pressure mercury lamps having an operating pressure of from several hundred Pa to 1 MPa; a metal halide lamp; and an LED. In the light of curability, a light source which can emit UV light having a high illumination intensity of 100 mW/cm$^2$ or more, such as a high-pressure mercury lamp, a metal halide lamp, and an LED, is preferable. Above all, an LED which consumes less power is preferable, but the light source is not limited thereto.

Immediately downstream of the UV lamp 52 in the conveyance direction Y, the conveying roller 421 for accumulation of the conveying unit 42 mentioned above is disposed. A part of the outer periphery of the conveying roller 421 is adjacent to the image forming drum 21 via the conveying belt 424. A recording medium P is delivered from the image forming drum 21 to the conveying belt 424 at the adjacent part.

Further, immediately downstream of the conveying roller 421, the cooling fan 53 which sends air to cool the outer peripheral surface of the image forming drum 21 is disposed.

Immediately downstream of the cooling fan 53, the heating roller 72 of a second heating unit is disposed. Further, immediately downstream the heating roller 72, the drum temperature sensor 91 as a drum temperature detector, which measures the surface temperature of the image forming drum 21, is disposed. A contact-type temperature detection element, such as a thermocouple and a thermistor, may be used as the drum temperature sensor 91, but a contactless temperature detection element, such as a thermopile, is more preferable.

The heating roller 71 (heating body) of a first heating unit is disposed immediately downstream of the delivering drum 22 in the conveyance direction Y, i.e., disposed between the delivering drum 22 and the recording heads 51. The heating roller 71 heats a recording medium P held on the image forming drum 21 before recording is performed on the medium P by the recording heads 51. A part of the heating roller 71 is in contact with the outer peripheral surface of the image forming drum 21. At the time of image formation, a recording medium P is disposed between the heating roller 71 and the image forming drum 21. At this time, the heating roller 71 presses a recording medium P against the outer peripheral surface of the image forming drum 21 so as to bring the recording medium P into close contact with the image forming drum 21.

Figure 6:
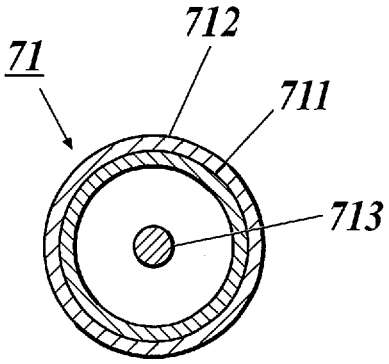
FIG. 6 is a cross-sectional view showing the schematic configuration of a heating roller of the first embodiment.

FIG. 6 is a cross-sectional view showing the schematic configuration of the heating roller 71. As shown in FIG. 6, the heating roller 71 includes a hollow pipe 711 composed of a metal such as aluminum; an elastic layer 712, such as a silicon rubber, which covers the entire circumference of the hollow pipe 711; and a heat source 713, such as a halogen heater, which is built in the hollow pipe 711 to heat the hollow pipe 711 and the elastic layer 712.

The elastic layer 712 is preferably made of material having good thermal conductivity. Further, the surface of the elastic layer 712 may be coated with a material (such as a PFA tube) which slide smoothly to improve durability.

The inkjet recording device 1A is provided with a heating-unit temperature sensor 92, in addition to the heating roller 71, to detect the temperature of the heating roller 71 of the first heating unit. A contact-type temperature detection element, such as a thermocouple and a thermistor, may be used as the temperature sensor 92, but a contactless temperature detection element, such as a thermopile, is more preferable, similarly to the drum temperature sensor 91.

The heating roller 72 (heating body) of the second heating unit, which is disposed downstream of the conveying roller 421 and upstream of the delivering drum 22 around the image forming drum 21 (to be more exact, which is disposed between the cooling fan 53 and the drum temperature sensor 91), has a structure identical to that of the heating roller 71 of the first heating unit.

[Main Control Configuration of Inkjet Recording Device]

Figure 7:
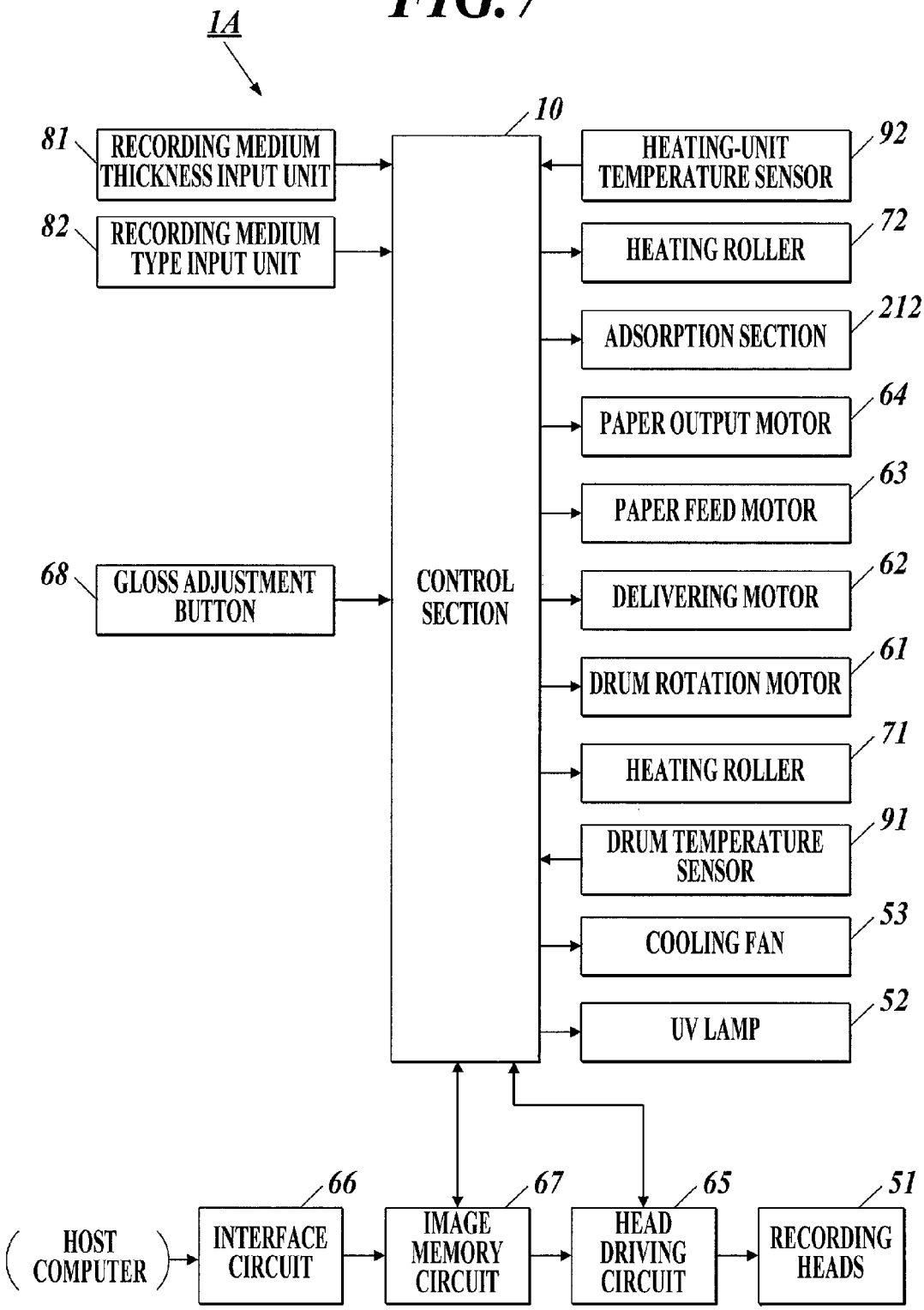
FIG. 7 is a block diagram showing the control system of the first embodiment.

FIG. 7 is a block diagram showing the main control configuration of the inkjet recording device 1A. As shown in FIG. 7, the control section 10 of the inkjet recording device 1A is electrically connected to a delivering motor 62 which rotates the delivering drum 22; a drum rotation motor 61 which rotates the image forming drum 21; a paper feed motor 63 which drives each driving section of the paper feed unit 3; a paper output motor 64 which drives each drive source of the accumulation unit 4; a head driving circuit 65 which drives the recording heads 51; the drum temperature sensor 91; the heating roller 71 of the first heating unit; the drum temperature sensor 91; the adsorption section 212; a gloss adjustment button 68 with which an operator inputs a setting for the degree of gloss of a formed image; a recording medium thickness input unit 81 and a recording medium type input unit 82.

The control section 10 is constituted of a ROM which stores a program to control each component of the inkjet recording device 1A, a CPU which executes the program, and a RAM which is a work area at the time of the execution of the program, for example.

Further, an image memory circuit 67 which stores the data of image to be formed inputted from a host computer as a higher-level device via an interface circuit 66 is provided in addition to the control section 10. The CPU of the control section 10 performs computing on the basis of image data stored in the image memory circuit 67 and the program, and sends a control signal to each component on the basis of the computing results.

The control section 10 serves as a heating control section which performs heat control of the heating roller 71.

The recording medium thickness input unit 81 is a unit with which an operator inputs the thickness of a recording medium P on which image formation is to be performed. The recording medium type input unit 82 is a unit with which an operator inputs the type of recording medium P on which image formation is to be performed.

The control section 10 performs heat control according to the thickness and the type of recording medium P. Specifically, the control section 10 stores table data where the set temperatures T4 and T5 of the heating roller 71 are set according to the two parameters of the type and thickness of recording medium P. The control section 10 performs the processing of determining the set temperatures T4 and T5 on the basis of the input of these.

The heating roller 71 is provided in order to raise the temperature of a recording medium P to a desired temperature range quickly. T4 and T5 are determined according to the thermal conductivity of the heating roller 71 and a contact time between the heating roller 71 and a recording medium P, for example.

The table below shows an example of the table data where the set temperatures T4 and T5 are set according to the two parameters of the type and thickness of recording medium P. The temperatures in the table are all expressed in Celsius. T1 in the table is the lower limit of the range of image-forming-drum set temperature, which is the target temperature band of the image forming drum 21 at the time of image formation; T2 is the intermediate value of the range of image-forming-drum set temperature; and T3 is the upper limit of the range of set temperature of the image forming drum 21.

TABLE 1

| | | | | UNIT ° C. THICKNESS OF RECORDING MEDIUM | | | | | |
|---|---|---|---|---|---|---|---|---|---|
| | | | | 0.1-0.2 mm | | 0.2-0.4 mm | | 0.3-0.6 mm | |
| TYPE OF RECORDING MEDIUM | T1 | T2 | T3 | T4 | T5 | T4 | T5 | T4 | T5 |
| GOOD QUALITY PAPER | 40 | 45 | 46 | 108 | 114 | 131 | 138 | 154 | 162 |
| COATED PAPER | 42 | 47 | 48 | 111 | 117 | 137 | 144 | 162 | 171 |
| CAST-COATED PAPER | 43 | 48 | 49 | 114 | 120 | 143 | 150 | 171 | 180 |
| CLEAR PET | 43 | 48 | 49 | 105 | 111 | 125 | 132 | 145 | 153 |

[Ink]

The ink used in the present invention is an activating beam curable ink which is cured by being irradiated with energy rays (activating beams). The activating beam curable ink contains a gelling agent in an amount of 1 percent by mass or more but less than 10 percent by mass, and exhibits a reversible sol-gel phase transition depending on temperature. The term "so-gel phase transition" used herein refers to a phenomenon in which a liquid state at an elevated temperature is transformed into a non-fluid gel state at a cooled temperature lower than or equal to a gelation temperature, and the non-fluid gel state is reversibly transformed into a liquid state at an elevated temperature higher than or equal to the solation temperature.

The term "gelation" used herein refers to a solidified, semi-solidified, or thickened state accompanied by sharp increases in viscosity and elasticity; for example, a lamella structure, a polymer network formed by non-covalent bonds or hydrogen bonds, a polymer network formed by physical aggregation, and an aggregated structure composed of substances each immobilized by interactions between fine particles or between deposited fine crystals. The term "solation" refers to a liquid state in which the interactions formed during the gelation are released. The term "solation temperature" used herein refers to an elevated temperature at which a gel ink is transformed into a sol state having fluidity. The term "gelation temperature" refers to a cooled temperature at which a sol ink is transformed into a gel state having reduced fluidity.

The activating beam curable ink, which exhibits such so-gel phase transition, is transformed into a liquid state at an elevated temperature, and thus can be ejected from an inkjet recording head. Upon recording using the activating beam curable ink at an elevated temperature, ink drops on a recording medium are spontaneously cooled and rapidly solidified by a temperature difference between the ink drops and the recording medium. This can prevents poor quality of an image due to integration of adjacent dots. Unfortunately, ink drops that are readily solidified may be isolated from each other to form a rough image. The roughness may lead to inhomogeneous gloss such as extremely low gloss and unnatural glitter. Vigorous investigation by the inventors found that the control of solidifying properties of ink drops, a gelation temperature of ink, and the temperature of a recording medium within the following range can prevent poor image quality due to integration of the ink drops, and can also achieve highly natural gloss on the image. Specifically, printing with the ink which contains a gelling agent in an amount ranging of 0.1 percent by mass or more but less than 10 percent by mass and has a viscosity of $10^2$ mPa·s or higher but lower than $10^5$ mPa·s at 25° C., under the control of the difference between the gelation temperature ($T_{gel}$) of ink with the gelling agent and the surface temperature ($T_s$) of the recording medium within the range of 5 to 15° C. can prevent integration of the ink drops and thus simultaneously achieve high image quality and natural gloss on an image. In this case, the temperature of the recording medium is controlled within the range of 42 to 48° C.

The inventors guess that such a phenomenon involves the following processes. When an ink drop ejected onto a recording medium is solidified before an adjacent ink drop is ejected, low gloss and unnatural glitter on an image are caused; whereas, when adjacent ink drops are solidified a certain time after the ink drops are ejected and integrated with each other, extremely poor image quality is caused due to overlap of the ink drops. Vigorous investigation by the inventors found that the control of viscosity of the ejected ink drops can prevent integration of ink drops and facilitate proper leveling of adjacent ink drops, which leads to natural gloss on an image.

Printing with the ink containing a gelling agent in an amount of 0.1 percent by mass or more but less than 10 percent by mass and exhibiting a viscosity of $10^2$ mPa·s or higher but lower than $10^5$ mPa·s at 25° C. allows the viscosity of the ink to be controlled within the temperature range of substrate. This control can simultaneously achieve high image quality and natural gloss on an image. Such a finding is based on the following assumption: an ink having viscosity lower than $10^2$ mPa·s at 25° C. cannot sufficiently prevent the integration of ink drops, and thus causes poor image quality within the above-described temperature range. An ink having viscosity of $10^5$ mPa·s or higher at 25° C. may exhibit high viscosity after gelation and cause a noticeable increase in viscosity during a cooling process. The viscosity of such an ink is barely controlled to an extent to be properly leveled within the above-described temperature range, which may reduce the gloss of an image. Contrarily, the ink of the present invention, which is transformed into a viscous gel having proper viscosity after gelation, can effectively inhibit the solidification of the dots, and thus achieve image quality exhibiting relatively natural gloss.

The term "homogeneous gloss" used herein does not define an absolute gloss, e.g., a specular reflection gloss at 60 degree. It, however, refers to entirely homogeneous gloss of an image (in particular, a solid image) without partially inhomogeneous gloss of the image, e.g., unnatural glitter, undesirable decreases in gloss, and stripe inconsistencies in gloss on the image, due to microscopic differences in gloss.

Use of the activating beam curable ink of the present invention under the control of the difference between the gelation temperature ($T_{gel}$) of the ink and the surface temperature ($T_s$) of the recording medium within the range of 5 to 15° C. can prevent poor image quality, and achieve high image quality exhibiting high sharpness of fine lines in characters and natural gloss. To achieve higher image quality, the temperature of the recording medium is preferably controlled within the range of 5 to 10° C.

The composition of the activating beam curable ink used in the present invention will now be described in sequence.

[Gelling Agent]

The term "gelation" used herein refers to a solidified, semi-solidified, or thickened state accompanied by sharp increases in viscosity and elasticity; for example, a lamella structure, a polymer network formed by non-covalent bonds or hydrogen bonds, a polymer network formed by physical aggregation, and an aggregate structure composed of substances each immobilized by interactions between fine particles or between deposited fine crystals.

Typical examples of gels include a thermoreversible gel and a non-thermoreversible gel. The thermoreversible gel is transformed into a fluid solution (also referred to as "sol") when heated, while it is reversibly transformed into gel when cooled. The non-thermoreversible gel is not reversibly transformed into a fluid solution when heated once it gelates. The gel according to the present invention, which contains an oil gelling agent, is preferably a thermoreversible gel to prevent clogging of the recording heads.

The gelation temperature (phase transition temperature) of the activating beam curable ink according to the present invention is preferably 40° C. or higher but lower than 100° C., and more preferably, ranges from 45 to 70° C. Taking into account summer environmental conditions, an ink exhibiting a phase transition at a temperature of 40° C. or higher can be stably ejected from a recording head regardless of the environment temperature during printing. An ink exhibiting a phase transition at a temperature lower than 90° C. eliminates the need for heating of an inkjet recording device to an extremely high temperature, which can reduce load on the recording heads of and the components of the ink supply system of an inkjet recording device.

The term "gelation temperature" used herein, which refers to a temperature at which a liquid is transformed into a gel form accompanied by a rapid change in viscosity, is a synonym of a "gel transition temperature", "gel dissolution temperature", "phase transition temperature", "sol-gel phase transition temperature", and "gelation point".

In the present invention, a gelation temperature of ink is calculated from a viscosity curve and a viscoelasticity curve observed with, for example, a rheometer (e.g., a stress controlled rheometer having a cone-plate, PhysicaMCR, Anton Paar Ltd.). The viscosity curve is observed during a temperature change in a sol ink at an elevated temperature under a low shear rate, whereas the viscoelasticity curve is observed during a measurement of a temperature change dependent on dynamic viscoelasticity. One example technique to obtain a gelation temperature involves placing a small piece of iron sealed in a glass tube into a dilatometer. With the temperature varied, a temperature at which the piece of iron in the ink liquid stops free-falling is determined to be a phase transition point (J. Polym. Sci., 21, 57 (1956)). Another example technique involves placing an aluminum cylinder on an ink to be subjected to a temperature change for gelation. A temperature at which the aluminum cylinder begins free-falling is determined to be a gelation temperature (Nihon Reoroji Gakkaishi (Journal of the Society of Rheology, Japan), Vol. 17, 86 (1989)). An example simple technique involves placing a specimen in a gel form on a heat plate to be heated. A temperature at which the shape of the specimen collapses is determined to be a gelation temperature. Such a gelation temperature (phase transition temperature) of an ink can be controlled depending on the type of the gelling agent, the amount of the added gelling agent, and the type of the activating beam curable monomer.

The ink according to the present invention preferably has a viscosity of $10^2$ mPa·s or higher but lower than $10^5$ mPa·s at 25° C., and more preferably, of $10^3$ mPa·s or higher but lower than $10^4$ mPa·s. Ink having a viscosity of $10^2$ mPa·s or higher can prevent poor image quality due to the integration of dots, while ink having a viscosity of lower than $10^5$ mPa·s can be properly leveled after being ejected onto a recording medium under a controlled surface temperature of the recording medium, and thus can provide homogeneous gloss. The viscosity of the ink can be effectively controlled depending on the type of the gelling agent, the amount of the added gelling agent, and the type of the activating beam curable monomer. In the present invention, the viscosity of the ink is observed with a stress controlled rheometer including a cone-plate (PhysicaMCR, Anton Paar, Ltd.), at a shear rate of 11.7 $s^{-1}$.

The gelling agent contained in the ink according to the present invention may be composed of a high-molecular compound or low-molecular compound; however, the gelling agent is preferably composed of a low-molecular compound because it can readily ejected from inkjet recording heads.

Non-limiting specific examples of the gelling agents which can be formulated in the ink according to the present invention are listed below.

Specific examples of high-molecular compounds preferably used in the present invention include fatty acids with inulin, such as inulin stearate; dextrins of fatty acids, such as dextrin palmitate and dextrin myristate (Rheopearl, available from Chiba Flour Milling Co., Ltd.); glyceryl behenate/eicosadioate; and polyglyceryl behenate/eicosadioate (Nom Coat, available from The Nisshin Oillio Group, Ltd.).

Examples of low-molecular compounds preferably used in the present invention include oil gelling agents having low molecular weight; amid compounds, such as N-lauroyl-L-glutamic acid dibutylamide and N-2-ethylhexanoyl-L-glutamic acid dibutylamide (available from Ajinomoto Fine-Techno Co., Inc.); dibenzylidene sorbitol compounds, such as 1,3:2,4-bis-O-benzylidene-D-glucitol (Gell All D available from New Japan Chemical Co., Ltd.); petroleum-derived waxes, such as paraffin wax, micro crystalline wax, and petrolatum; plant-derived waxes, such as candelilla wax, carnauba wax, rice wax, Japan wax, jojoba oil, jojoba solid wax, and jojoba ester; animal-derived waxes, such as beewax, lanolin, and spermaceti; mineral waxes, such as montan wax and hydrogenated wax; denatured waxes such as hardened castor oil and hardened castor oil derivatives, montan wax derivatives, paraffin wax derivatives, micro crystalline wax derivatives, and polyethylene wax derivatives; higher fatty acids, such as behenic acid, arachidic acid, stearic acid, palmitic acid, myristic acid, lauric acid, oleic acid, and erucic acid; higher alcohols such as a stearyl alcohol and behenyl alcohol; hydroxystearic acids, such as 12-hydroxystearic acid; derivatives of 12-hydroxystearic acid; fatty acid amides, such as a lauric acid amide, stearic acid amide, behenic acid amide, oleic acid amide, erucic acid amide, ricinoleic acid amide, and 12-hydroxystearic acid amide (for example, Nikka Amide from Nippon Kasei Chemical Co., Ltd, ITOWAX available from Itoh Oil Chemicals Co., Ltd, and FATTYAMID available from Kao Corporation); N-substituted fatty acid amides, such as N-stearyl stearic acid amide, N-oleyl palmitic acid amide; special fatty acid amides, such as N,N'-ethylenebisstearylamide N,N'-ethylenebis (12-hydroxystearic amide), and N,N'-xylylene bisstearylamide; higher amines, such as dodecylamine, tetradecylamine, and octadecylamine; fatty acid esters, such as stearyl stearate, oleyl palmitate, glycerin fatty acid ester, sorbitan fatty acid ester, propylene glycol fatty acid ester, ethylene glycol fatty acid ester, and polyoxyethylene glycol fatty acid ester (e.g., EMALLEX available from Nihon Emulsion Co., Ltd., Rikemal available from Riken Vitamin Co., Ltd., and Poem available from Riken Vitamin Co., Ltd.); sucrose fatty acid esters, such as sucrose stearate and sucrose palmitate (for example, Ryoto Sugar Ester available from Mitsubishi-Kagaku Foods Corporation); synthetic waxes, such as polyethylene wax and α-olefin maleic anhydride copolymer wax; polymerizable waxes (UNILIN from Baker-Petrolite Corporation); dimer acids and dimer diols (PRIPOR available from Croda International Plc); which are described in Japanese Unexamined Patent Application Publication Nos. 2005-126507, 2005-255821, and 2010-111790. These gelling agents may be used alone or in combination as appropriate.

The ink of the present invention, which contains the gelling agent, is transformed into a gel form immediately after being ejected from an inkjet recording head onto a recording medium. This prevents the mixing and integration of dots and thus can provide high quality image during high-speed printing. The ink dots are then cured by activating beams to be fixed on the recording medium, forming a firm image film. The amount of the gelling agent included in the ink is preferably 1 percent by mass or more but less than 10 percent by mass, and more preferably, 2 percent by mass or more but less than 7 percent by mass. The ink containing the gelling agent in an amount of 1 percent by mass or more can be subjected to sufficient gelation and thus can prevent poor image quality due to the integration of the dots. Moreover, the ink drops having increased viscosity after gelation are photoradically cured without a decrease in photocurable properties due to oxygen inhabitation. The ink containing the gelling agent of less than 10 percent by mass can prevent poor quality of a cured film due to non-cured component after irradiation with activating beams and can prevent poor inkjet characteristics.

[Activating Beam-curable Compositions]

The ink of the present invention is characterized in that it contains a gelling agent, coloring material, and an activating beam curable composition cured by activating beams.

The activating beam curable composition (hereinafter also referred to as "photopolymerizable compound") used in the present invention will now be described.

Examples of the activating beams used in the present invention include electron beams, ultraviolet rays, α beams, γ beams, and x-rays; however, ultraviolet rays and electron beams are preferred that are less damaging the human body, easy to handle, and industrially widespread. In the present invention, ultraviolet rays are particularly preferred.

In the present invention, any photopolymerizable compound that can be cross-linked or polymerized by irradiation with activating beams may be used without limitation; and, photo-cationically or photo-radically polymerizable compounds are preferred.

[Cationically Polymerizable Compound]

Any known cationically polymerizable monomers may be used; examples of the cationically polymerized monomers include epoxy compounds, vinyl ether compounds, and oxetane compounds described in Japanese Unexamined Patent Application Publication Nos. 6-9714, 2001-31892, 2001-40068, 2001-55507, 2001-310938, 2001-310937, and 2001-220526.

In the present invention, the photopolymerizable compound preferably contains at least one oxetane compound and at least one compound selected from an epoxy compound and a vinyl ether compound in order to prevent contraction of the recording medium during curing of the ink.

Preferred examples of aromatic epoxides include di- or poly-glycidyl ethers prepared by the reaction of polyhydric phenol having at least one aromatic nucleus or an alkylene oxide adduct thereof with epichlorohydrin, such as diglycidyl or polyglycidyl ethers of bisphenol A or an alkylene oxide adduct thereof, diglycidyl or polyglycidyl ethers of hydrogenated bisphenol A or an alkylene oxide adduct thereof, and novolac epoxy resin. Examples of the alkylene oxides include ethylene oxide and propylene oxide.

Preferred examples of alicyclic epoxides include a cyclohexene oxide-containing compound and a cyclopentane oxide-containing compound that are prepared by epoxidizing a compound having at least one cycloalkane ring such as a cyclohexene ring and a cyclopentene ring with a proper oxidant, such as hydrogen peroxide and a peracid.

Preferred examples of aliphatic epoxides include diglycidyl or polyglycidyl ethers of aliphatic polyhydric alcohols or alkylene oxide adducts thereof. Representative examples of the diglycidyl or polyglycidyl ethers include diglycidyl ethers of alkylene glycols, such as diglycidyl ether of ethylene glycol, diglycidyl ether of propylene glycol, and diglycidyl ether of 1,6-hexanediol; polyglycidyl ethers of polyhydric alcohols, such as diglycidyl ether or triglycidyl ether of glycerine or alkylene oxide adducts thereof; and diglycidyl ethers of polyalkylene glycols, such as diglycidyl ethers of polyethylene glycol or alkylene oxide adducts thereof, and diglycidyl ethers of polypropylene glycol or alkylene oxide adducts thereof. Examples of the alkylene oxides include ethylene oxide and propylene oxide.

Preferred epoxides among these epoxides are aromatic epoxides and alicyclic epoxides, and more preferred are alicyclic epoxides because of their rapid curability. In the present invention, the above-described epoxides may be used alone or in combination as appropriate.

Examples of vinyl ether compounds include di- or tri-vinyl ether compounds, such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexane dimethanol divinyl ether, and trimethylolpropane trivinyl ether; and monovinyl ether compounds, such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexane dimethanol monovinyl ether, n-propyl vinyl ether, isopropyl vinyl ether, isopropenyl ether o-propylenecarbonate, dodecyl vinyl ether; diethylene glycol monovinyl ether, and octadecyl vinyl ether.

Preferred vinyl ether compounds among these vinyl ether compounds are di- or tri-vinyl ether compounds, and more preferred are di-vinyl ether compounds because of their curing properties, adhesion, and surface hardness. In the present invention, the above-described vinyl ether compounds may be used alone or in combination as appropriate.

The term "oxetane compound" used herein refers to a compound having one or more oxetane rings. Any known oxetane compound may be used, for example, described in Japanese Unexamined Patent Application Publication Nos. 2001-220526 and 2001-310937.

The use of an oxetane compound having five or more oxetane rings in the present invention may lead to an increase in viscosity of the ink composition. Such an ink composition is hard to handle, has a high glass transition temperature, and thus exhibits low adhesion after curing. The oxetane compound used in the present invention thus is preferably a compound having one to four oxetane rings.

Example of the oxetane compounds preferably used in the present invention include compounds represented by Formulae (1), (2), (7), (8), and (9) respectively described in paragraphs [0089], [0092], [0107], [0109], and [0166] of Japanese Unexamined Patent Application Publication No. 2005-255821.

Specific examples of the oxetane compounds include example compounds 1 to 6 described in paragraphs [0104] to

[0119], and compounds described in paragraph [0121] of Japanese Unexamined Patent Application Publication No. 2005-255821.

[Radically Polymerizable Compound]

A radically polymerizable compound will now be described.

Any known radically polymerizable monomers may be used as photo-radically polymerizable monomers. Example of the known radically polymerizable monomers include photo-curable material prepared using photo-polymerizable compounds, and cationically polymerizable photo-curable resin, which are described in Japanese Unexamined Patent Application Publication No. 7-159983, Japanese Examined Patent Application Publication No. 7-31399, and Japanese Unexamined Patent Application Publication Nos. 8-224982 and 10-863. In addition to these monomers, photo-cationically polymerizable photo-curable resin that is sensitized to light having wavelengths longer than those of visible light, may also be used as a photo-radically polymerizable monomer, the resin being described in Japanese Unexamined Patent Application Publication Nos. 6-43633 and No. 8-324137, for example.

Radically polymerizable compounds have radically polymerizable ethylenically unsaturated bonds. Any radically polymerizable compound that has at least one radically polymerizable ethylenically unsaturated bond in a molecule may be used that has a chemical form such as a monomer, oligomer, or polymer. Such radically polymerizable compounds may be used alone or in combination in any proportion to improve target properties.

Examples of the compounds having the radically polymerizable ethylenically unsaturated bond(s) include unsaturated carboxylic acids, such as acrylic acid, methacrylic acid, itaconic acid, crotonic acid, isocrotonic acid, and maleic acid, and salts thereof; esters, urethanes, amides, anhydrides of these unsaturated carboxylic acids; acrylonitrile; styrene; and radically polymerizable compounds such as various unsaturated polyesters, unsaturated polyethers, unsaturated polyamides, and unsaturated urethanes.

In the present invention, any known (meth)acrylate monomers and/or oligomers may be used as radically polymerizable compounds. The term "and/or" used herein means that the radically polymerizable compound may be a monomer, oligomer, or combination thereof. The same is applied to the term "and/or" in the following description.

Example compounds having (meth)acrylate groups include monofunctional monomers, such as isoamyl acrylate, stearyl acrylate, lauryl acrylate, octyl acrylate, decyl acrylate, isomyristyl acrylate, isostearyl acrylate, 2-ethylhexyl diglycol acrylate, 2-hydroxybutyl acrylate, 2-acryloyloxyethyl hexahydrophthalate, butoxyethyl acrylate, ethoxydiethylene glycolacrylate, methoxydiethylene glycolacrylate, methoxypolyethylene glycolacrylate, methoxypropylene glycolacrylate, phenoxyethyl acrylate, tetrahydrofurfuryl acrylate, isobornyl acrylate, 2-hydroxyethyl acrylate, 2-hydroxypropyl acrylate, 2-hydroxy 3-phenoxypropyl acrylate, 2-acryloyloxy ethylsuccinic acid, 2-acryloyloxyethylphthalic acid, 2-acryloyloxyethyl 2-hydroxyethylphthalate, lactone modified flexible acrylate, and t-butylcyclohexyl acrylate; bifunctional monomers, such as triethylene glycol diacrylate, tetraethylene glycol diacrylate, polyethylene glycol diacrylate, tripropylene glycol diacrylate, polypropylene glycol diacrylate, 1,4-butanediol diacrylate, 1,6-hexanediol diacrylate, 1,9-nonanediol diacrylate, neopentyl glycol diacrylate, dimethylol tricyclodecane diacrylate, bisphenol-A PO-adduct diacrylate, hydroxypivalate neopentyl glycol diacrylate, and polytetramethylene glycol diacrylate; and multifunctional (tri- or higher functional) monomers, such as trimethylolpropane triacrylate, pentaerythritol triacrylate, pentaerythritol tetraacrylate, dipentaerythritol hexaacrylate, ditrimethylolpropane tetraacrylate, glycerine propoxy triacrylate, caprolactone-modified trimethylolpropane triacrylate, pentaerythritol ethoxy tetraacrylate, and caprolactam-modified dipentaerythritol hexaacrylate. In addition to these monomers, polymerizable oligomers may be used. Examples of the polymerizable oligomers include epoxy acrylates, aliphatic urethane acrylates, aromatic urethane acrylates, polyester acrylates, linear acylic oligomers. More specifically, commercially available or industrially known monomers, oligomers, and polymers that can be radically polymerized and crosslinked may be used, which are described in "Kakyozai Handobukku (Cross-linker Handbook)", Shinzo Yamashita (Taiseisha, 1981); "UV•EB Kouka Handobukku (Genryo Hen) (UV•EB Curing Handbook (Material))", Kiyomi Kato, (Koubunshi Kankoukai, 185); "UV•EB Koukagijyutsu no Ouyo to Shijyo (Application and Market of UVEB Curing Technology)", pp. 79, RadTech Japan (CMC Publishing Co., Ltd., 1989); "Poriesuteru Jyushi Handbook (Polyester Resin Handbook)", Eiichiro Takiyama, (Nikkan Kogyo Shimbun Ltd., 1988).

Specific examples of the preferred monomers include isoamyl acrylate, stearyl acrylate, lauryl acrylate, octyl acrylate, decyl acrylate, isomyristyl acrylate, isostearyl acrylate, ethoxydiethylene glycol acrylate, methoxypolyethylene glycol acrylate, methoxypropylene glycol acrylate, isobornyl acrylate, lactone-modified flexible acrylate, tetraethylene glycol diacrylate, polyethylene glycol diacrylate, polypropylene glycol diacrylate, dipentaerythritol hexaacrylate, di(trimethylolpropane) tetraacrylate, glycerine propoxy triacrylate, caprolactone-modified trimethylolpropane triacrylate, pentaerythritol ethoxy tetraacrylate, and caprolactam-modified dipentaerythritol hexaacrylate in the light of their sensitivity, skin irritancy, eye irritancy, mutagenicity, and toxicity.

Specifically, more preferred monomers among these monomers are stearyl acrylate, lauryl acrylate, isostearyl acrylate, ethoxydiethylene glycol acrylate, isobornyl acrylate, tetraethylene glycol diacrylate, glyceryl propoxy triacrylate, caprolactone-modified trimethylolpropane triacrylate, and caprolactam-modified dipentaerythritol hexaacrylate.

The polymer of the present invention may be combinations of vinyl ether monomer and/or oligomer and (meth)acrylate monomer and/or oligomer. Examples of the vinyl ether monomers include di- or tri-vinyl ether compounds, such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexane dimethanol divinyl ether, and trimethylolpropane trivinyl ether; and monovinyl ether compounds, such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexane dimethanol monovinyl ether, n-propyl vinyl ether, isopropyl vinyl ether, isopropenyl ether o-propylene carbonate, dodecyl vinyl ether, diethylene glycol monovinyl ether, and octadecyl vinyl ether. The vinyl ether oligomer is preferably a bifunctional vinyl ether compound having a molar weight of 300-1000 and two to three ester groups in a molecule. Non-limiting examples of such bifunctional vinyl ether compounds include VEctomer available from Sigma-Aldrich Co. LLC., such as VEctomer 4010, VEctomer 4020, VEctomer 4040, VEctomer 4060, and VEctomer 5015.

The polymer of the present invention may be combinations of various vinyl ether compounds and maleimide compounds.

Non-limiting examples of the maleimide compounds include N-methylmaleimide, N-propylmaleimide, N-hexylmaleimide, N-laurylmaleimide, N-cyclohexylmaleimide, N-phenylmaleimide, N,N'-methylenebismaleimide, polypropylene glycol bis(3-maleimidepropyl)ether, tetraethylene glycol bis (3-maleimidepropyl)ether, bis(2-maleimide ethyl) carbonate, N,N'-(4,4'-diphenylmethane) bismaleimide, N,N'-2,4-tolylene bismaleimide, and multifunctional maleimide compounds which are ester compounds containing carboxylic acids and various polyols, the multifunctional maleimides compound being described in Japanese Unexamined Patent Application Publication No. 11-124403.

The amount of added cationic polymer or radically polymerizable compound described above is preferably within a range of 1 to 97 percent by mass, and more preferably, of 30 to 95 percent by mass.

[Components of Ink]

Components, other than the components described above, of the ink of the present invention will now be described.

[Color Material]

The ink of the invention may contain any dye or pigment as a color material. The preferred materials are pigments with stable dispersion in the ink components and weatherability. Examples of pigments according to the invention include, but not limited to, organic and inorganic pigments represented by the following color index numbers, which can be used in accordance with the purpose.

Red or magenta pigments: Pigment Reds 3, 5, 19, 22, 31, 38, 43, 48:1, 48:2, 48:3, 48:4, 48:5, 49:1, 53:1, 57:1, 57:2, 58:4, 63:1, 81, 81:1, 81:2, 81:3, 81:4, 88, 104, 108, 112, 122, 123, 144, 146, 149, 166, 168, 169, 170, 177, 178, 179, 184, 185, 208, 216, 226, and 257; Pigment Violets 3, 19, 23, 29, 30, 37, 50, and 88; and Pigment Oranges 13, 16, 20, and 36.

Blue or cyan pigments: Pigment Blues 1, 15, 15:1, 15:2, 15:3, 15:4, 15:6, 16, 17-1, 22, 27, 28, 29, 36, and 60.

Green pigments: Pigment Greens 7, 26, 36, and 50.

Yellow pigments: Pigment Yellows 1, 3, 12, 13, 14, 17, 34, 35, 37, 55, 74, 81, 83, 93, 94, 95, 97, 108, 109, 110, 137, 138, 139, 153, 154, 155, 157, 166, 167, 168, 180, 185, and 193.

Black pigments: Pigment Blacks 7, 28, and 26.

Specific examples of the pigments include CHROMOFINE YELLOWs 2080, 5900, 5930, AF-1300, and AF-2700L; CHROMOFINE ORANGEs 3700L and 6730; CHROMOFINE SCARLET 6750; CHROMOFINE MAGENTAs 6880, 6886, 6891N, 6790, and 6887; CHROMOFINE VIOLET RE; CHROMOFINE REDs 6820 and 6830; CHROMOFINE BLUEs HS-3, 5187, 5108, 5197, 5085N, SR-5020, 5026, 5050, 4920, 4927, 4937, 4824, 4933GN-EP, 4940, 4973, 5205, 5208, 5214, 5221, and 5000P; CHROMOFINE GREENs 2GN, 2GO, 2G-550D, 5310, 5370, and 6830; CHROMOFINE BLACK A-1103; SEIKAFAST YELLOWs 10GH, A-3, 2035, 2054, 2200, 2270, 2300, 2400(B), 2500, 2600, ZAY-260, 2700(B), and 2770; SEIKAFAST REDs 8040, C405(F), CA120, LR-116, 1531B, 8060R, 1547, ZAW-262, 1537B, GY, 4R-4016, 3820, 3891, and ZA-215; SEIKAFAST CARMINEs 6B1476T-7, 1483LT, 3840, and 3870; SEIKAFAST BORDEAUX 10B-430; SEIKALIGHT ROSE R40; SEIKALIGHT VIOLETs B800 and 7805; SEIKAFAST MAROON 460N; SEIKAFAST ORANGES 900 and 2900; SEIKALIGHT BLUES C718 and A612; CYANINE BLUEs 4933M, 4933GN-EP, 4940, and 4973 (Dainichiseika Color & Chemicals Mfg. Co., Ltd.); KET Yellows 401, 402, 403, 404, 405, 406, 416, and 424; KET Orange 501; KET Reds 301, 302, 303, 304, 305, 306, 307, 308, 309, 310, 336, 337, 338, and 346; KET Blues 101, 102, 103, 104, 105, 106, 111, 118, and 124; KET Green 201 (DIC Corporation), Colortex Yellows 301, 314, 315, 316, P-624, 314, U10GN, U3GN, UNN, UA-414, and U263; Finecol Yellows T-13 and T-05; Pigment Yellow 1705; Colortex Orange 202, Colortex Reds 101, 103, 115, 116, D3B, P-625, 102, H-1024, 105C, UFN, UCN, UBN, U3BN, URN, UGN, UG276, U456, U457, 105C, and USN; Colortex Maroon 601; Colortex Brown B610N; Colortex Violet 600; Pigment Red 122; Colortex Blues 516, 517, 518, 519, A818, P-908, and 510; Colortex Greens 402 and 403; Colortex Blacks 702 and U905 (Sanyo Color Works. LTD.); Lionol Yellow 1405G; Lionol Blues FG7330, FG7350, FG7400G, FG7405G, ES, and ESP-S (Toyo Ink SC Holdings Co., Ltd.); Toner Magenta E02; Permanent Rubin F6B; Toner Yellow HG; Permanent Yellow GG-02; Hostaperm Blue B2G (Hoechst Industry Ltd.); Novoperm P-HG; Hostaperm Pink E; Hostaperm Blue B2G (Clariant International Ltd.); and Carbon Blacks #2600, #2400, #2350, #2200, #1000, #990, #980, #970, #960, #950, #850, MCF88, #750, #650, MA600, MA7, MA8, MA11, MA100, MA100R, MA77, #52, #50, #47, #45, #45L, #40, #33, #32, #30, #25, #20, #10, #5, #44, and CF9 (Mitsubishi Chemical Corporation).

The pigments may be dispersed, for example, with a ball mill, a sand mill, an attritor, a roll mill, an agitator, a Henschel mixer, a colloid mill, an ultrasonic homogenizer, a pearl mill, a wet jet mill, or a paint shaker.

A dispersant may be added for dispersion of the pigments. The preferred dispersant is a polymer dispersant. Examples of polymer dispersants include Solsperse® series by Avecia Inc., PB series by Ajinomoto Fine-Techno Co., Inc., and the following materials.

Pigment dispersants: hydroxyl-containing carboxylic acid esters, salts of long-chain polyaminoamides and high-molecular-weight acid esters, salts of high-molecular-weight polycarboxylic acids, salts of long-chain polyaminoamides and polar acid esters, high-molecular-weight unsaturated acid esters, copolymers, modified polyurethanes, modified polyacrylates, polyether-ester anionic surfactants, salts of naphthalenesulfonic acid-formalin condensates, salts of aromatic sulfonic acid-formalin condensates, polyoxyethylene alkyl phosphate esters, polyoxyethylene nonylphenyl ethers, stearylamine acetates, and pigment derivatives.

Specific examples of polymer dispersants include: ANTI-TERRA-U (polyaminoamide phosphate salt), ANTI-TERRA-203 and ANTI-TERRA-204 (high-molecular-weight polycarboxylates), DISPERBYK-101 (polyaminoamide phosphate and acid ester), DISPERBYK-107 (hydroxyl group-containing carboxylic acid ester), DISPERBYK-110 (copolymer containing acid group), DISPERBYK-130 (polyamide), DISPERBYK-161, -162, -163, -164, -165, -166, and -170 (high molecular weight copolymers), 400, Bykumen (high-molecular-weight unsaturated acid ester), BYK-P104 and BYK-P105 (high-molecular-weight unsaturated polycarboxylic acids), BYK-P104S and -P240S (high molecular weight unsaturated polycarboxylic acids and silicon), and Lactimon (long-chain amine, unsaturated polycarboxylic acid, and silicon) by BYK-Chemie GmbH.

Further examples include: Efkas 44, 46, 47, 48, 49, 54, 63, 64, 65, 66, 71, 701, 764, and 766, Efka Polymers 100 (modified polyacrylate), 150 (aliphaticmodifiedpolymer), 400, 401, 402, 403, 450, 451, 452, 453 (modified polyacrylates), and 745 (copper phthalocyanine) by Efka Chemicals B.V.; FLOWREN TG-710 (urethane oligomer), FLOWNONs SH-290 and SP-1000, POLYFLOW Nos. 50E and 300 (acrylic copolymers) by Kyoeisha Chemical Co., Ltd.; Disparlons KS-860, 873SN, and 874 (polymer dispersants), and Disparlon #2150 (aliphatic polyvalent carboxylic acid) and #7004 (polyether ester) by Kusumoto Chemicals, Ltd.

Still further examples include: DEMOLs RN, N (sodium naphthalene sulfonate-formaldehyde condensates), MS, C, SN-B (sodium aromatic sulfonate-formaldehyde condensates), and EP, HOMOGENOL L-18 (polycarboxylic polymer), EMULGENs 920, 930, 931, 935, 950, and 985 (polyoxyethylene nonylphenyl ethers), ACETAMINs 24 (coconut amine acetate), and 86 (stearyl amine acetate) by Kao Corporation; SOLSPERSEs 5000 (phthalocyanine ammonium salt), 13240, 13940 (polyester amines), 17000 (aliphatic amine), 24000, and 32000 by AstraZeneca plc; and NIKKOL T106 (polyoxyethylene sorbitan monooleate), MYS-IEX (polyoxyethylene monostealate), and Hexagline 4-0 (hexaglyceryl tetraoleate) by Nikko Chemicals Co., Ltd.

The ink preferably contains a pigment dispersant in an amount of 0.1 to 20 percent by mass. Synergists dedicated to the respective pigments may be used as dispersion aids. The dispersant and dispersion aids are preferably added in amounts of 1 to 50 parts by mass for 100 parts by mass of pigments. A dispersion medium may be a solvent or a polymerizable compound. Preferably, the ink of the present invention, which is subjected to reaction and curing after printing, contains no solvent. Residual solvent, which is a volatile organic compound (VOC), in cured-ink images causes a decrease in solvent resistance and environmental issues. The preferred dispersion media are therefore polymerizable compounds, especially a monomer with the lowest viscosity rather than a solvent, in view of dispersion characteristics.

The pigment preferably has an average particle diameter in the range of 0.08 to 0.5 μm and a maximum diameter of 0.3 to 10 μm, more preferably 0.3 to 3 μm in view of dispersion of the pigment. These diameters are appropriately determined depending on the types of the pigment itself, dispersant, and dispersion medium, dispersion conditions, and filtration conditions. Such size control prevents nozzle clogging in the recording head and leads to high storage stability, transparency, and curing sensitivity of the ink.

The ink of the present invention may optionally contain a known dye, preferably an oil-soluble dye. Non-limiting oil-soluble dyes that can be used in the present invention are listed below.

[Magenta Dye]

MS Magenta VP, MS Magenta HM-1450, and MS Magenta HSo-147 (Mitsui Chemicals, Inc.); AIZENSOT Red-1, AIZEN SOT Red-2, AIZEN SOT Red-3, AIZEN SOT Pink-1, and SPIRON Red GEH SPECIAL (Hodogaya Chemical Co., Ltd.); RESOLIN Red FB 200%, MACROLEX Red Violet R, and MACROLEX ROT5B (Bayer); KAYASET Red B, KAYASET Red 130, and KAYASET Red 802 (Nippon Kayaku Co., Ltd.); PHLOXIN, ROSE BENGAL, and ACID Red (Daiwa Kasei Co., Ltd.); HSR-31 and DIARESIN Red K (Mitsubishi Chemical Corporation); and Oil Red (BASF Japan Ltd.).

[Cyan Dye]

MS Cyan HM-1238, MS Cyan HSo-16, Cyan HSo-144, and MS Cyan VPG (Mitsui Chemicals, Inc.); AIZEN SOT Blue-4 (Hodogaya Chemical Co., Ltd.); RESOLIN BR.Blue BGLN 200%, MACROLEX Blue RR, CERES Blue GN, SIRIUS SUPRA TURQ.Blue Z-BGL, and SIRIUS SUPRA TURQ.Blue FB-LL 330% (Bayer); KAYASET Blue FR, KAYASET Blue N, KAYASET Blue 814, Turq.Blue GL-5 200, and Light Blue BGL-5 200 (Nippon Kayaku Co., Ltd.); DAIWA Blue 7000 and Oleosol Fast Blue GL (Daiwa Kasei Co., Ltd.); DIARESIN Blue P (Mitsubishi Chemical Corporation); and SUDAN Blue 670, NEOPEN Blue 808, and ZAPON Blue 806 (BASF Japan Ltd.).

[Yellow Dye]

MS Yellow HSm-41, Yellow KX-7, and Yellow EX-27 (Mitsui Chemicals, Inc.); AIZEN SOT Yellow-1, AIZEN SOT YelloW-3, and AIZEN SOT Yellow-6 (Hodogaya Chemical Co., Ltd.); MACROLEX Yellow 6G and MACROLEX FLUOR.Yellow 10GN (Bayer); KAYASET Yellow SF-G, KAYASET Yellow 2G, KAYASET Yellow A-G, and KAYASET Yellow E-G (Nippon Kayaku Co., Ltd.); DAIWA Yellow 330HB (Daiwa Kasei Co., Ltd.); HSY-68 (Mitsubishi Chemical Corporation); and SUDAN Yellow 146 and NEOPEN Yellow 075 (BASF Japan Ltd.).

[Black Dye]

MS Black VPC (Mitsui Chemicals, Inc.); AIZEN SOT Black-1 and AIZEN SOT Black-5 (Hodogaya Chemical Co., Ltd.); RESORIN Black GSN 200% and RESOLIN BlackBS (Bayer); KAYASET Black A-N (Nippon Kayaku Co., Ltd.); DAIWA Black MSC (Daiwa Kasei Co., Ltd.); HSB-202 (Mitsubishi Chemical Corporation); and NEPTUNE Black X60 and NEOPEN Black X58 (BASF Japan Ltd.).

The pigments or oil-soluble dyes are preferably added in amounts of 0.1 to 20 percent by mass, more preferably 0.4 to 10 percent by mass. Addition of 0.1 percent by mass or more yields desirable image quality, and addition of 20 percent by mass or less provides appropriate ink viscosity during ejection of ink. Two or more colorants may be appropriately used for color adjustment.

[Photopolymerization Initiator]

The ink of the present invention preferably contains at least one photopolymerization initiator when ultraviolet rays, for example, are used as activating beams. For use of electron beams as activating beams, no photopolymerization initiator is necessary in many cases.

Photopolymerization initiators are broadly categorized into two types: an intramolecular bonding cleavage type and an intramolecular hydrogen abstraction type.

Photopolymerization initiators of the intramolecular bonding cleavage type include acetophenones, such as diethoxyacetophenone, 2-hydroxy-2-methyl-1-phenylpropan-1-one, benzyl dimethyl ketal, 1-(4-isopropylphenyl)-2-hydroxy-2-methylpropan-1-one, 4-(2-hydroxyethoxy)phenyl 2-hydroxy-2-propyl ketone, 1-hydroxycyclohexyl phenyl ketone, 2-methyl-2-morpholino(4-thiomethylphenyl)propan-1-one, and 2-benzyl-2-dimethylamino-1-(4-morpholinophenyl)-butanone; benzoins, such as benzoin, benzoin methyl ethers, and benzoin isopropyl ethers; acylphosphine oxides, such as 2,4,6-trimethyl benzoin diphenylphosphine oxide; benzyl; and methyl phenylglyoxylate.

Photopolymerization initiators of the intramolecular hydrogen abstraction type include benzophenones, such as benzophenone, o-benzoylbenzoic acid, methyl-4-phenyl benzophenone, 4,4'-dichlorobenzophenone, hydroxybenzophenone, 4-benzoyl-4'-methyl diphenyl sulfide, acrylated benzophenone, 3,3',4,4'-tetra(t-butylperoxycarbonyl)benzophenone, and 3,3'-dimethyl-4-methoxy benzophenone; thioxanthones, such as 2-isopropylthioxanthone, 2,4-dimethylthioxanthone, 2,4-diethylthioxanthone, and 2,4-dichlorothioxanthone; aminobenzophenones, such as Michler's ketone and 4,4'-diethylamino benzophenone; 10-butyl-2-chloroacridone; 2-ethylanthraquinone; 9,10-phenanthrenequinone; and camphorquinone.

The preferred amount of a photopolymerization initiator, if used, is 0.01 to 10 percent by mass of an activating beam curable composition.

Examples of the radical polymerization initiators include triazine derivatives disclosed in documents, such as Japanese Examined Patent Application Publication Nos. S59-1281 and S61-9621, and Japanese Unexamined Patent Application Publication No. S60-60104; organic peroxides disclosed in documents, such as Japanese Unexamined Patent Application Publication Nos. S59-1504 and S61-243807; diazonium compounds disclosed in documents, such as Japanese Examined Patent Application Publication Nos. S43-23684, S44-6413, S44-6413, and S47-1604 and U.S. Pat. No. 3,567,453; organic azide compounds disclosed in documents, such as U.S. Pat. Nos. 2,848,328, 2,852,379, and 2,940,853; orthoquinonediazides disclosed in documents, such as Japanese Examined Patent Application Publication Nos. S36-22062, S37-13109, S38-18015, and S45-9610; onium compounds disclosed in documents, such as Japanese Examined Patent Application Publication No. S55-39162 and Japanese Unexamined Patent Application Publication No. S59-14023 and *Macromolecules,* 10, P. 1307, 1977; azo compounds disclosed in Japanese Unexamined Patent Application Publication No. S59-142205; metal allene complexes disclosed in documents, such as Japanese Unexamined Patent Application Publication No. H1-54440, EP patent Nos. 109,851 and 126,712 and *J. Imag. Sci.,* 30, P. 174, 1986; (oxo)sulfonium organoboron complexes disclosed in Japanese Patent Nos. 2711491 and 2803454; titanocene dichlorides disclosed in Japanese Unexamined Patent Publication No. S61-151197; transition metal complexes containing transition metals, such as ruthenium disclosed in Coordination Chemistry Review, 84, pp. 85-277, 1988 and Japanese Unexamined Patent Application Publication No. H2-182701; 2,4,5-triarylimidazole dimer; carbon tetrabromide disclosed in Japanese Unexamined Patent Application Publication No. H3-209477; and organic halogen compounds disclosed in Japanese Unexamined Patent Application Publication No. S59-107344. The preferred amount of a polymerization initiator ranges from 0.01 to 10 parts by mass for 100 parts by mass of a compound containing a radically polymerizable ethylenically unsaturated bond.

The ink of the present invention may contain a photoacid generator serving as a photopolymerization initiator.

As photoacid generators, compounds that are used, for example, for a chemically amplified photoresist or photo cationic polymerization are used (The Japanese Research Association for Organic Electronics Materials (ed.), *Organic materials for imaging*, pp. 187-192, BUNSHIN, 1993). Examples of such a compound suitable for the present invention are as follows.

First group: salts of aromatic onium compounds, such as diazonium, ammonium, iodonium, sulfonium, and phosphonium with $B(C_6F_5)_4^-$, $PF_6^-$, $AsF_6^-$, $SbF_6^-$, or $CF_3SO_3^-$.

Specific examples of the onium compound usable in the invention are disclosed in paragraph [0132] of Japanese Unexamined Patent Publication No. 2005-255821.

Second group: sulfonated compounds generating sulfonic acid. Specific examples of such a sulfonated compound are disclosed in paragraph [0136] of Japanese Unexamined Patent Publication No. 2005-255821.

Third group: halides photogenerating hydrogen halide. Specific examples of such a halide are disclosed in paragraph [0138] of Japanese Unexamined Patent Publication No. 2005-255821.

Fourth group: iron-allene complexes disclosed in paragraph [0140] of Japanese Unexamined Patent Publication No. 2005-255821.

[Other Addictive Agents]

The activating beam curable ink according to the present invention may also contain a variety of additives, other than those described above. Examples of such additives include surfactants, leveling agents, matting agents, polyester resins for adjusting membrane properties, polyurethane resins, vinyl resins, acrylic resins, elastomeric resins, and waxes. Any known basic compound can be used for improvement in storage stability. Typical examples include basic alkali metal compounds, basic alkali earth metal compounds, and basic organic compounds, such as amines.

Inks used in this embodiment are listed below.

Pigment dispersion elements for the following ink composition are obtained by heating and stirring a mixture of 5 parts by mass of SOLSPERSE 32000 (Lubrizol Corporation) and 80 parts by mass of HD-N (1,6-hexanediol dimethacrylate: Shin-Nakamura Chemical Co., Ltd.) in a stainless steel beaker to dissolve the mixture, cooling the mixture to room temperature, adding 15 parts by mass of Carbon Black #56 (Mitsubishi Chemical Corporation) to the mixture, putting the mixture and zirconia beads of 0.5 mm in a sealed glass vial, performing dispersion of the mixture with a paint shaker for 10 hours, and removing the zirconia beads therefrom.

TABLE 2

| | NAME | MANUFACTURER | AMOUNT (PART) |
|---|---|---|---|
| POLYMERIZABLE COMPOUND | A-600 | SHIN-NAKAMURA CHEMICAL CO., LTD. | 50 |
| POLYMERIZABLE COMPOUND | A-GLY-9E | SHIN-NAKAMURA CHEMICAL CO., LTD. | 5 |
| POLYMERIZABLE COMPOUND | HD-N | SHIN-NAKAMURA CHEMICAL CO., LTD. | 4.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZAT1ON INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 3

| | NAME | MANUFACTURER | AMOUNT (PART) |
|---|---|---|---|
| POLYMERIZABLE COMPOUND | 9G | SHIN-NAKAMURA CHEMICAL CO., LTD. | 35 |
| POLYMERIZABLE COMPOUND | U-200PA | SHIN-NAKAMURA CHEMICAL CO., LTD. | 5 |
| POLYMERIZABLE COMPOUND | 3G | SHIN-NAKAMURA CHEMICAL CO., LTD. | 19.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | DAROCUR TPO | BASF | 3 |
| SENSITIZER | PROCURE TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 4

| | NAME | MANUFACTURER | AMOUNT (PART) |
|---|---|---|---|
| POLYMERIZABLE COMPOUND | 14G | SHIN-NAKAMURA CHEMICAL CO., LTD. | 45 |
| POLYMERIZABLE COMPOUND | A-HD-N | SHIN-NAKAMURA CHEMICAL CO., LTD. | 14.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 5

| | NAME | MANUFACTURER | AMOUNT (PART) |
|---|---|---|---|
| POLYMERIZABLE COMPOUND | UA-4200 | SHIN-NAKAMURA CHEMICAL CO., LTD. | 35 |
| POLYMERIZABLE COMPOUND | A-HD-N | SHIN-NAKAMURA CHEMICAL CO., LTD. | 24.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 6

| | NAME | MANUFACTURER | AMOUNT (PART) |
|---|---|---|---|
| POLYMERIZABLE COMPOUND | AD-TMP | SHIN-NAKAMURA CHEMICAL CO., LTD. | 30 |
| POLYMERIZABLE COMPOUND | A-GLY-9E | SHIN-NAKAMURA CHEMICAL CO., LTD. | 20 |
| POLYMERIZABLE COMPOUND | HD-N | SHIN-NAKAMURA CHEMICAL CO., LTD. | 9.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

TABLE 7

| | NAME | MANUFACTURER | AMOUNT (PART) |
|---|---|---|---|
| POLYMERIZABLE COMPOUND | U-200PA | SHIN-NAKAMURA CHEMICAL CO., LTD. | 13 |
| POLYMERIZABLE COMPOUND | A-GLY-9E | SHIN-NAKAMURA CHEMICAL CO., LTD. | 5 |
| POLYMERIZABLE COMPOUND | HD-N | SHIN-NAKAMURA CHEMICAL CO., LTD. | 41.85 |
| PIGMENT DISPERSION ELEMENT | | | 20 |
| GELLING AGENT | KAO WAX T-1 | KAO CORPORATION | 5 |
| PHOTOPOLYMERIZATION INITIATOR | IRGACURE 379 | BASF | 3 |
| PHOTOPOLYMERIZATION INITIATOR | DAROCUR TPO | BASF | 5 |
| SENSITIZER | KAYACURE DETX-S | NIPPON KAYAKU CO., LTD. | 2 |
| POLYMERIZATION INHIBITOR | UV-10 | BASF | 0.1 |
| SURFACTANT | KF351 | SHIN-ETSU CHEMICAL CO., LTD. | 0.05 |

[Image Formation Control of Inkjet Recording Device in First Embodiment]

Figure 9:
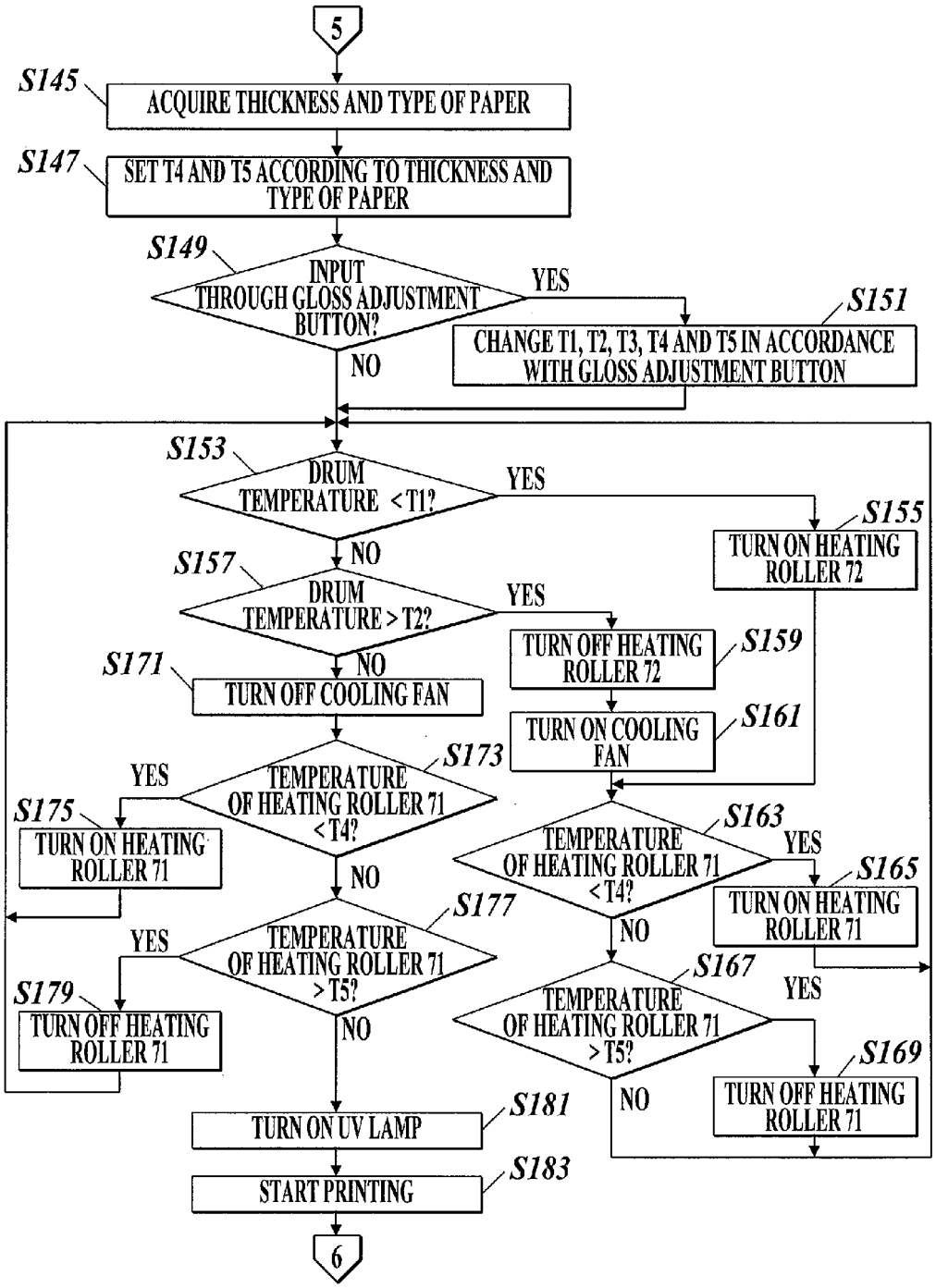
FIG. 9 is the continuation of the flowchart of FIG. 8.
Figure 10:
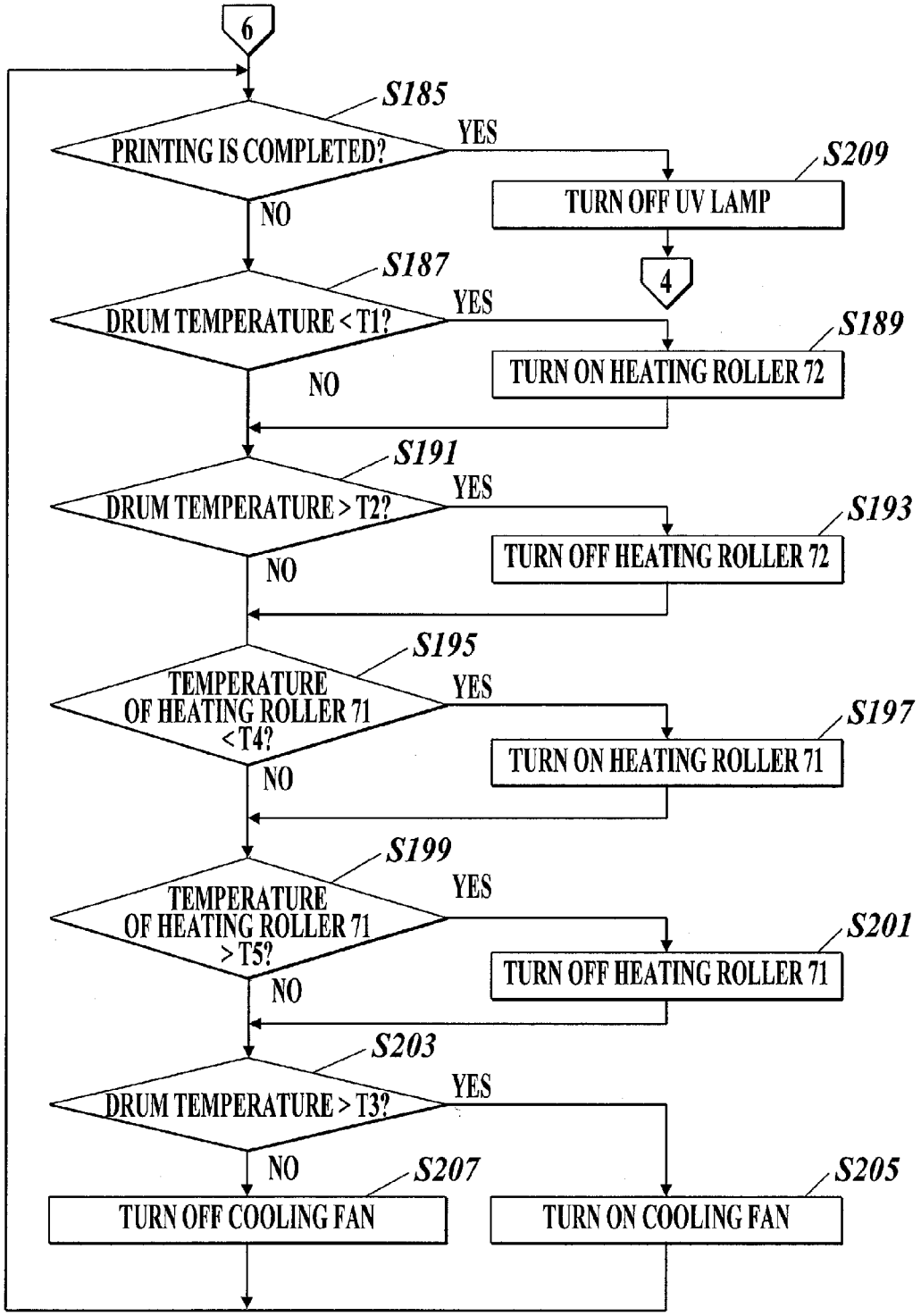
FIG. 10 is the continuation of the flowchart of FIG. 9.

Next, the operation control at the time of image formation of the inkjet recording device 1A having the above-described configuration in accordance with the first embodiment is described with reference to the flowcharts of FIGS. 8 to 10.

In the inkjet recording device 1A, when the main power supply is turned on, the control section 10 reads the set temperatures T1, T2, T3, T4 and T5, which are set initial values, related to the image forming drum 21, from the ROM (Step S101). T1 is the lower limit of the range of image-forming-drum set temperature, which is the target temperature band of the image forming drum 21 at the time of image formation; T2 is the intermediate value of the range of image-forming-drum set temperature; and T3 is the upper limit of the range of set temperature of the image forming drum 21. For example, the set temperatures are set to: T1=42° C., T2=47° C., and T3=48° C.

T4 is the lower limit of the range of heating-unit set temperature, which is the target temperature band of the heating roller 71 at the time of image formation; and T5 is the upper limit of the range of heating-unit set temperature.

The control section 10 starts rotating the image forming drum 21 with the drum rotation motor 61 (Step S103), and subsequently, starts heating the image forming drum 21 with the heating rollers 71 and 72 (Step S105) and starts irradiation with ultraviolet rays by the UV lamp 52 (Step S107). That is, the heating rollers 71 and 72 and the UV lamp 52 perform preheating of the image forming drum 21 to which a recording medium P has not been supplied.

When the preheating is started, the control section 10 monitors the temperature of the image forming drum 21 with the drum temperature sensor 91 (Step S109). When the temperature of the image forming drum 21 is less than T1, the heating-unit temperature sensor 92 monitors the temperature of the heating roller 71 (Step S111).

When the detected temperature of the heating roller 71 is equal to or more than the set temperature T4, the processing moves on to Step S115. When the detected temperature is less than the set temperature T4, the heating roller 71 is turned on or maintained in the on-state (Step S113), and the processing moves on to Step S115.

At Step S115, it is determined whether the detected temperature of the heating roller 71 is more than the set temperature T5. When the detected temperature is more than the set temperature T5, the heating roller 71 is turned off, and the processing is returned to Step S109.

When detected temperature of the heating roller 71 is equal to or less than the set temperature T5, the processing is directly returned to Step S109.

On the other hand, when it is determined that the temperature of the image forming drum 21 is equal to or more than T1 at step S109, the irradiation with the UV lamp 52 is stopped (Step S119).

After that, the control section 10 continues to monitor the detected temperature of the image forming drum 21 (Step S121). When the image forming drum 21 is equal to or more than the set temperature T1, the processing moves on to Step S125; and when the image forming drum 21 is less than the set temperature T1, the heating roller 72 is turned on (Step S123), and the processing moves on to Step S125.

At Step S125, monitoring of the detected temperature of the image forming drum 21 is continued. When the image forming drum 21 is equal to or less than the set temperature T2, the processing moves on to Step S129; and when the image forming drum 21 is more than the set temperature T2, the heating roller 72 is turned off (Step S127), and the processing moves on to Step S129.

Next, the control section 10 monitors the detected temperature of the heating roller 71 (Step S129). When the heating roller 71 is equal to or more than the set temperature T4, the processing moves on to Step S133; and when the heating roller 71 is less than the set temperature T4, the heating roller 71 is turned on (Step S131), and the processing moves on to Step S133.

At Step S133, the monitoring of the detected temperature of the heating roller 71 is continued. When the heating roller 71 is equal to or less than the set temperature T5, the processing moves on to Step S137; and when the heating roller 71 is more than the set temperature T5, the heating roller 71 is turned off (Step S135), and the processing moves on to Step S137.

At Step S137, the detected temperature of the image forming drum 21 is monitored again. When the detected temperature is more than the set temperature T3, the cooling fan 53 is operated to cool the image forming drum 21 (Step S139), and the processing is returned to Step S121. When the image forming drum 21 is equal to or less than the set temperature T3, the cooling fan 53 is stopped (Step S141), and monitoring is performed to check whether an instruction for printing is inputted from the host computer (Step S143). When an instruction for printing is not inputted, the temperature regulation at Steps S121-S143 described above is repeated.

On the other hand, when an instruction for printing is inputted, the control section 10 reads the thickness and the type of recording medium P inputted by the recording medium thickness input unit 81 and the recording medium type input unit 82 (Step S145), and specifies the set temperatures T4 and T5 with reference to table data (Step S147).

Further, it is determined whether a setting has been made for executing gloss adjustment on ink dots through the gloss adjustment button 68 (Step S149). When a setting has been made for executing gloss adjustment, the set temperatures T1, T2, T3, T4 and T5 are changed into new set values (Step S151).

Next, the control section 10 monitors the detected temperature of the image forming drum 21 (Step S153). When the detected temperature is less than the set temperature T1, the heating roller 72 is maintained in the on-state (Step S155), and the processing moves on to Step S163.

When the detected temperature is equal to or more than the set temperature T1, it is further determined whether the detected temperature of the image forming drum 21 is more than the set temperature T2 (Step S157). When the detected temperature is more than the set temperature T2, the heating roller 72 is turned off (Step S159), and the cooling fan 53 is operated (Step S161).

Then, the detected temperature of the heating roller 71 is monitored (Step S163). When the detected temperature of the heating roller 71 is less than the set temperature T4, the heating roller 71 is turned on (Step S165), and the processing is returned to Step S153.

When the detected temperature of the heating roller 71 is equal to or more than the set temperature T4, it is further determined whether the detected temperature is more than the set temperature T5 (Step S167). When the detected temperature of the heating roller 71 is equal to or less than the set temperature T5, the processing is returned to Step S153; and when the detected temperature is more than the set temperature T5, the heating roller 71 is turned off (Step S169), and then, the processing is returned to Step S153.

On the other hand, when the detected temperature of the image forming drum 21 is equal to or less than the set temperature T2 in the determination at Step S157, the cooling fan 53 is turned off (Step S171), and the detected temperature of the heating roller 71 is monitored (Step S173).

When the detected temperature of the heating roller 71 is less than the set temperature T4, the heating roller 71 is turned on (Step S175), and the processing is returned to Step S153.

When the detected temperature of the heating roller 71 is equal to or more than the set temperature T4, it is further determined whether the detected temperature is more than the set temperature T5 (Step S177). When the detected temperature of the heating roller 71 is more than the set temperature T5, the heating roller 71 is turned off (Step S179), and then, the processing is returned to Step S153.

On the other hand, when the detected temperature of the heating roller 71 is equal to or less than the set temperature T5 in the determination at Step S177, the UV lamp 52 is turned on (Step S181), and image formation is started (Step S183). That is, the control section 10 starts to drive the paper feed motor 63, the paper output motor 64 and the delivering motor 62, and starts suction with the adsorption section 212 of the image forming drum 21. As a result, conveyance of a recording medium P from the paper feed unit 3 is started. The recording medium P is supplied to the image forming drum 21 through the delivering drum 22. Then, the control section 10 drives the recording heads 51 in series in accordance with the data of image to be formed to coincide with the arrival of the recording medium P at the recording heads 51 to perform predetermined image formation.

Subsequently, the control section 10 determines whether the image formation is all completed in accordance with the data of image to be formed (Step S185). When the image formation is not completed, the control section 10 monitors the detected temperature of the image forming drum 21 (Step S187). When the detected temperature is equal to or more than the set temperature T1, the processing moves on to Step S191; and when the detected temperature is less than the set temperature T1, the heating roller 72 is turned on (Step S189), and the processing moves on to Step S191.

At Step S191, monitoring of the detected temperature of the image forming drum 21 is continued. When the detected temperature is equal to or less than the set temperature T2, the processing moves on to Step S195; and when the detected temperature is more than the set temperature T2, the heating roller 72 is turned off (Step S193), and the processing moves on to Step S195.

At Step S195, the control section 10 monitors the detected temperature of the heating roller 71. When the detected temperature is equal to or more than the set temperature T4, the processing moves on to Step S199; and when the detected temperature is less than the set temperature T4, the heating roller 71 is turned on (Step S197), and the processing moves on to Step S199.

At Step S199, monitoring of the detected temperature of the heating roller 71 is continued. When the detected temperature is equal to or less than the set temperature T5, the processing moves on to Step S203; and when the detected temperature is more than the set temperature T5, the heating roller 71 is turned off (Step S201), and the processing moves on to Step S203.

Further, at Step S203, the detected temperature of the image forming drum 21 is monitored. When the detected temperature is more than the set temperature T3, the cooling fan 53 is operated to cool the image forming drum 21 (Step S205); and when the detected temperature is equal to or less than the set temperature T3, the cooling fan 53 is stopped (Step S207).

Then, the processing is returned to Step S185 again, and it is determined whether the image formation has been completed.

When it is determined that the image formation has been completed in the determination at Step S185, the processing is returned to Step S121 through Step S209, and preheating control is performed on the basis of the set temperatures T1, T2, T3, T4 and T5 until the next instruction for printing is inputted.

[Effects of First Embodiment]

As described above, the inkjet recording device 1A maintains the temperature of the image forming drum 21 at the predetermined range based on the set temperatures T1, T2 and T3. Therefore, how the dots spread on a recording medium P can be controlled, and a recorded image having a constant smoothness and gloss can be obtained. Further, since the recording heads 51 perform image formation directly on a recording medium P on the image forming drum 21, it is not necessary to perform transfer from the image forming drum to a recording medium P. This avoids image deterioration owing to the transfer, and can maintain high image quality. Further, this eliminates the need for a cleaning section which is required at the time of transferring an image.

Further, the inkjet recording device 1A includes the gloss adjustment button 68, and an operator inputs the degree of gloss and changes the range based on the set temperatures T1, T2 and T3 of the image forming drum on the basis of the set gloss. Therefore, an operator can adjust the smoothness and gloss of a recorded image as he/she chooses.

Further, since the inkjet recording device 1A includes the cooling fan 53 to cool the image forming drum 21, the temperature of the image forming drum 21 can be maintained at a predetermined range of temperature even when the image forming drum 21 is overheated. Therefore, how the dots spread on a recording medium can be controlled more effectively, and a recorded image having a constant smoothness and gloss can be obtained.

Further, as in the control at Steps S105-S143 described above, after the main power supply is turned on, the heating roller 71 performs preheating of the image forming drum 21 with no recording medium P supplied. Therefore, the temperature of the image forming drum 21 rises and the inkjet recording device 1A is ready for image recording in a short period of time.

Further, as in the control at Steps S107-S119 described above, after the main power supply is turned on, the image forming drum 21 is heated by being irradiated with ultraviolet rays, i.e., energy rays. Therefore, the temperature of the image forming drum 21 rises and the inkjet recording device 1A is ready for image recording in a short period of time.

Further, since the heating roller 72 of the second heating unit directly heats the image forming drum 21 with no recording medium P between the roller 72 and the drum 21, it is possible to heat the image forming drum 21 to a target temperature quickly. This leads to a quick control of how the dots spread, smoothness and gloss, and can maintain high image quality.

Further, the inkjet recording device 1A determines the set temperatures T4 and T5, which defines the range of set temperature of the heating roller 71, according to the thickness and the type of recording medium. Therefore, for recording media having various thicknesses and types, the temperature of a recording medium P can be maintained at an intended temperature; how the dots spread on a recording medium P can be controlled more effectively; and a recorded image having a constant smoothness and gloss can be obtained.

In addition, to achieve stability in image quality and gloss, it is preferable that the heating roller 71 perform heating so that the temperature of a recording medium under image formation is within the range of not less than 25° C. and less than (phase transition temperature −5)° C., wherein the phase transition temperature is the phase transition temperature of the ink ejected from each of the plurality of recording heads 51.

Further, although the type of recording medium P can be inputted by an operator through the recording medium type input unit 82, a sensor may be used to input the type of recording medium P, instead. The sensor may be provided in the path of a recording medium P upstream of the heating roller 71, and may identify the type of recording medium P. The type of sensor is not limited, and any sensor may be employed as long as it can identify the type of recording medium P.

Further, instead of inputting the type of recording medium P by an operator, the information of the type may be read with a reader from a bar code which is put on a case where recording media P are stored, for example.

[Second Embodiment]

Figure 11:
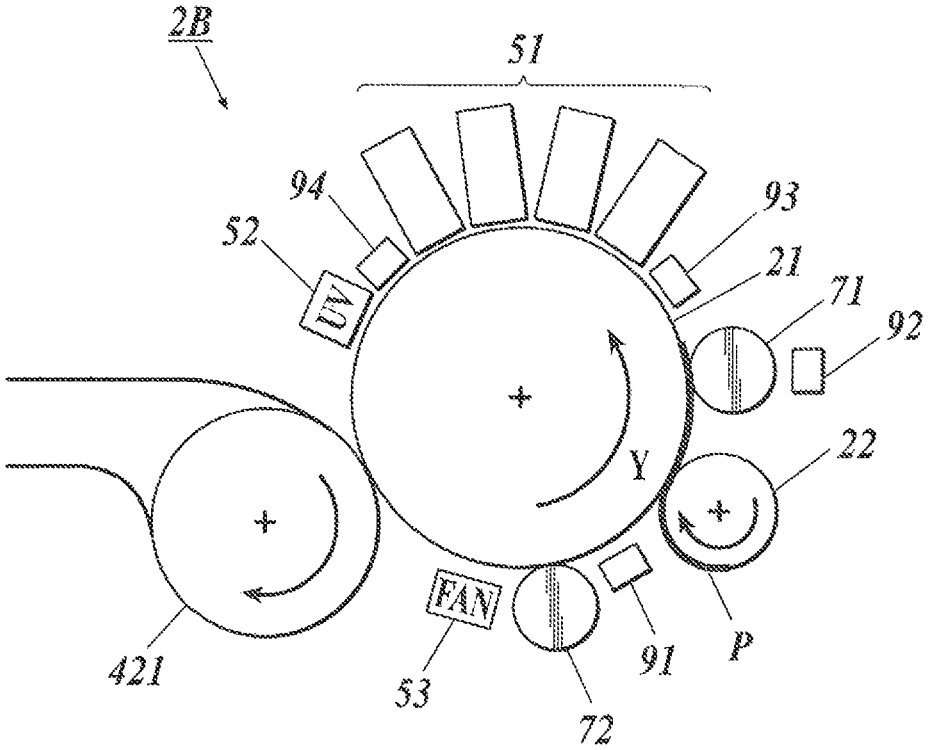
FIG. 11 is a typical view showing the internal configuration of an image forming unit of an inkjet recording device of the second embodiment of the present invention.
Figure 12:
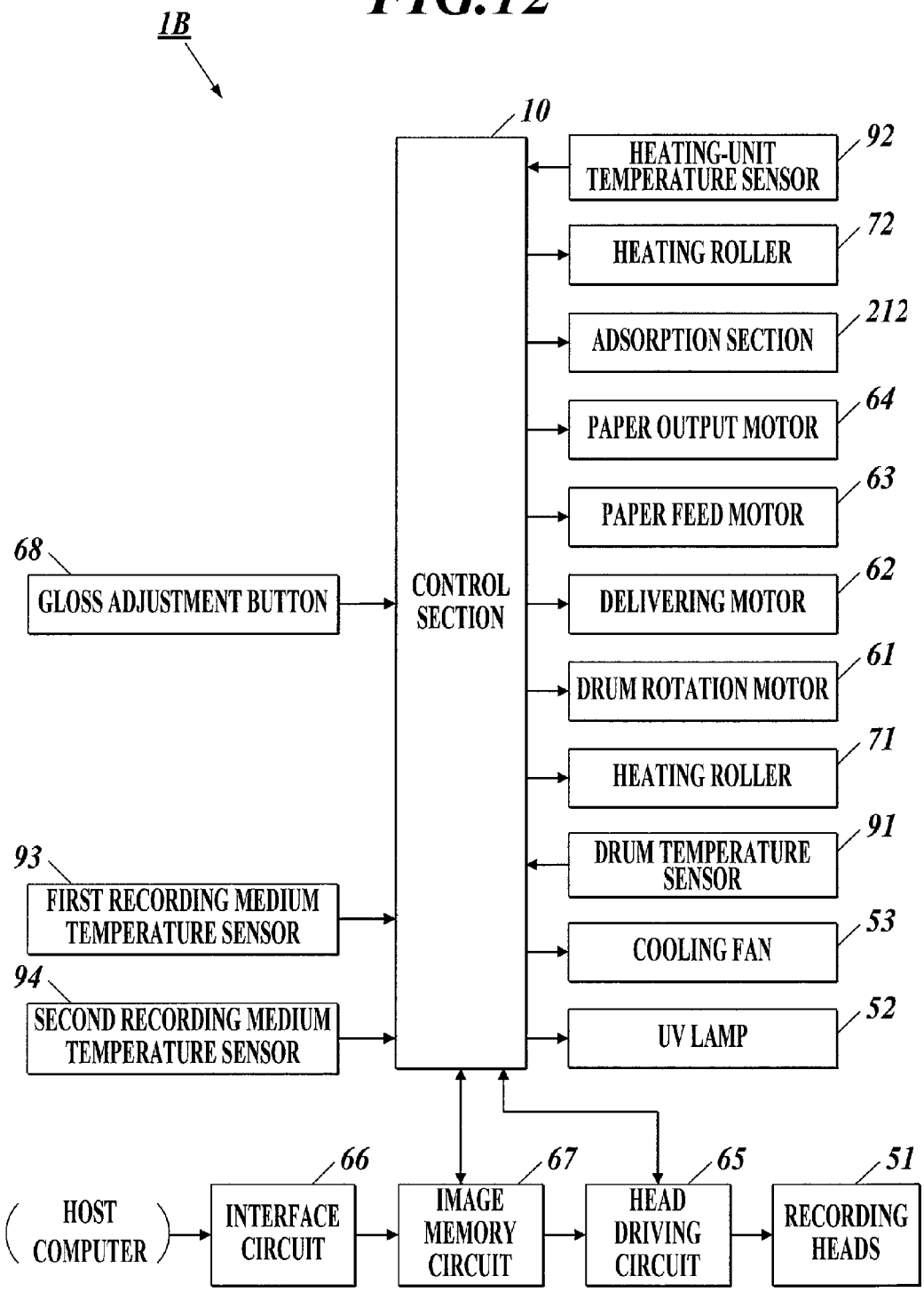
FIG. 12 is a block diagram showing the control system of the second embodiment of the present invention.
Figure 14:
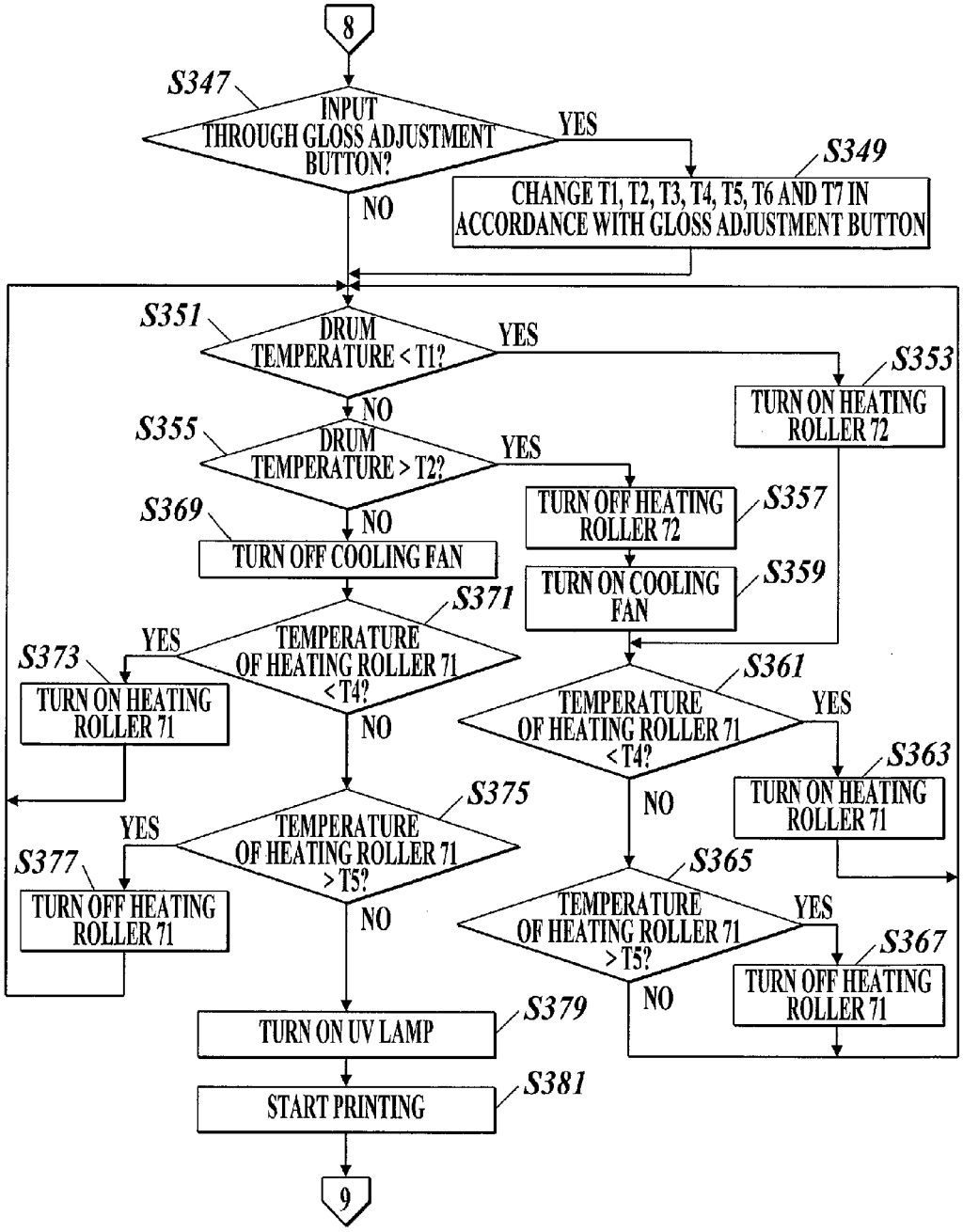
FIG. 14 is the continuation of the flowchart of FIG. 13.
Figure 15:
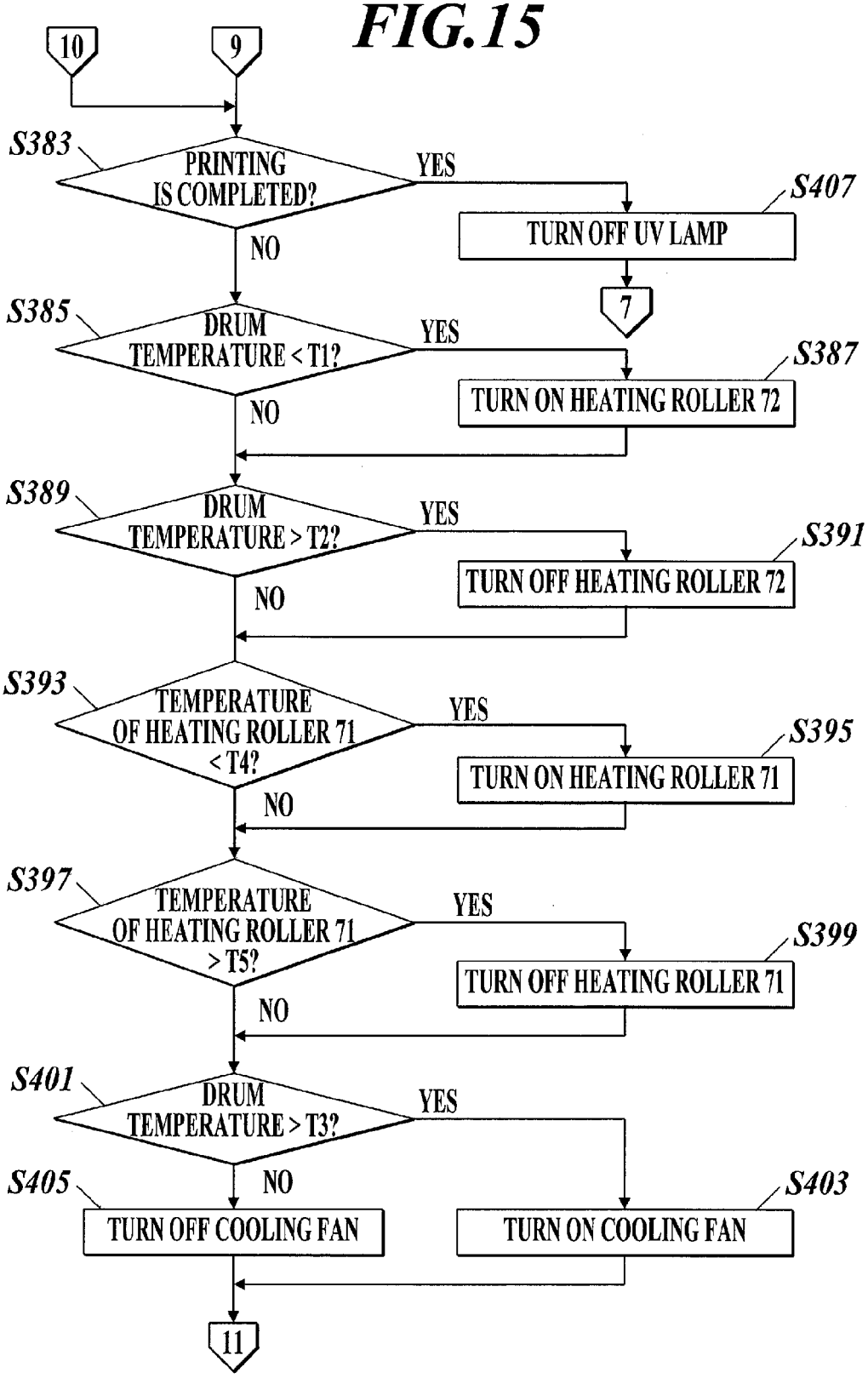
FIG. 15 is the continuation of the flowchart of FIG. 14.
Figure 16:
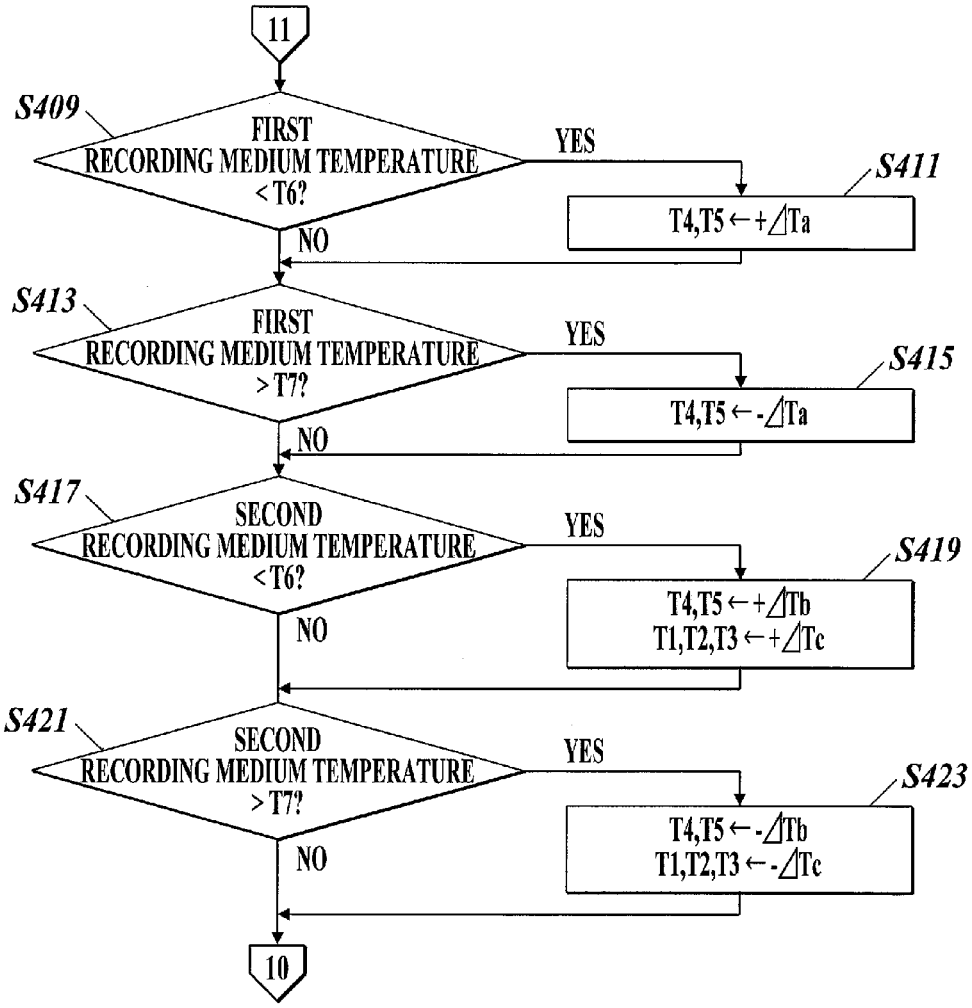
FIG. 16 is the continuation of the flowchart of FIG. 15.

An inkjet recording device 1B, which is the second embodiment of the present invention, is described with reference to the drawings. FIG. 11 is a typical view showing the internal configuration of an image forming unit 2B of an inkjet recording device 1B, and FIG. 12 is a block diagram showing the main control configuration of the inkjet recording device 1B. In the following explanations, only the points where the inkjet recording device 1B is different from the inkjet recording device 1A are described. The same components are indicated by the same reference number/letter, and repetitive explanations are omitted.

In the inkjet recording device 1B, a first recording medium temperature sensor 93 as a first recording medium temperature detector which detects the temperature of a recording medium P is disposed downstream of a heating roller 71 of a first heating unit and upstream of recording heads 51 around an image forming drum 21.

A second recording medium temperature sensor 94 as a second recording medium temperature detector which detects the temperature of a recording medium P is disposed downstream of the recording heads 51 and upstream of a conveying roller 421 for accumulation (to be more exact, which is disposed upstream of a UV lamp 52).

A contact-type temperature detection element, such as a thermocouple and a thermistor, may be used as the recording medium temperature sensors 93 and 94, but a contactless temperature detection element, such as a thermopile, is more preferable, similarly to a drum temperature sensor 91.

A recording medium thickness input unit 81 and a recording medium type input unit 82 are not provided in addition to a control section 10 in the inkjet recording device 1B, as shown in FIG. 12. But the units 81 and 82 may be provided in addition to the control section 10.

Next, the operation control at the time of image formation of the inkjet recording device 1B having the above described configuration is described with reference to the flowcharts of FIGS. 13 to 16.

In the inkjet recording device 1B, when the main power supply is turned on, the control section 10 reads the set temperatures T1, T2, T3, T4, T5, T6 and T7, which are set initial values, related to the image forming drum 21, from a ROM (Step S301). The set temperature T6 is the lower limit of the target temperature band of a recording medium P at each position of the first and second recording medium temperature sensors 93 and 94, and the set temperature T7 is the upper limit thereof. The set temperatures T6 and T7 of the first and second recording medium temperature sensors 93 and 94 may be the same normally. However, when the characteristics of the inks used for a plurality of recording heads 51 are different from one another, e.g., when the ink on the upstream side has a higher phase-change point than the ink on the downstream side in the recording medium conveyance direction (the phase-change point being a point where an ink changes from the liquid form to the gel form), it is preferable that the set temperatures T6 and T7 of the first recording medium temperature sensor 93 be higher than the set temperatures T6 and T7 of the second recording medium temperature sensor 94 according to the difference.

The control section 10 starts rotating the image forming drum 21 with a drum rotation motor 61 (Step S303), and subsequently, starts heating the image forming drum 21 with the heating rollers 71 and 72 (Step S305) and starts irradiation with ultraviolet rays by the UV lamp 52 (Step S307). That is, the heating rollers 71 and 72 and the UV lamp 52 perform preheating of the image forming drum 21 to which a recording medium P has not been supplied.

When the preheating is started, the control section 10 monitors the temperature of the image forming drum 21 with a drum temperature sensor 91 (Step S309). When the temperature of the image forming drum 21 is less than T1, the heating-unit temperature sensor 92 monitors the temperature of the heating roller 71 (Step S311).

When the detected temperature of the heating roller 71 is equal to or more than the set temperature T4, the processing moves on to Step S315. When the detected temperature is less than the set temperature T4, the heating roller 71 is turned on or maintained in the on-state (Step S313), and the processing moves on to Step S315.

At Step S315, it is determined whether the detected temperature of the heating roller 71 is more than the set temperature T5. When the detected temperature is more than the set temperature T5, the heating roller 71 is turned off, and (Step S317), and the processing is returned to Step S309.

When detected temperature of the heating roller 71 is equal to or less than the set temperature T5, the processing is directly returned to Step S309.

On the other hand, when it is determined that the temperature of the image forming drum 21 is equal to or more than T1 at step S309, the irradiation with the UV lamp 52 is stopped (Step S319).

After that, the control section 10 continues to monitor the detected temperature of the image forming drum 21 (Step S321). When the image forming drum 21 is equal to or more than the set temperature T1, the processing moves on to Step S325; and when the image forming drum 21 is less than the set temperature T1, the heating roller 72 is turned on (Step S323), and the processing moves on to Step S325.

At Step S325, monitoring of the detected temperature of the heating roller 71 is continued. When the image forming drum 21 is equal to or less than the set temperature T2, the processing moves on to Step S329; and when the image forming drum 21 is more than the set temperature T2, the heating roller 72 is turned off (Step S327), and the processing moves on to Step S329.

Next, the control section 10 monitors the detected temperature of the heating roller 71 (Step S329). When the heating roller 71 is equal to or more than the set temperature T4, the processing moves on to Step S333; and when the heating roller 71 is less than the set temperature T4, the heating roller 71 is turned on (Step S331), and the processing moves on to Step S333.

At Step S333, the monitoring of the detected temperature of the heating roller 71 is continued. When the heating roller 71 is equal to or less than the set temperature T5, the processing moves on to Step S337; and when the heating roller 71 is more than the set temperature T5, the heating roller 71 is turned off (Step S335), and the processing moves on to Step S337.

At Step S337, the detected temperature of the image forming drum 21 is monitored again. When the detected temperature is more than the set temperature T3, the cooling fan 53 is operated to cool the image forming drum 21 (Step S339), and the processing is returned to Step S321. When the image forming drum 21 is equal to or less than the set temperature T3, the cooling fan 53 is stopped (Step S341), and monitoring is performed to check whether an instruction for printing is inputted from the host computer (Step S343). When an instruction for printing is not inputted, the temperature regulation at Steps S321-S343 described above is repeated.

On the other hand, when an instruction for printing is inputted, the control section 10 determines whether a setting has been made for executing gloss adjustment on ink dots through the gloss adjustment button 68 (Step S347). When a setting has been made for executing gloss adjustment, the set temperatures T1, T2, T3, T4, T5, T6 and T7 are changed into new set values (Step S349).

Next, the control section 10 monitors the detected temperature of the image forming drum 21 (Step S351). When the detected temperature is less than the set temperature T1, the heating roller 72 is maintained in the on-state (Step S353), and the processing moves on to Step S361.

When the detected temperature is equal to or more than the set temperature T1, it is further determined whether the detected temperature of the image forming drum 21 is more than the set temperature T2 (Step S355). When the detected temperature is more than the set temperature T2, the heating roller 72 is turned off (Step S357), and the cooling fan 53 is operated (Step S359).

Then, the detected temperature of the heating roller 71 is monitored (Step S361). When the detected temperature of the heating roller 71 is less than the set temperature T4, the heating roller 71 is turned on (Step S363), and the processing is returned to Step S351.

When the detected temperature of the heating roller 71 is equal to or more than the set temperature T4, it is further determined whether the detected temperature is more than the set temperature T5 (Step S365). When the detected temperature of the heating roller 71 is equal to or less than the set temperature T5, the processing is returned to Step S351; and when the detected temperature is more than the set temperature T5, the heating roller 71 is turned off (Step S367), and then, the processing is returned to Step S351.

On the other hand, when the detected temperature of the image forming drum 21 is equal to or less than the set temperature T2 in the determination at Step S355, the cooling fan 53 is turned off (Step S369), and the detected temperature of the heating roller 71 is monitored (Step S371).

When the detected temperature of the heating roller 71 is less than the set temperature T4, the heating roller 71 is turned on (Step S373), and the processing is returned to Step S351.

When the detected temperature of the heating roller 71 is equal to or more than the set temperature T4, it is further determined whether the detected temperature is more than the set temperature T5 (Step S375). When the detected temperature of the heating roller 71 is more than the set temperature T5, the heating roller 71 is turned off (Step S377), and then, the processing is returned to Step S351.

On the other hand, when the detected temperature of the heating roller 71 is equal to or less than the set temperature T5 in the determination at Step S375, the UV lamp 52 is turned on (Step S379), and image formation is started (Step S381). That is, the control section 10 starts to drive the paper feed motor 63, the paper output motor 64 and the delivering motor 62, and starts suction with the adsorption section 212 of the image forming drum 21. As a result, conveyance of a recording medium P from the paper feed unit 3 is started. The recording medium P is supplied to the image forming drum 21 through the delivering drum 22. Then, the control section 10 drives the recording heads 51 in series in accordance with the data of image to be formed to coincide with the arrival of the recording medium P at the recording heads 51 to perform predetermined image formation.

Subsequently, the control section 10 determines whether the image formation is all completed in accordance with the data of image to be formed (Step S383). When it is determined that the image formation has been completed, the processing is returned to Step S321, and preheating control is performed on the basis of the set temperatures T1, T2, T3, T4 and T5 until the next instruction for printing is inputted (Step S407).

On the other hand, When the image formation is not completed, the control section 10 monitors the detected temperature of the image forming drum 21 (Step S385). When the detected temperature is equal to or more than the set temperature T1, the processing moves on to Step S389; and when the detected temperature is less than the set temperature T1, the heating roller 72 is turned on (Step S387), and the processing moves on to Step S389.

At Step S389, monitoring of the detected temperature of the image forming drum 21 is continued. When the detected temperature is equal to or less than the set temperature T2, the processing moves on to Step S393; and when the detected temperature is more than the set temperature T2, the heating roller 72 is turned off (Step S391), and the processing moves on to Step S393.

At Step S393, the control section 10 monitors the detected temperature of the heating roller 71. When the detected temperature is equal to or more than the set temperature T4, the processing moves on to Step S397; and when the detected temperature is less than the set temperature T4, the heating roller 71 is turned on (Step S395), and the processing moves on to Step S397.

At Step S397, monitoring of the detected temperature of the heating roller 71 is continued. When the detected temperature is equal to or less than the set temperature T5, the processing moves on to Step S401; and when the detected temperature is more than the set temperature T5, the heating roller 71 is turned off (Step S399), and the processing moves on to Step S401.

Further, at Step S401, the detected temperature of the image forming drum 21 is monitored. When the detected temperature is more than the set temperature T3, the cooling fan 53 is operated to cool the image forming drum 21 (Step S403); and when the detected temperature is equal to or less than the set temperature T3, the cooling fan 53 is stopped (Step S405).

Subsequently, the control section 10 monitors the detected temperature of the recording medium P with the first recording medium temperature sensor 93 (Step S409). When the detected temperature is equal to or more than the set temperature T6, the processing moves on to Step S413; and when the detected temperature is less than the set temperature T6, the correction value, which is obtained by subtracting the detected temperature from the set temperature T6 and multiplying the resultant by a predetermined coefficient, is added to the above-mentioned set temperatures T4 and T5 of the heating roller 71 (Step S411).

Subsequently, the control section 10 monitors the detected temperature of the recording medium P with the first recording medium temperature sensor 93 (Step S413). When the detected temperature is equal to or less than the set temperature T7, the processing moves on to Step S417; and when the detected temperature is more than the set temperature T7, the correction value, which is obtained by subtracting the detected temperature from the set temperature T7 and multiplying the resultant by a predetermined coefficient (i.e., the correction value is a negative value), is added to the above-mentioned set temperatures T4 and T5 of the heating roller 71 (Step S415).

Further, the control section 10 monitors the detected temperature of the recording medium P with the second recording medium temperature sensor 94 (Step S417). When the detected temperature is equal to or more than the set temperature T6, the processing moves on to Step S421. When the detected temperature is less than the set temperature T6, the correction value, which is obtained by subtracting the detected temperature from the set temperature T6 and multiplying the resultant by a predetermined coefficient, is added to the above-mentioned set temperatures T4 and T5 of the heating roller 71; and the correction value, which is obtained by subtracting the detected temperature from the set temperature T6 and multiplying the resultant by another predetermined coefficient, is added to the above-mentioned set temperatures T1, T2 and T3 of the image forming drum 21 (Step S419).

Subsequently, the control section 10 monitors the detected temperature of the recording medium P with the second recording medium temperature sensor 94 (Step S421). When the detected temperature is equal to or less than the set temperature T7, the processing is returned to Step S383.

On the other hand, when the detected temperature is more than the set temperature T7, the correction value, which is obtained by subtracting the detected temperature from the set temperature T7 and multiplying the resultant by a predetermined coefficient (i.e., the correction value is a negative value), is added to the above-mentioned set temperatures T4 and T5 of the heating roller 71, and the correction value, which is obtained by subtracting the detected temperature from the set temperature T7 and multiplying the resultant by another predetermined coefficient, is added to the above-mentioned set temperatures T1, T2 and T3 of the image forming drum 21 (Step S423).

Then, the processing is returned to Step S383.

[Effects of Second Embodiment]

As described above, the inkjet recording device 1B has the effects similar to the inkjet recording device 1A. Further, the first recording medium temperature sensor 93 detects the temperature of a recording medium P before the recording heads 51, and the set temperatures T4 and T5 of the heating roller 71 are corrected on the basis of the detected temperature. Therefore, how the dots spread on a recording medium P can be controlled, and a recorded image having a constant smoothness and gloss can be obtained.

Further, the second recording medium temperature sensor 94 detects the temperature of a recording medium P as well after the recording medium P passes the recording heads 51. Thus, the set temperatures T1-T5 of the image forming drum 21 and the heating roller 71 are corrected on the basis of the detected temperature. As a result, how the dots spread on a recording medium P can be controlled, and a recorded image having a constant smoothness and gloss can be obtained.

The set temperatures T1, T2 and T3 of the image forming drum 21 may be corrected on the basis of the temperature detected by the first recording medium temperature sensor 93.

[Third Embodiment]

Figure 17:
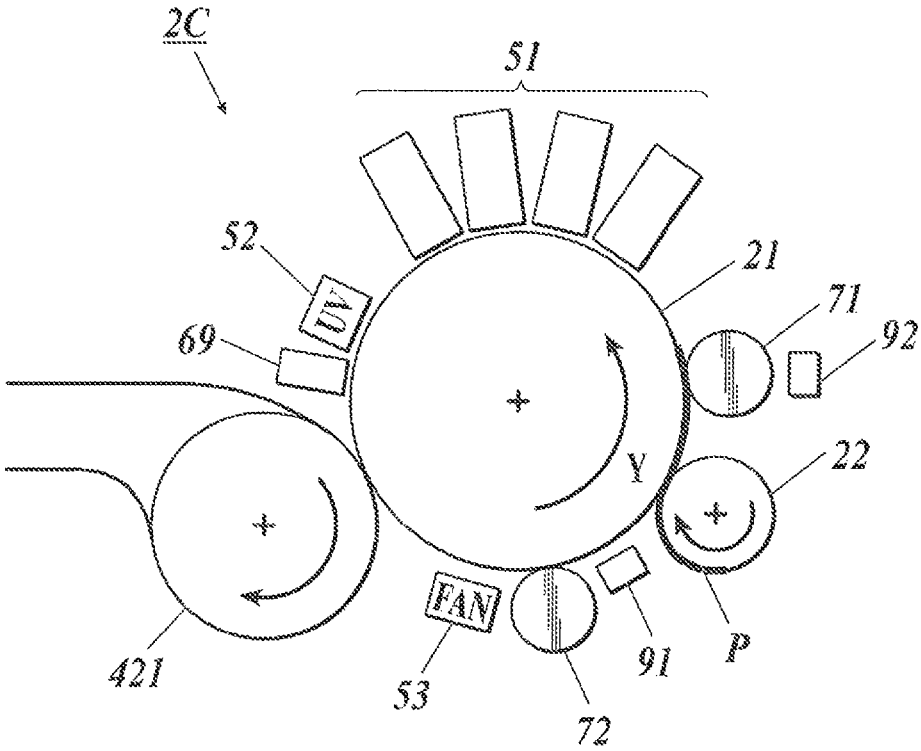
FIG. 17 is a typical view showing the internal configuration of an image forming unit of an inkjet recording device of the third embodiment of the present invention.
Figure 18:
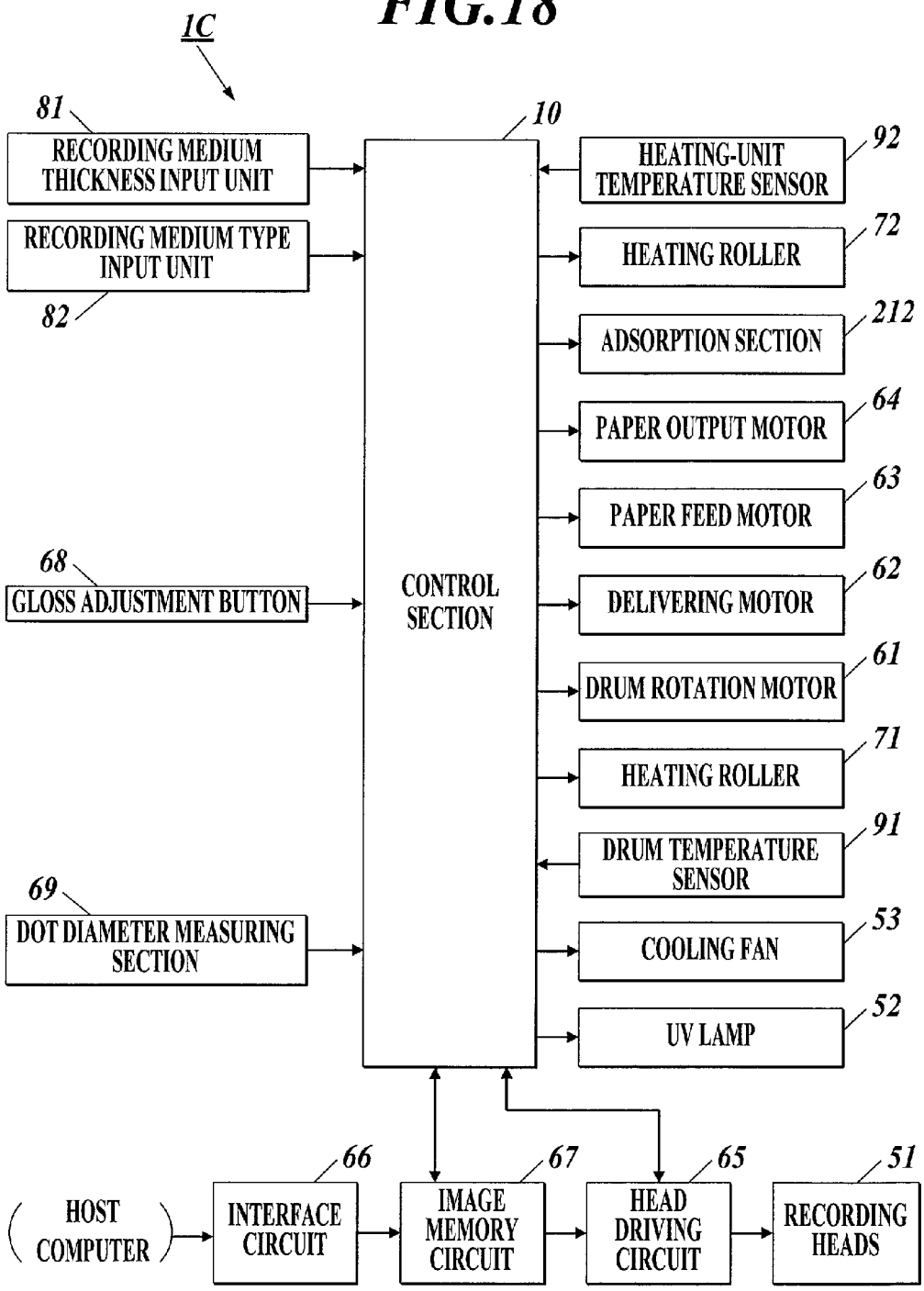
FIG. 18 is a block diagram showing the control system of the third embodiment of the present invention.
Figure 19:
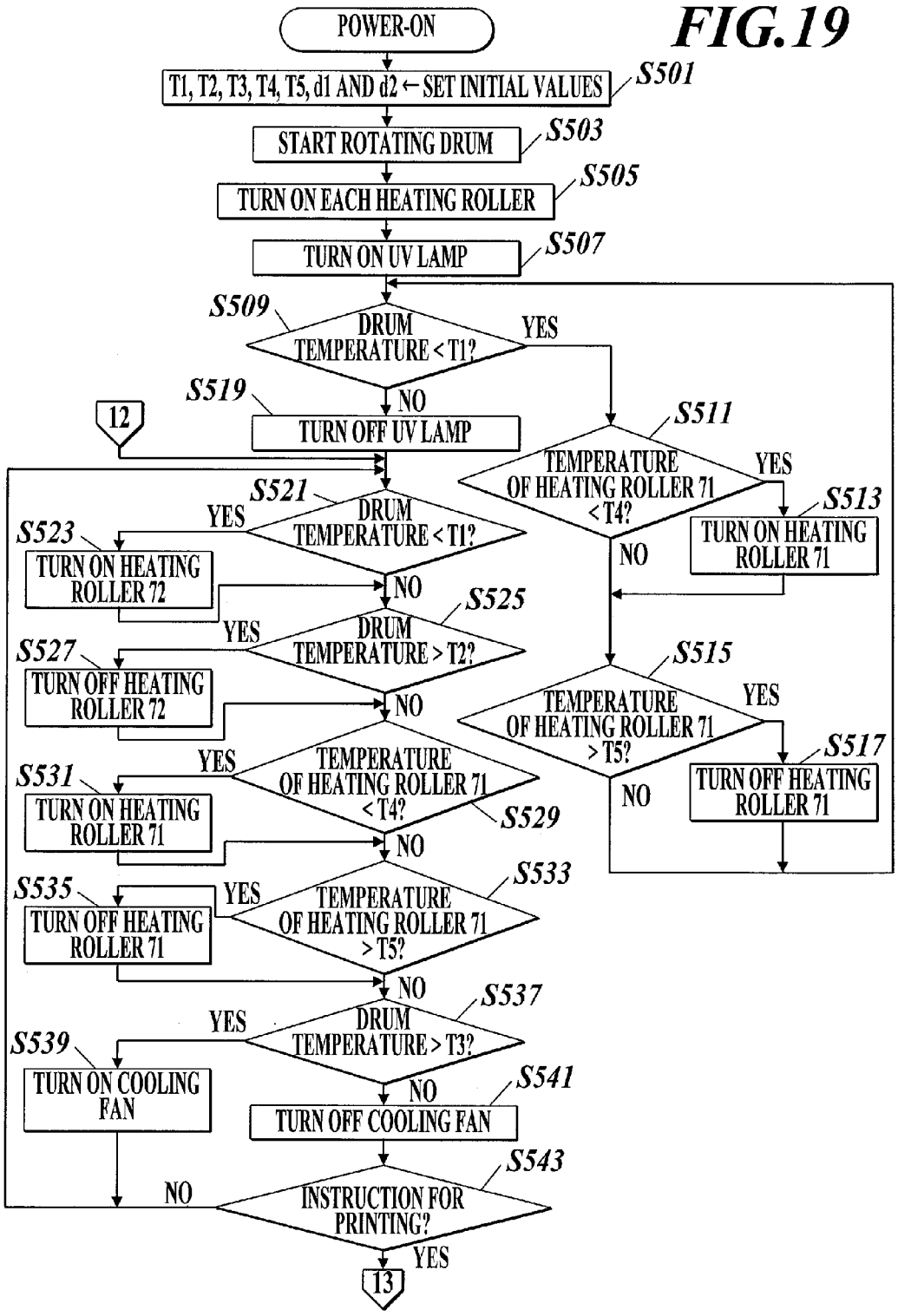
FIG. 19 is a flowchart showing the operation control at the time of image formation of the third embodiment of the present invention.
Figure 20:
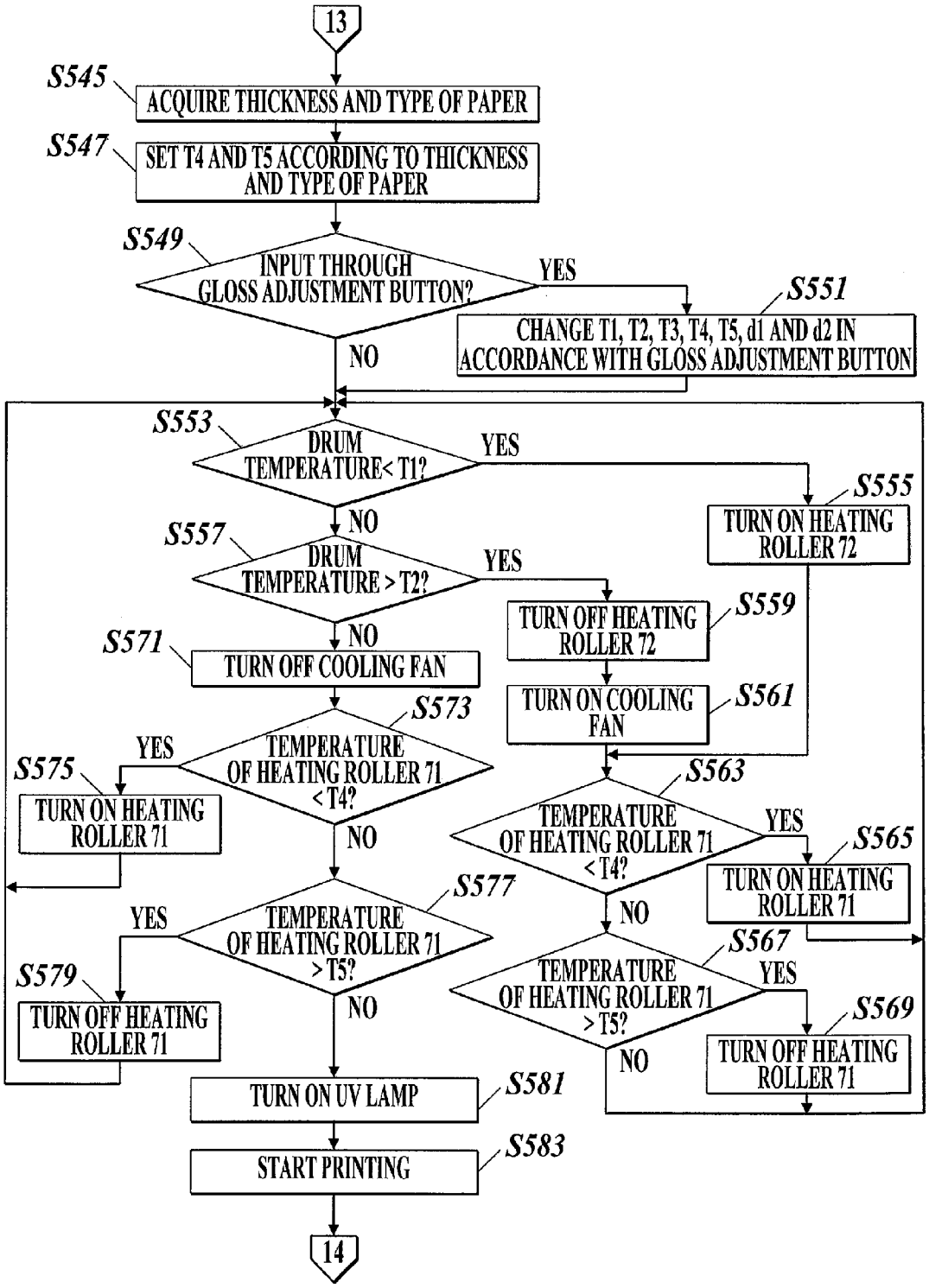
FIG. 20 is the continuation of the flowchart of FIG. 19.
Figure 21:
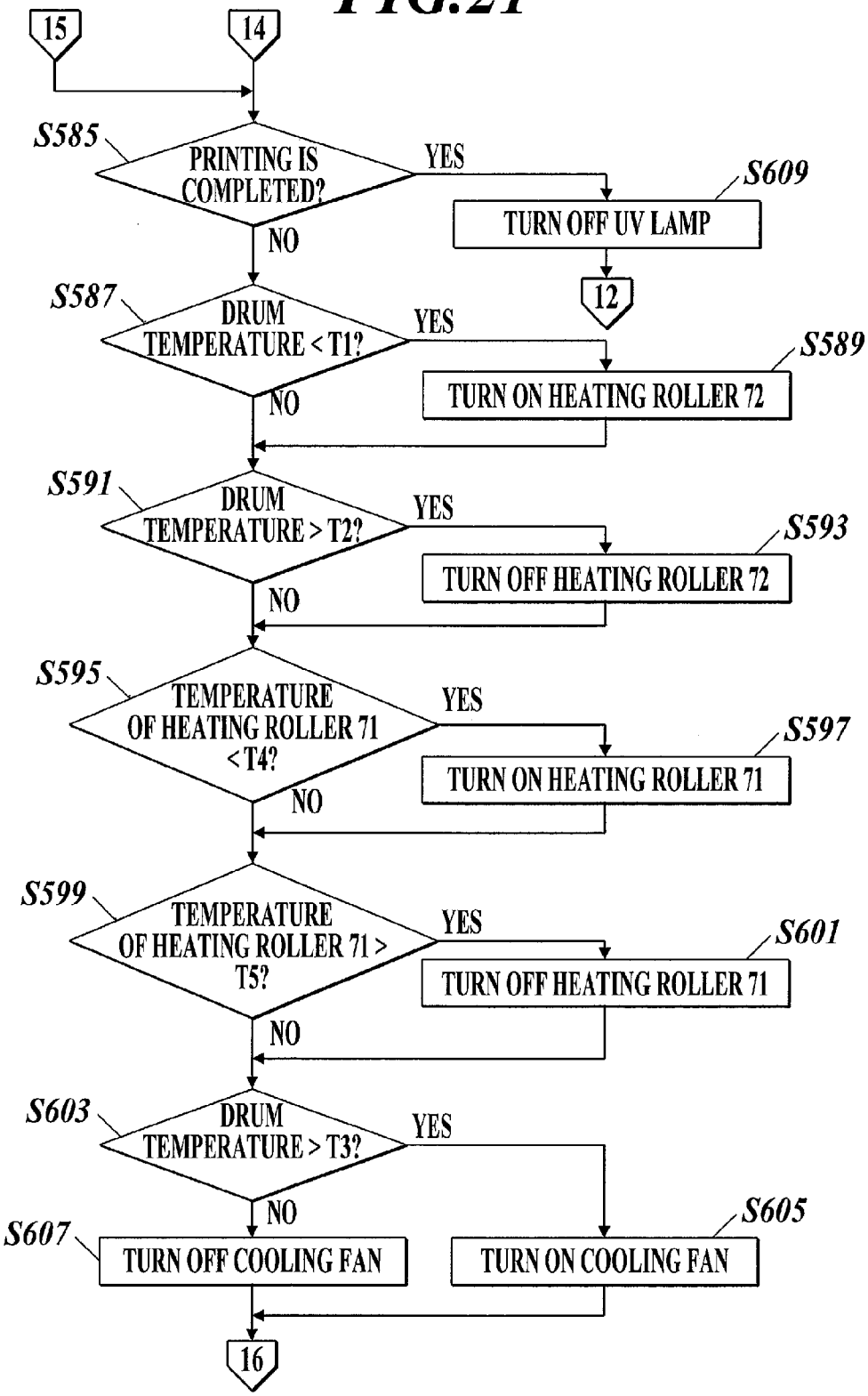
FIG. 21 is the continuation of the flowchart of FIG. 20.
Figure 22:
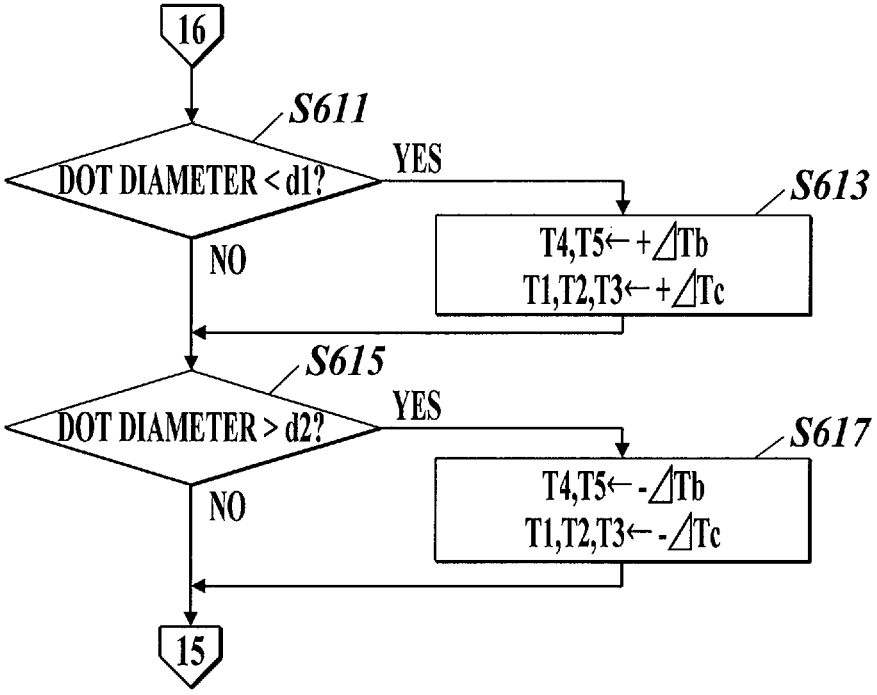
FIG. 22 is the continuation of the flowchart of FIG. 21.

An inkjet recording device 1C, which is the third embodiment of the present invention, is described with reference to the drawings. FIG. 17 is a typical view showing the internal configuration of an image forming unit 2C of an inkjet recording device 1C, and FIG. 18 is a block diagram showing the main control configuration of the inkjet recording device 1C. In the following explanations, only the points where the inkjet recording device 1C is different from the inkjet recording device 1A are described. The same components are indicated by the same reference number/letter, and repetitive explanations are omitted.

The inkjet recording device 1C is different from the inkjet recording device 1A in that the inkjet recording device 1C includes a dot diameter measuring section 69 disposed immediately downstream of a UV lamp 52 around an image forming drum 21. The dot diameter measuring section 69 is an image sensing device such as a CCD which images the dots on a recording medium P formed by recording heads 51 for the range corresponding to the full width of the recording medium P. A control section 10 generates the picked-up image data from the output of the dot diameter measuring section 69, and calculates the size of dots on the basis of the image of the dots.

Next, the operation control at the time of image formation of the inkjet recording device 1C having the above described configuration is described with reference to the flowcharts of FIGS. 19 to 22.

In the inkjet recording device 1A, when the main power supply is turned on, the control section 10 reads the set temperatures T1, T2, T3, T4 and T5 and the set dot diameters d1 and d2, which are set initial values, related to the image forming drum 21, from a ROM (Step S501). The value of d1 is the lower limit of the target value of the diameter of dot to be formed on a recording medium P, and the value of d2 is the upper limit of the target value of the diameter of dot to be formed on a recording medium P.

The control section 10 starts rotating the image forming drum 21 with a drum rotation motor 61 (Step S503), and subsequently, starts heating the image forming drum 21 with heating rollers 71 and 72 (Step S505) and starts irradiation with ultraviolet rays by the UV lamp 52 (Step S507). That is, the heating rollers 71 and 72 and the UV lamp 52 perform preheating of the image forming drum 21 to which a recording medium P has not been supplied.

When the preheating is started, the control section 10 monitors the temperature of the image forming drum 21 with a drum temperature sensor 91 (Step S509). When the temperature of the image forming drum 21 is less than T1, the heating-unit temperature sensor 92 monitors the temperature of the heating roller 71 (Step S511).

When the detected temperature of the heating roller 71 is equal to or more than the set temperature T4, the processing moves on to Step S515. When the detected temperature is less than the set temperature T4, the heating roller 71 is turned on or maintained in the on-state (Step S513), and the processing moves on to Step S515.

At Step S515, it is determined whether the detected temperature of the heating roller 71 is more than the set temperature T5. When the detected temperature is more than the set temperature T5, the heating roller 71 is turned off (Step S517), and the processing is returned to Step 5509.

When detected temperature of the heating roller 71 is equal to or less than the set temperature T5, the processing is directly returned to Step S509.

On the other hand, when it is determined that the temperature of the image forming drum 21 is equal to or more than T1 at step S509, the irradiation with the UV lamp 52 is stopped (Step S519).

After that, the control section 10 continues to monitor the detected temperature of the image forming drum 21 (Step S521). When the image forming drum 21 is equal to or more than the set temperature T1, the processing moves on to Step S525; and when the image forming drum 21 is less than the set temperature T1, the heating roller 72 is turned on (Step S523), and the processing moves on to Step S525.

At Step S525, monitoring of the detected temperature of the image forming drum 21 is continued. When the image forming drum 21 is equal to or less than the set temperature T2, the processing moves on to Step S529; and when the image forming drum 21 is more than the set temperature T2, the heating roller 72 is turned off (Step S527), and the processing moves on to Step S529.

Next, the control section 10 monitors the detected temperature of the heating roller 71 (Step S529). When the heating roller 71 is equal to or more than the set temperature T4, the processing moves on to Step S533; and when the heating roller 71 is less than the set temperature T4, the heating roller 71 is turned on (Step S531), and the processing moves on to Step S533.

At Step S533, the monitoring of the detected temperature of the heating roller 71 is continued. When the heating roller 71 is equal to or less than the set temperature T5, the processing moves on to Step S537; and when the heating roller 71 is more than the set temperature T5, the heating roller 71 is turned off (Step S535), and the processing moves on to Step S537.

At Step S537, the detected temperature of the image forming drum 21 is monitored again. When the detected temperature is more than the set temperature T3, the cooling fan 53 is operated to cool the image forming drum 21 (Step S539), and the processing is returned to Step S521. When the image forming drum 21 is equal to or less than the set temperature T3, the cooling fan 53 is stopped (Step S541), and monitoring is performed to check whether an instruction for printing is inputted from the host computer (Step S543). When an instruction for printing is not inputted, the temperature regulation at Steps S521-S543 described above is repeated.

On the other hand, when an instruction for printing is inputted, the control section 10 reads the thickness and the type of recording medium P inputted by the recording medium thickness input unit 81 and the recording medium type input unit 82 (Step S545), and specifies the set temperatures T4 and T5 with reference to table data (Step S547).

Further, it is determined whether a setting has been made for executing gloss adjustment on ink dots through the gloss adjustment button 68 (Step S549). When a setting has been made for executing gloss adjustment, the set temperatures T1, T2, T3, T4 and T5 and the set dot diameters d1 and d2 are changed into new set values (Step S551).

Next, the control section 10 monitors the detected temperature of the image forming drum 21 (Step S553). When the detected temperature is less than the set temperature T1, the heating roller 72 is maintained in the on-state (Step S555), and the processing moves on to Step S563.

When the detected temperature is equal to or more than the set temperature T1, it is further determined whether the detected temperature of the image forming drum 21 is more than the set temperature T2 (Step S557). When the detected temperature is more than the set temperature T2, the heating roller 72 is turned off (Step S559), and the cooling fan 53 is operated (Step S561).

Then, the detected temperature of the heating roller 71 is monitored (Step S563). When the detected temperature of the heating roller 71 is less than the set temperature T4, the heating roller 71 is turned on (Step S565), and the processing is returned to Step S553.

When the detected temperature of the heating roller 71 is equal to or more than the set temperature T4, it is further determined whether the detected temperature is more than the set temperature T5 (Step S567). When the detected temperature of the heating roller 71 is equal to or less than the set temperature T5, the processing is returned to Step S553; and when the detected temperature is more than the set temperature T5, the heating roller 71 is turned off (Step S569), and then, the processing is returned to Step S553.

On the other hand, when the detected temperature of the image forming drum 21 is equal to or less than the set temperature T2 in the determination at Step S557, the cooling fan 53 is turned off (Step S571), and the detected temperature of the heating roller 71 is monitored (Step S573).

When the detected temperature of the heating roller 71 is less than the set temperature T4, the heating roller 71 is turned on (Step S575), and the processing is returned to Step S553.

When the detected temperature of the heating roller 71 is equal to or more than the set temperature T4, it is further determined whether the detected temperature is more than the set temperature T5 (Step S577). When the detected temperature of the heating roller 71 is more than the set temperature T5, the heating roller 71 is turned off (Step S579), and then, the processing is returned to Step S553.

On the other hand, when the detected temperature of the heating roller 71 is equal to or less than the set temperature T5 in the determination at Step S577, the UV lamp 52 is turned on (Step S581), and image formation is started (Step S583). That is, the control section 10 starts to drive the paper feed motor 63, the paper output motor 64 and the delivering motor 62, and starts suction with the adsorption section 212 of the image forming drum 21. As a result, conveyance of a recording medium P from the paper feed unit 3 is started. The recording medium P is supplied to the image forming drum 21 through the delivering drum 22. Then, the control section 10 drives the recording heads 51 in series in accordance with the data of image to be formed to coincide with the arrival of the recording medium P at the recording heads 51 to perform predetermined image formation.

Subsequently, the control section 10 determines whether the image formation is all completed in accordance with the data of image to be formed (Step S585). When the image formation is completed, the processing moves on to Step S609; and when the image formation is not completed, the control section 10 monitors the detected temperature of the image forming drum 21 (Step S587). When the detected temperature is equal to or more than the set temperature T1, the processing moves on to Step S591; and when the detected temperature is less than the set temperature T1, the heating roller 72 is turned on (Step S589), and the processing moves on to Step S591.

At Step S591, monitoring of the detected temperature of the image forming drum 21 is continued. When the detected temperature is equal to or less than the set temperature T2, the processing moves on to Step S595; and when the detected temperature is more than the set temperature T2, the heating roller 72 is turned off (Step S593), and the processing moves on to Step S595.

At Step S595, the control section 10 monitors the detected temperature of the heating roller 71. When the detected temperature is equal to or more than the set temperature T4, the processing moves on to Step S599; and when the detected temperature is less than the set temperature T4, the heating roller 71 is turned on (Step S597), and the processing moves on to Step S599.

At Step S599, monitoring of the detected temperature of the heating roller 71 is continued. When the detected temperature is equal to or less than the set temperature T5, the processing moves on to Step S603; and when the detected temperature is more than the set temperature T5, the heating roller 71 is turned off (Step S601), and the processing moves on to Step S603.

Further, at Step S603, the detected temperature of the image forming drum 21 is monitored. When the detected temperature is more than the set temperature T3, the cooling fan 53 is operated to cool the image forming drum 21 (Step S605); and when the detected temperature is equal to or less than the set temperature T3, the cooling fan 53 is stopped (Step S607).

Subsequently, the control section 10 determines whether the dot diameter obtained through the imaging by the dot diameter measuring section 69 during the image formation is less than the set dot diameter d1 (Step S611). When the dot diameter is equal to or more than the set dot diameter d1, the processing moves on to Step S613; and when the dot diameter is less than the set dot diameter d1, the correction value, which is obtained by subtracting the imaged-dot diameter from the set dot diameter d1 and multiplying the resultant by a predetermined coefficient, is added to the above-mentioned set temperatures T1, T2 and T3 of the image forming drum 21 and the set temperatures T4 and T5 of the heating roller 71 (Step S611).

Further, the control section 10 determines whether the dot diameter obtained through the imaging by the dot diameter measuring section 69 during the image formation is more than the set dot diameter d2 (Step S615). When the dot diameter is equal to or less than the set dot diameter d2, the processing is returned to Step S585. When the dot diameter is more than the set dot diameter d2, the correction value, which is obtained by subtracting the imaged-dot diameter from the set dot diameter d2 and multiplying the resultant by a predetermined coefficient (i.e., the correction value is a negative value), is added to the above-mentioned set temperatures T1, T2 and T3 of the image forming drum 21 and the set temperatures T4 and T5 of the heating roller 71 (Step S617), and the processing is returned to Step S585.

[Effects of Third Embodiment]

As described above, the inkjet recording device 1C has the effects similar to the inkjet recording device 1A. Further, the dot diameter measuring section 69 measures the dot diameter of ink recorded on a recording medium P, and the set temperatures T4 and T5 of the heating roller 71 and the set temperatures T1, T2 and T3 of the image forming drum 21 are changed. Therefore, how the dots spread on a recording medium P can be controlled more effectively, and a recorded image having a constant smoothness and gloss can be obtained.

[Fourth Embodiment]

Figure 23:
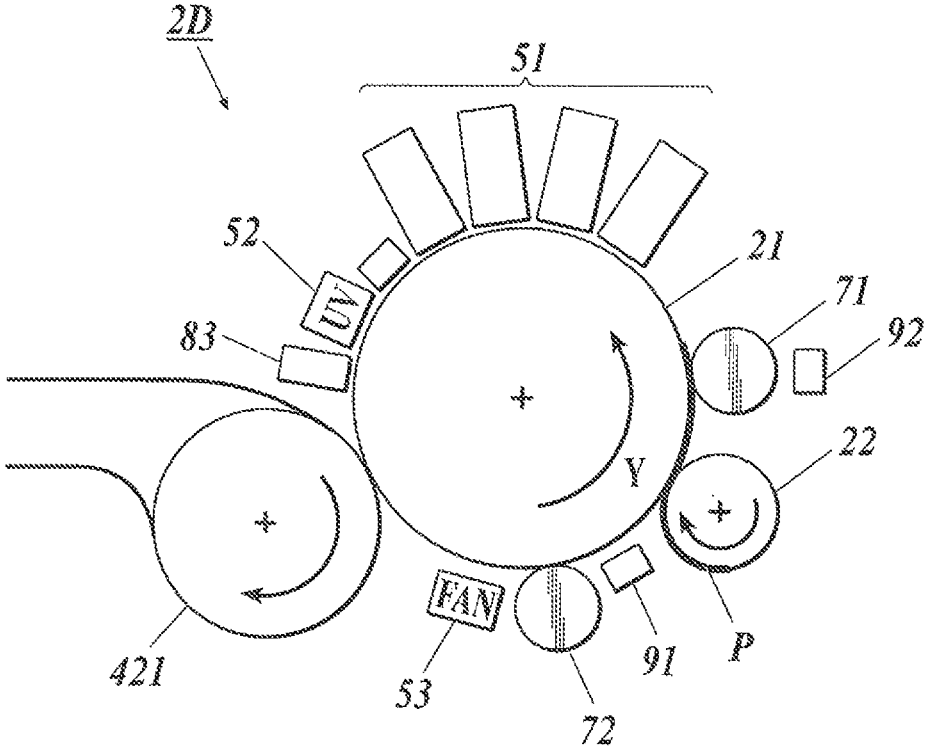
FIG. 23 is a typical view showing the internal configuration of an image forming unit of an inkjet recording device of the fourth embodiment of the present invention.
Figure 24:
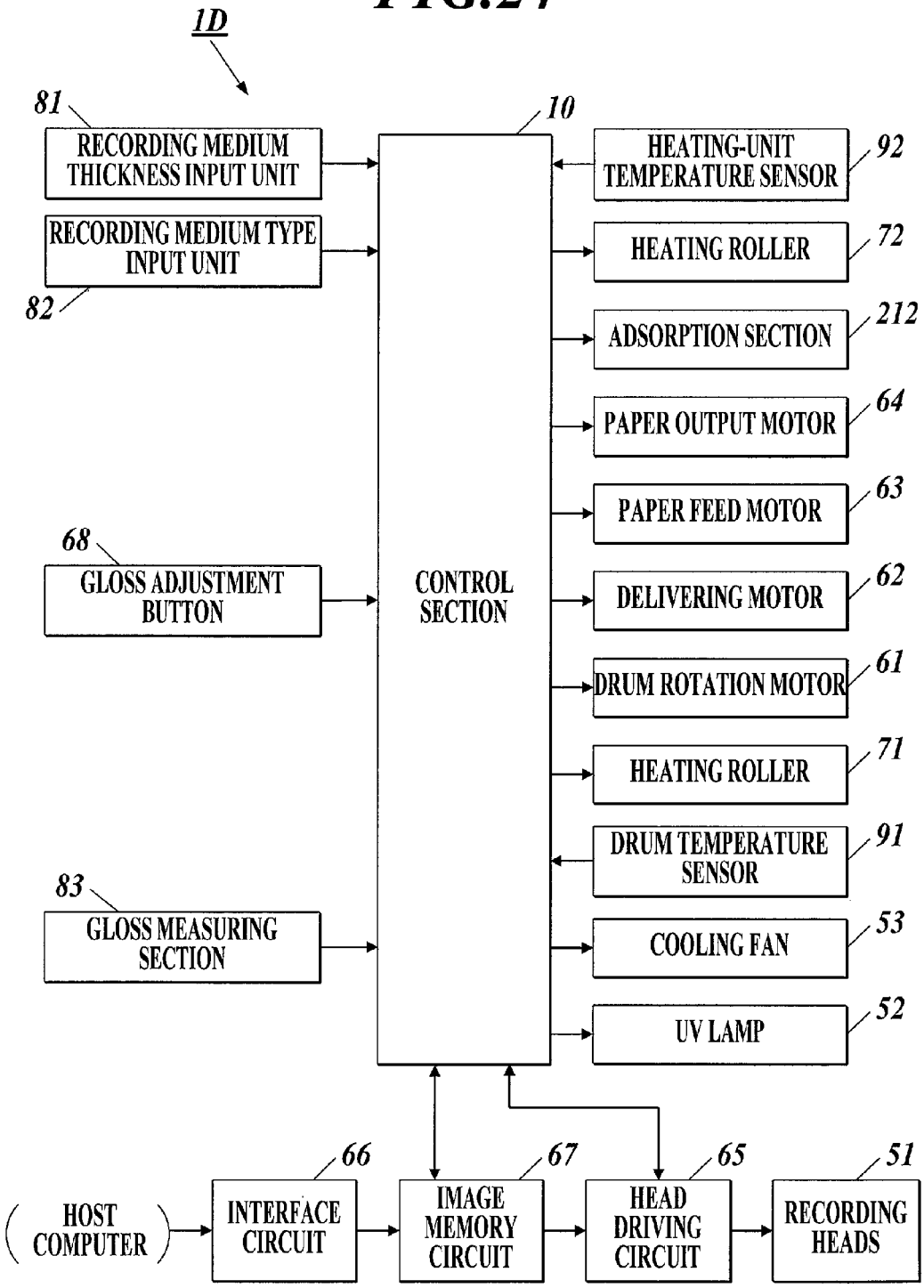
FIG. 24 is a block diagram showing the control system of the fourth embodiment of the present invention.

An inkjet recording device 1D, which is the fourth embodiment of the present invention, is described with reference to the drawings. FIG. 23 is a typical view showing the internal configuration of an image forming unit 2D of an inkjet recording device 1D, and FIG. 24 is a block diagram showing the main control configuration of the inkjet recording device 1D. In the following explanations, only the points where the inkjet recording device 1D is different from the inkjet recording device 1A are described. The same components are indicated by the same reference number/letter, and repetitive explanations are omitted.

The inkjet recording device 1D is different from the inkjet recording device 1A in that the inkjet recording device 1D includes a gloss measuring section 83 disposed immediately downstream of a UV lamp 52 around an image forming drum 21.

Figure 25:
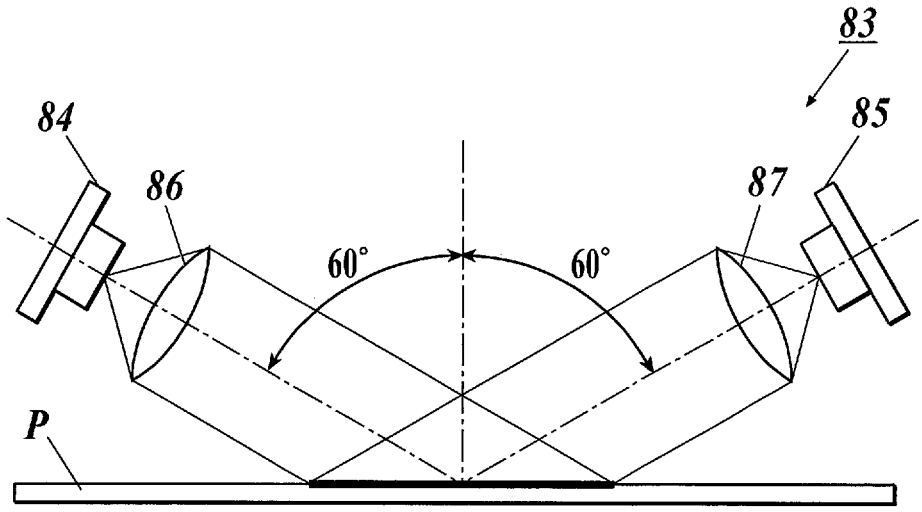
FIG. 25 is an explanatory diagram showing a gloss measuring section of the fourth embodiment of the present invention.
Figure 27:
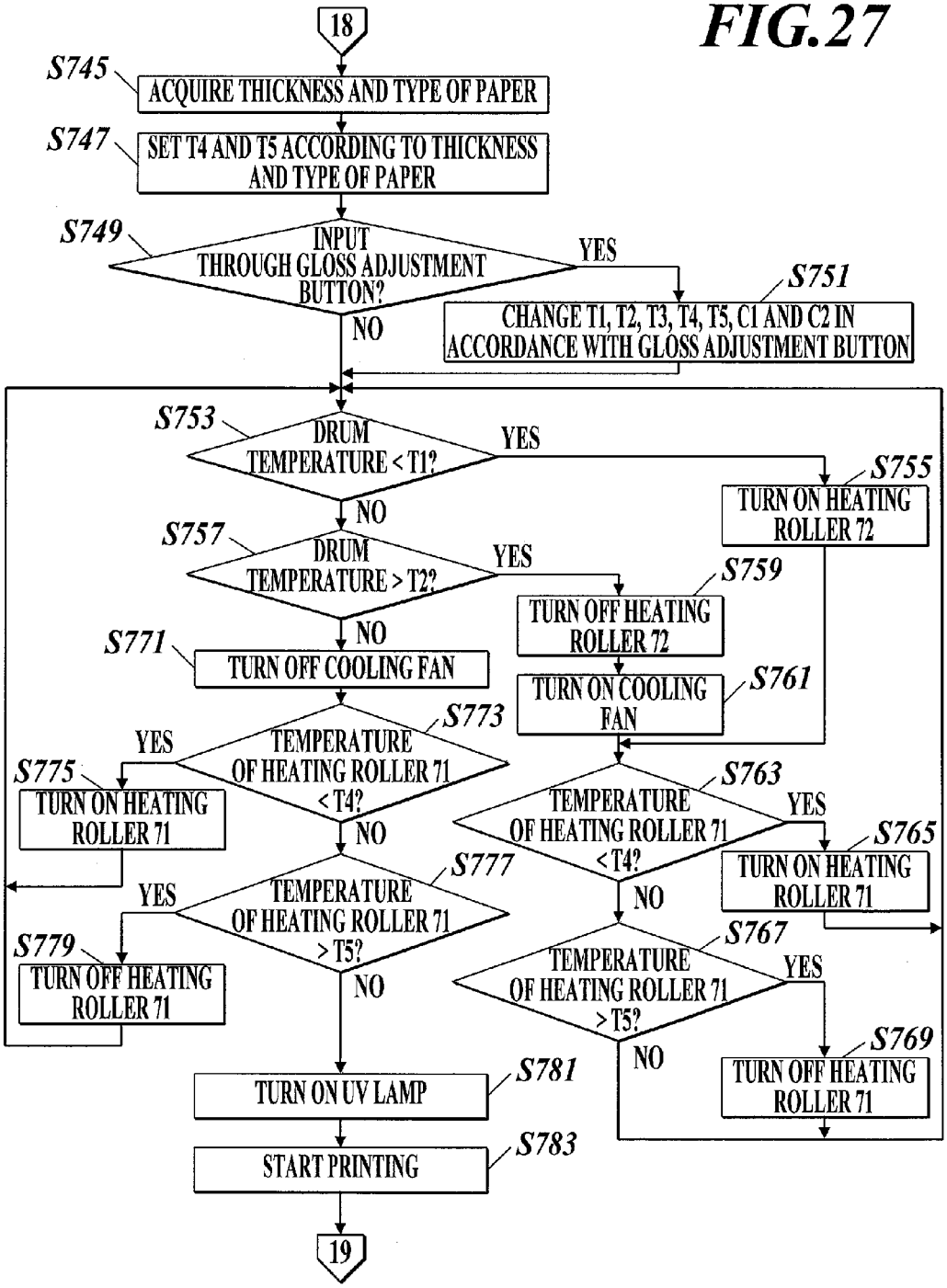
FIG. 27 is the continuation of the flowchart of FIG. 26.
Figure 28:
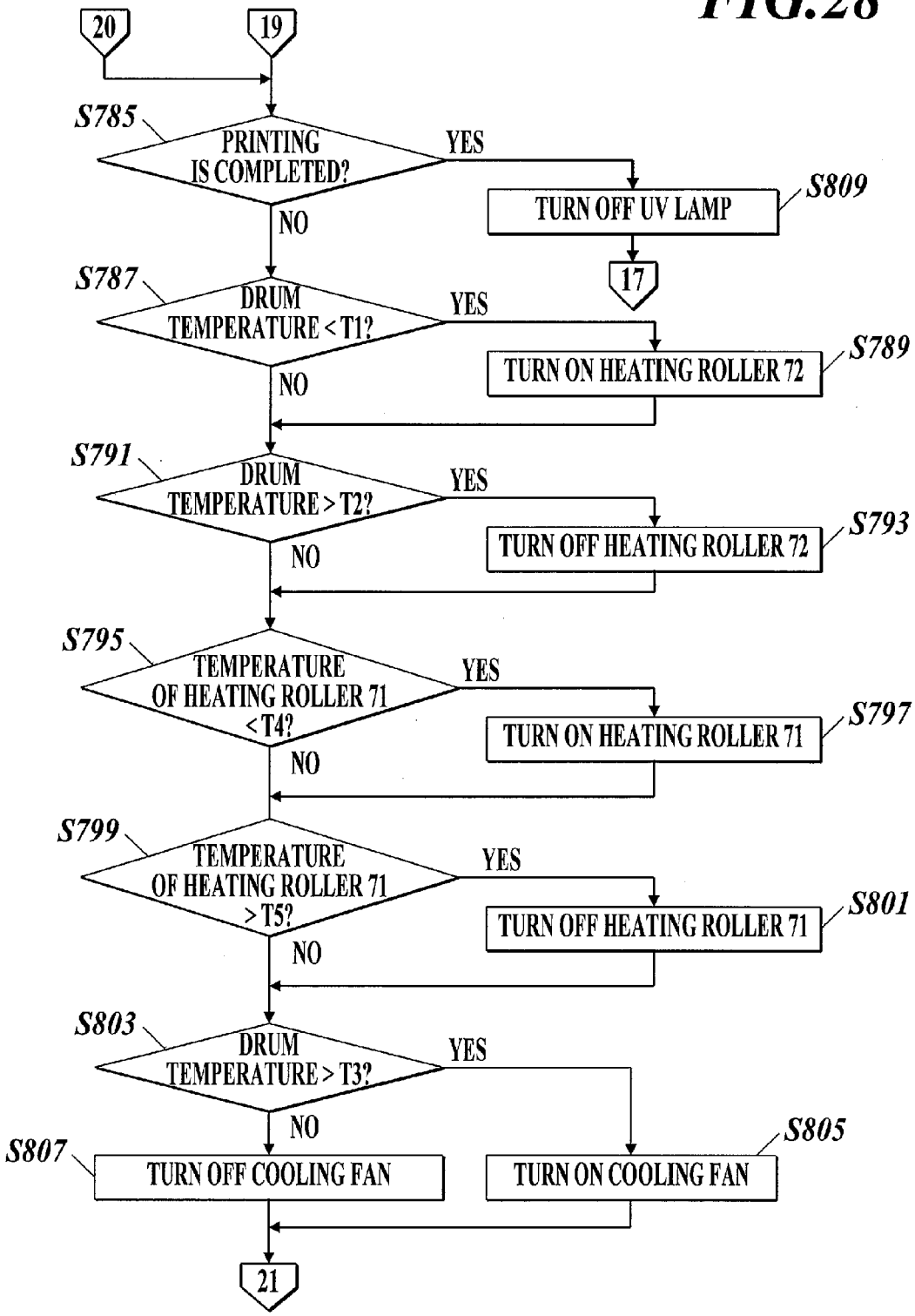
FIG. 28 is the continuation of the flowchart of FIG. 27.
Figure 29:
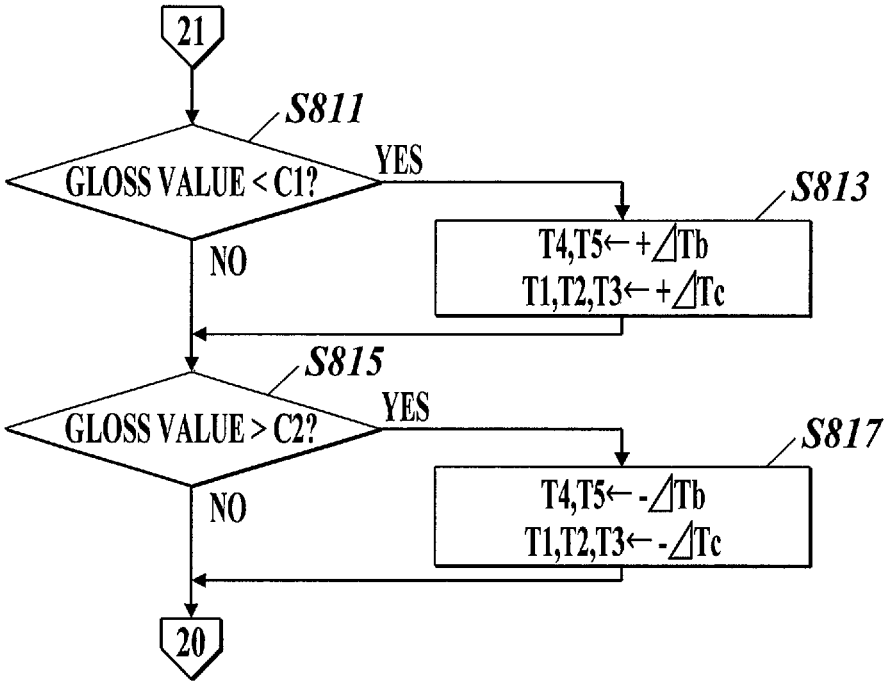
FIG. 29 is the continuation of the flowchart of FIG. 28.

FIG. 25 is an explanatory diagram showing the configuration of the gloss measuring section 83. The gloss measuring section 83 is a measurement device which measures the gloss of dots on a recording medium P formed by recording heads 51 for the range corresponding to the full width of the recording medium P. The gloss measuring section 83 is mainly constituted of a light source 84 which irradiates the upper surface of a recording medium P at an inclination angle of 60 degrees with respect to a vertical direction; an optical receiver 85 which receives the reflected light; and optical lenses 86 and 87 of the light source 84 and the optical receiver 85, respectively.

The control section 10 obtains the intensity of the reflected light from dots on the basis of the output signals from the optical receiver 85 of the gloss measuring section 83, and calculates the gloss.

Next, the operation control at the time of image formation of the inkjet recording device 1D having the above described configuration is described with reference to the flowcharts of FIGS. 26 to 29.

In the inkjet recording device 1D, when the main power supply is turned on, the control section 10 reads the set temperatures T1, T2, T3, T4 and T5 and the set gloss values (luminance values) C1 and C2, which are set initial values, related to the image forming drum 21, from a ROM (Step S701). The value of C1 is the lower limit of the target gloss value of dot to be formed on a recording medium P, and the value of C2 is the upper limit of the target gloss value of dot to be formed on a recording medium P.

The control section 10 starts rotating the image forming drum 21 with a drum rotation motor 61 (Step S703), and subsequently, starts heating the image forming drum 21 with the heating rollers 71 and 72 (Step S705) and starts irradiation with ultraviolet rays by the UV lamp 52 (Step S707). That is, the heating rollers 71 and 72 and the UV lamp 52 perform preheating of the image forming drum 21 to which a recording medium P has not been supplied.

When the preheating is started, the control section 10 monitors the temperature of the image forming drum 21 with a drum temperature sensor 91 (Step S709). When the temperature of the image forming drum 21 is less than T1, the heating-unit temperature sensor 92 monitors the temperature of the heating roller 71 (Step S711).

When the detected temperature of the heating roller 71 is equal to or more than the set temperature T4, the processing moves on to Step S715. When the detected temperature is less than the set temperature T4, the heating roller 71 is turned on or maintained in the on-state (Step S713), and the processing moves on to Step S715.

At Step S715, it is determined whether the detected temperature of the heating roller 71 is more than the set temperature T5. When the detected temperature is more than the set temperature T5, the heating roller 71 is turned off, and the processing is returned to Step S709.

When detected temperature of the heating roller 71 is equal to or less than the set temperature T5, the processing is directly returned to Step S709.

On the other hand, when it is determined that the temperature of the image forming drum 21 is equal to or more than T1 at step S709, the irradiation with the UV lamp 52 is stopped (Step S719).

After that, the control section 10 continues to monitor the detected temperature of the image forming drum 21 (Step S721). When the image forming drum 21 is equal to or more than the set temperature T1, the processing moves on to Step S725; and when the image forming drum 21 is less than the set temperature T1, the heating roller 72 is turned on (Step S723), and the processing moves on to Step S725.

At Step S725, monitoring of the detected temperature of the image forming drum 21 is continued. When the image forming drum 21 is equal to or less than the set temperature T2, the processing moves on to Step S729; and when the image forming drum 21 is more than the set temperature T2, the heating roller 72 is turned off (Step S727), and the processing moves on to Step S729.

Next, the control section 10 monitors the detected temperature of the heating roller 71 (Step S729). When the heating roller 71 is equal to or more than the set temperature T4, the processing moves on to Step S733; and when the heating roller 71 is less than the set temperature T4, the heating roller 71 is turned on (Step S731), and the processing moves on to Step S733.

At Step S733, the monitoring of the detected temperature of the heating roller 71 is continued. When the heating roller 71 is equal to or less than the set temperature T5, the processing moves on to Step S737; and when the heating roller 71 is more than the set temperature T5, the heating roller 71 is turned off (Step S735), and the processing moves on to Step S737.

At Step S737, the detected temperature of the image forming drum 21 is monitored again. When the detected temperature is more than the set temperature T3, the cooling fan 53 is operated to cool the image forming drum 21 (Step S739), and the processing is returned to Step S721. When the image forming drum 21 is equal to or less than the set temperature T3, the cooling fan 53 is stopped (Step S741), and monitoring is performed to check whether an instruction for printing is inputted from the host computer (Step S743). When an instruction for printing is not inputted, the temperature regulation at Steps S721-S743 described above is repeated.

On the other hand, when an instruction for printing is inputted, the control section 10 reads the thickness and the type of recording medium P inputted by the recording medium thickness input unit 81 and the recording medium type input unit 82 (Step S745), and specifies the set temperatures T4 and T5 with reference to table data (Step S747).

Further, it is determined whether a setting has been made for executing gloss adjustment on ink dots through the gloss adjustment button 68 (Step S749). When a setting has been made for executing gloss adjustment, the set temperatures T1, T2, T3, T4 and T5 and the set gloss values C1 and C2 of dot are changed into new set values (Step S751).

Next, the control section 10 monitors the detected temperature of the image forming drum 21 (Step S753). When the detected temperature is less than the set temperature T1, the heating roller 72 is maintained in the on-state (Step S755), and the processing moves on to Step S763.

When the detected temperature is equal to or more than the set temperature T1, it is further determined whether the detected temperature of the image forming drum 21 is more than the set temperature T2 (Step S757). When the detected temperature is more than the set temperature T2, the heating roller 72 is turned off (Step S759), and the cooling fan 53 is operated (Step S761).

Then, the detected temperature of the heating roller 71 is monitored (Step S763). When the detected temperature of the heating roller 71 is less than the set temperature T4, the heating roller 71 is turned on (Step S765), and the processing is returned to Step S753.

When the detected temperature of the heating roller 71 is equal to or more than the set temperature T4, it is further determined whether the detected temperature is more than the set temperature T5 (Step S767). When the detected temperature of the heating roller 71 is equal to or less than the set temperature T5, the processing is returned to Step S753; and when the detected temperature is more than the set temperature T5, the heating roller 71 is turned off (Step S769), and then, the processing is returned to Step S753.

On the other hand, when the detected temperature of the image forming drum 21 is equal to or less than the set temperature T2 in the determination at Step S757, the cooling fan 53 is turned off (Step S771), and the detected temperature of the heating roller 71 is monitored (Step S773).

When the detected temperature of the heating roller 71 is less than the set temperature T4, the heating roller 71 is turned on (Step S775), and the processing is returned to Step S753.

When the detected temperature of the heating roller 71 is equal to or more than the set temperature T4, it is further determined whether the detected temperature is more than the set temperature T5 (Step S777). When the detected temperature of the heating roller 71 is more than the set temperature T5, the heating roller 71 is turned off (Step S779), and then, the processing is returned to Step S753.

On the other hand, when the detected temperature of the heating roller 71 is equal to or less than the set temperature T5 in the determination at Step S777, the UV lamp 52 is turned on (Step S781), and image formation is started (Step S783). That is, the control section 10 starts to drive the paper feed motor 63, the paper output motor 64 and the delivering motor 62, and starts suction with the adsorption section 212 of the image forming drum 21. As a result, conveyance of a recording medium P from the paper feed unit 3 is started. The recording medium P is supplied to the image forming drum 21 through the delivering drum 22. Then, the control section 10 drives the recording heads 51 in series in accordance with the data of image to be formed to coincide with the arrival of the recording medium P at the recording heads 51 to perform predetermined image formation.

Subsequently, the control section 10 determines whether the image formation is all completed in accordance with the data of image to be formed (Step S785). When the image formation is completed, the processing moves on to Step S809; and when the image formation is not completed, the control section 10 monitors the detected temperature of the image forming drum 21 (Step S787). When the detected temperature is equal to or more than the set temperature T1, the processing moves on to Step S791; and when the detected temperature is less than the set temperature T1, the heating roller 72 is turned on (Step S789), and the processing moves on to Step S791.

At Step S791, monitoring of the detected temperature of the image forming drum 21 is continued. When the detected temperature is equal to or less than the set temperature T2, the processing moves on to Step S795; and when the detected temperature is more than the set temperature T2, the heating roller 72 is turned off (Step S793), and the processing moves on to Step S795.

At Step S795, the control section 10 monitors the detected temperature of the heating roller 71. When the detected temperature is equal to or more than the set temperature T4, the processing moves on to Step S799; and when the detected temperature is less than the set temperature T4, the heating roller 71 is turned on (Step S797), and the processing moves on to Step S799.

At Step S799, monitoring of the detected temperature of the heating roller 71 is continued. When the detected temperature is equal to or less than the set temperature T5, the processing moves on to Step S803; and when the detected temperature is more than the set temperature T5, the heating roller 71 is turned off (Step S801), and the processing moves on to Step S803.

Further, at Step S803, the detected temperature of the image forming drum 21 is monitored. When the detected temperature is more than the set temperature T3, the cooling fan 53 is operated to cool the image forming drum 21 (Step S805); and when the detected temperature is equal to or less than the set temperature T3, the cooling fan 53 is stopped (Step S807).

Subsequently, the control section 10 determines whether the gloss value obtained by the measurement by the gloss measuring section 83 during the image formation is less than the set gloss value C1 (Step S811). When the gloss value is equal to or more than the set gloss value C1 is, the processing moves on to Step S813; and when the gloss value is less than the set gloss value C1, the correction value, which is obtained by subtracting the measured gloss value from the set gloss value C1 and multiplying the resultant by a predetermined coefficient, is added to the above-mentioned set temperatures T1, T2 and T3 of the image forming drum 21 and the set temperatures T4 and T5 of the heating roller 71 (Step S811).

Further, the control section 10 determines whether the gloss value obtained by the measurement by the gloss measuring section 83 during the image formation is more than the set gloss value C2 (Step S815). When the gloss value is equal to or less than the set gloss value C2, the processing is returned to Step S785. When the gloss value is more than the set gloss value C2, the correction value, which is obtained by subtracting the measured gloss value from the set gloss value C2 and multiplying the resultant by a predetermined coefficient (i.e., the correction value is a negative value), is added to the above-mentioned set temperatures T1, T2 and T3 of the image forming drum 21 and the set temperatures T4 and T5 of the heating roller 71 (Step S817), and the processing is returned to Step S785.

[Effects of Fourth Embodiment]

As described above, the inkjet recording device 1D has the effects similar to the inkjet recording device 1A. Further, the gloss measuring section 83 measures the gloss value of ink dot recorded on a recording medium P, and the set temperatures T4 and T5 of the heating roller 71 and the set temperatures T1, T2 and T3 of the image forming drum 21 are changed. Therefore, how the dots spread on a recording medium P can be controlled more effectively, and a recorded image having a constant gloss can be obtained.

[Fifth Embodiment]

Figure 30:
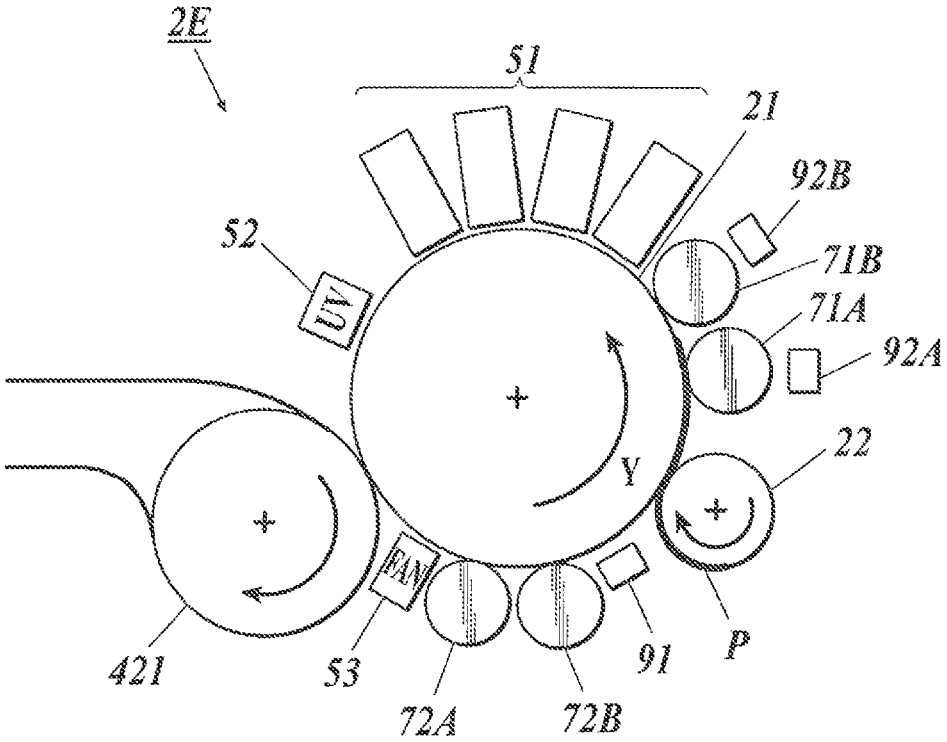
FIG. 30 is a typical view showing the internal configuration of an image forming unit of an inkjet recording device of the fifth embodiment of the present invention.
Figure 31:
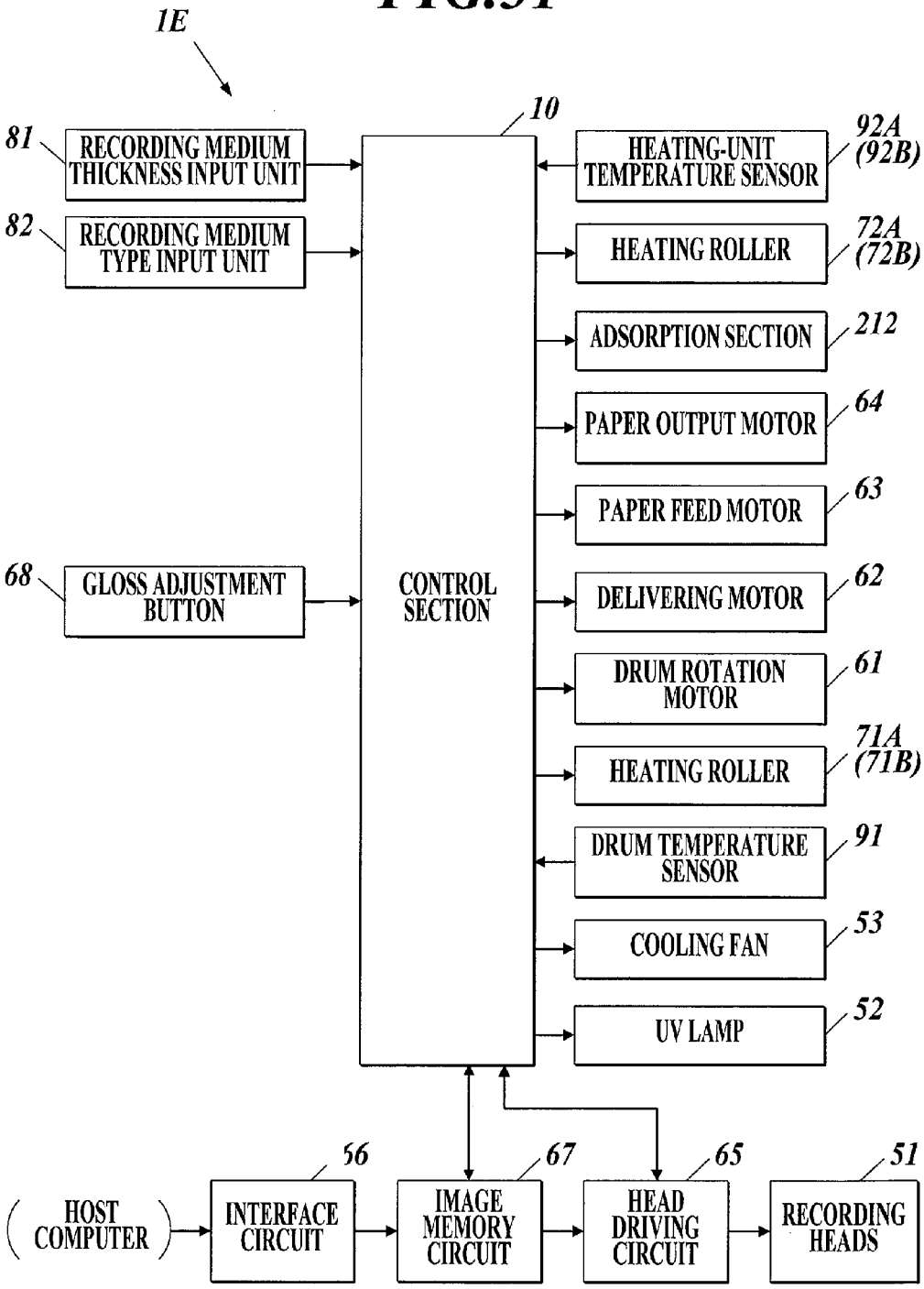
FIG. 31 is a block diagram showing the control system of the fifth embodiment of the present invention.

An inkjet recording device 1E, which is the fifth embodiment of the present invention, is described with reference to the drawings. FIG. 30 is a typical view showing the internal configuration of an image forming unit 2E of an inkjet recording device 1E, and FIG. 31 is a block diagram showing the main control configuration of the inkjet recording device 1E. In the following explanations, only the points where the inkjet recording device 1E is different from the inkjet recording device 1A are described. The same components are indicated by the same reference number/letter, and repetitive explanations are omitted.

The inkjet recording device 1E is different from the inkjet recording device 1A in that a first heating unit includes two adjacent heating rollers 71A and 71B disposed around an image forming drum 21, and in that two heating-unit temperature sensors 92A and 92B as a heating-unit temperature detector are disposed to detect the temperatures of the heating rollers 71A and 71B, respectively, in the inkjet recording device 1E.

Further, the inkjet recording device 1E is different from the inkjet recording device 1A in that a second heating unit includes two adjacent heating rollers 72A and 72B disposed around the image forming drum 21 in the inkjet recording device 1E.

The heating rollers 71A and 71B are disposed at the same position and have the same structure as the heating roller 71. Similarly, the heating rollers 72A and 72B are disposed at the same position and have the same structure as the heating roller 72.

Further, each of the heating-unit temperature sensors 92A and 92B has the same structure as the heating-unit temperature sensor 92.

Figure 32:
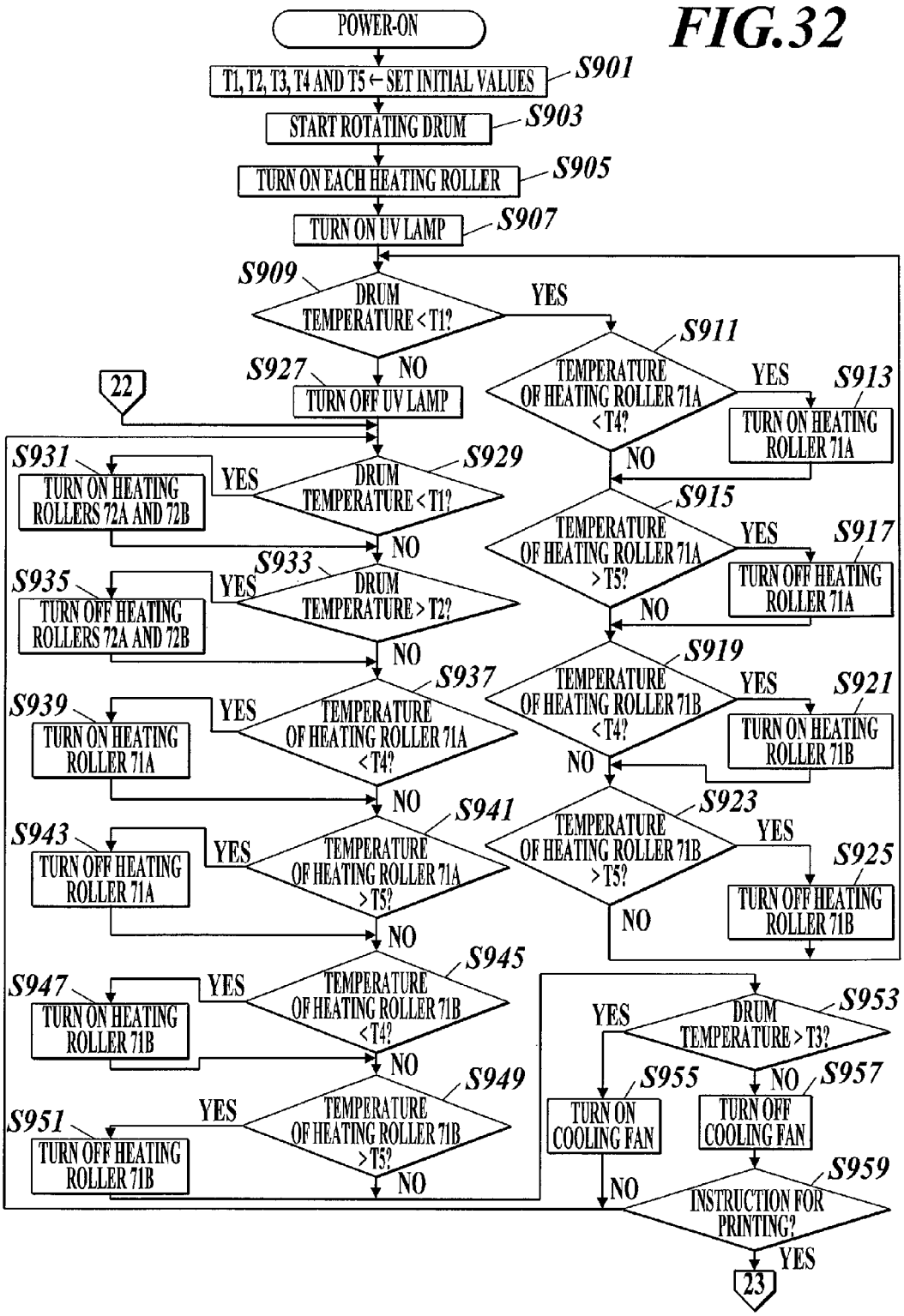
FIG. 32 is a flowchart showing the operation control at the time of image formation of the fifth embodiment of the present invention.
Figure 33:
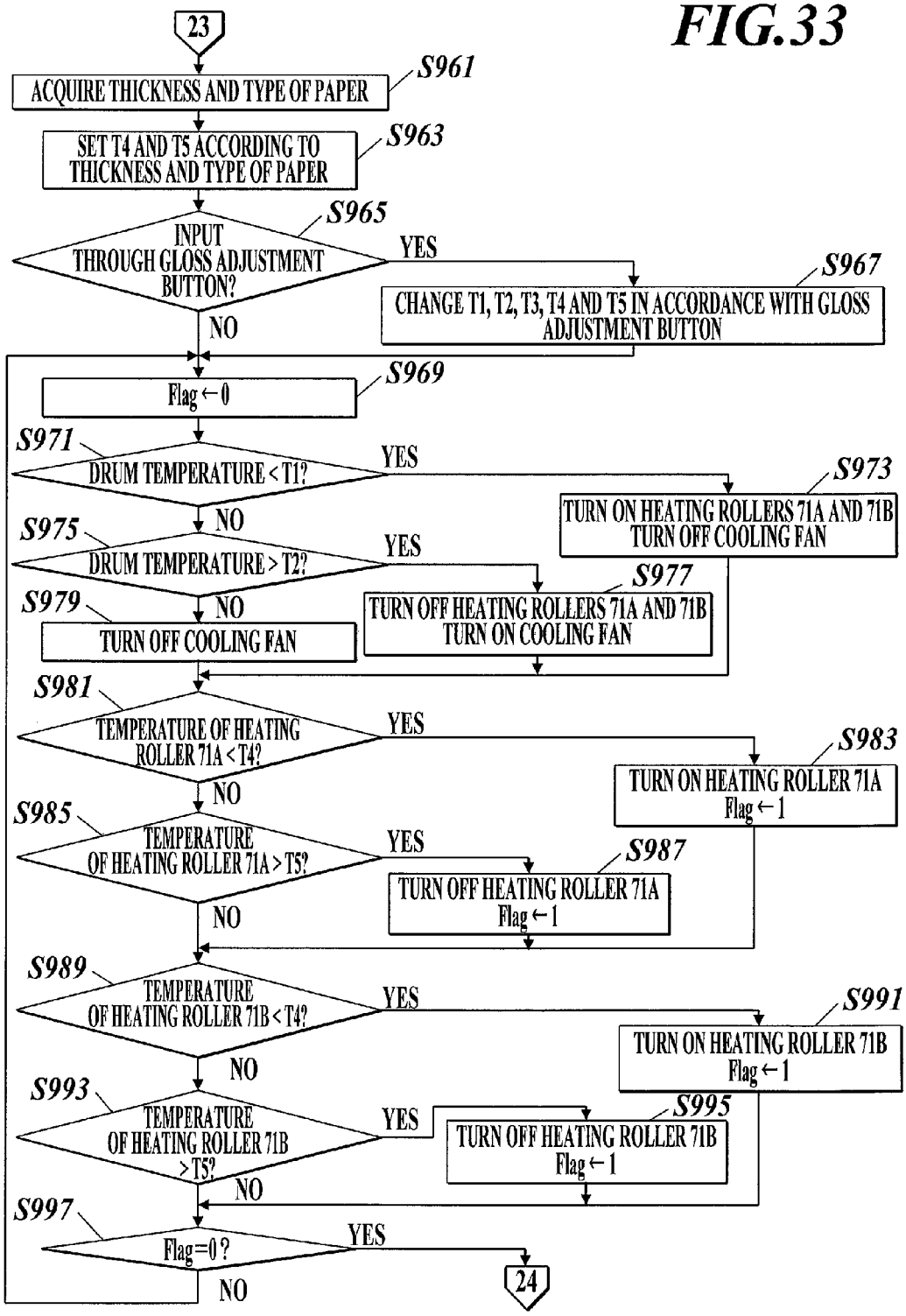
FIG. 33 is the continuation of the flowchart of FIG. 32.
Figure 34:
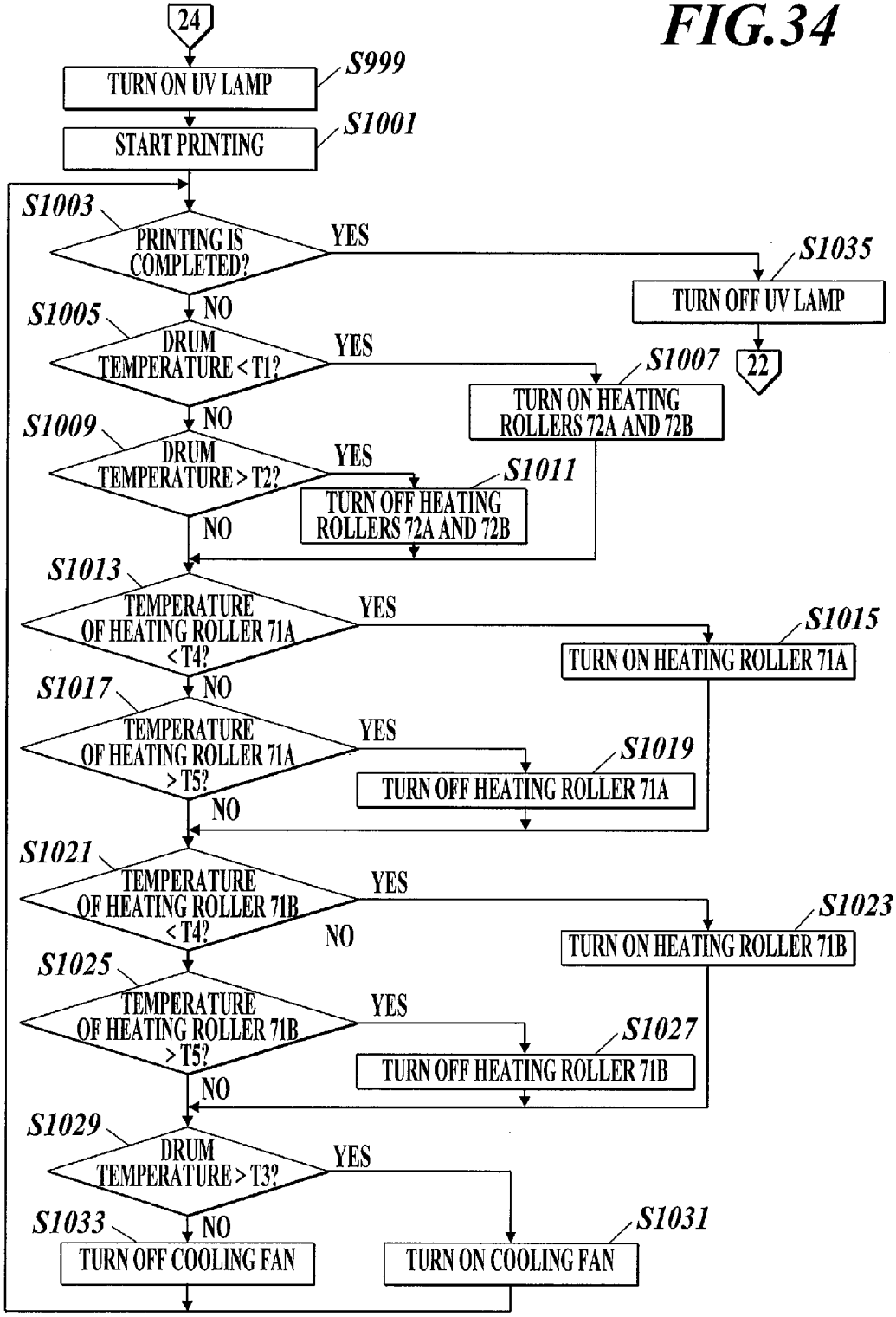
FIG. 34 is the continuation of the flowchart of FIG. 33.

Next, the operation control at the time of image formation of the inkjet recording device 1E having the above described configuration is described with reference to the flowcharts of FIGS. 32 to 34.

In the inkjet recording device 1E, when the main power supply is turned on, the control section 10 reads the set temperatures T1, T2, T3, T4 and T5, which are set initial values, related to the image forming drum 21, from a ROM (Step S901).

The control section 10 starts rotating the image forming drum 21 with a drum rotation motor 61 (Step S903), and subsequently, starts heating the image forming drum 21 with the heating rollers 71A, 71B, 72A and 72B (Step S905) and starts irradiation with ultraviolet rays by a UV lamp 52 (Step S907). That is, the heating rollers 71A, 71B, 72A and 72B and the UV lamp 52 perform preheating of the image forming drum 21 to which a recording medium P has not been supplied.

When the preheating is started, the control section 10 monitors the temperature of the image forming drum 21 with a drum temperature sensor 91 (Step S909). When the temperature of the image forming drum 21 is less than T1, the heating-unit temperature sensor 92A monitors the temperature of the heating roller 71A (Step S911).

When the detected temperature of the heating roller 71A is equal to or more than the set temperature T4, the processing moves on to Step S915. When the detected temperature is less than the set temperature T4, the heating roller 71A is turned on or maintained in the on-state (Step S913), and the processing moves on to Step S915.

At Step S915, it is determined whether the detected temperature of the heating roller 71A is more than the set temperature T5. When the detected temperature is more than the set temperature T5, the heating roller 71A is turned off, and the processing moves on to Step S919.

When detected temperature of the heating roller 71A is equal to or less than the set temperature T5, the processing directly moves on to Step S919.

At Step S919, the control section 10 monitors the temperature of the heating roller 71B with the heating-unit temperature sensor 92B.

When the detected temperature of the heating roller 71B is equal to or more than the set temperature T4, the processing moves on to Step S923; and when the detected temperature is less than the set temperature T4, the heating roller 71B turned on or maintained in the on-state (Step S921), and the processing moves on to Step S923.

At Step S923, it is determined whether the detected temperature of the heating roller 71B is more than the set temperature T5. When the detected temperature is more than the set temperature T5, the heating roller 71B is turned off, and the processing is returned to Step S909.

When detected temperature of the heating roller 71B is equal to or less than the set temperature T5, the processing is directly returned to Step S909.

On the other hand, when it is determined that the temperature of the image forming drum 21 is equal to or more than T1 at step S909, the irradiation with the UV lamp 52 is stopped (Step S927).

After that, the control section 10 continues to monitor the detected temperature of the image forming drum 21 (Step S929). When the image forming drum 21 is equal to or more than the set temperature T1, the processing moves on to Step S933; and when the image forming drum 21 is less than the set temperature T1, the heating rollers 72A and 72B are turned on (Step S931), and the processing moves on to Step S933.

At Step S933, monitoring of the detected temperature of the image forming drum 21 is continued. When the image forming drum 21 is equal to or less than the set temperature T2, the processing moves on to Step S937; and when the image forming drum 21 is more than the set temperature T2, the heating rollers 72A and 72B are turned off (Step S935), and the processing moves on to Step S937.

Next, the control section 10 monitors the detected temperature of the heating roller 71A (Step S937). When the heating roller 71A is equal to or more than the set temperature T4, the processing moves on to Step S941; and when the heating roller 71A is less than the set temperature T4, the heating roller 71A is turned on (Step S939), and the processing moves on to Step S941.

At Step S941, the monitoring of the detected temperature of the heating roller 71A is continued. When the heating roller 71A is equal to or less than the set temperature T5, the processing moves on to Step S945; and when the heating roller 71A is more than the set temperature T5, the heating roller 71A is turned off (Step S943), and the processing moves on to Step S945.

Next, the control section 10 monitors the detected temperature of the heating roller 71B (Step S945). When the heating roller 71B is equal to or more than the set temperature T4, the processing moves on to Step S949; and when the heating roller 71B is less than the set temperature T4, the heating roller 71B is turned on (Step S947), and the processing moves on to Step S949.

At Step S949, the monitoring of the detected temperature of the heating roller 71B is continued. When the heating roller 71B is equal to or less than the set temperature T5, the processing moves on to Step S953; and when the heating roller 71B is more than the set temperature T5, the heating roller 71B is turned off (Step S951), and the processing moves on to Step S953.

At Step S953, the detected temperature of the image forming drum 21 is monitored again. When the detected temperature is more than the set temperature T3, the cooling fan 53 is operated to cool the image forming drum 21 (Step S955), and the processing is returned to Step S929. When the image forming drum 21 is equal to or less than the set temperature T3, the cooling fan 53 is stopped (Step S957), and monitoring is performed to check whether an instruction for printing is inputted from the host computer (Step S959). When an instruction for printing is not inputted, the temperature regulation at Steps S929-S959 described above is repeated.

On the other hand, when an instruction for printing is inputted, the control section 10 reads the thickness and the type of recording medium P inputted by the recording medium thickness input unit 81 and the recording medium type input unit 82 (Step S961), and specifies the set temperatures T4 and T5 with reference to table data (Step S963).

Further, it is determined whether a setting has been made for executing gloss adjustment on ink dots through the gloss adjustment button 68 (Step S965). When a setting has been made for executing gloss adjustment, the set temperatures T1, T2, T3, T4 and T5 are changed into new set values (Step S967).

Next, the control section 10 sets a flag to 0 (Step S969), and monitors the detected temperature of the image forming drum 21 (Step S971). When the detected temperature is less than the set temperature T1, the heating rollers 72A and 72B are maintained in the on-state, the cooling fan 53 is stopped, the flag is set to 1 (Step S973), and the processing moves on to Step S981.

When the detected temperature is equal to or more than the set temperature T1, it is further determined whether the detected temperature of the image forming drum 21 is more than the set temperature T2 (Step S975). When the detected temperature is more than the set temperature T2, the heating rollers 72A and 72B are turned off, the flag is set to 1, and the cooling fan 53 is operated (Step S977).

When the detected temperature of the image forming drum 21 is equal to or less than the set temperature T2, the cooling fan 53 is stopped (Step S979).

Then, the detected temperature of the heating roller 71A is monitored (Step S981). When the detected temperature of the heating roller 71A is less than the set temperature T4, the heating roller 71A is turned on, the flag is set to 1 (Step S983), and the processing moves on to Step S989.

When the detected temperature of the heating roller 71A is equal to or more than the set temperature T4, it is further determined whether the detected temperature is more than the set temperature T5 (Step S985). When the detected temperature of the heating roller 71A is equal to or less than the set temperature T5, the processing moves on to Step S989; and when the detected temperature is more than the set temperature T5, the heating roller 71A is turned off, the flag is set to 1 (Step S987), and then, the processing moves on to Step S989.

At Step S989, the detected temperature of the heating roller 71B is monitored. When the detected temperature of the heating roller 71B is less than the set temperature T4, the heating roller 71B is turned on, the flag is set to 1 (Step S991), and the processing moves on to Step S997.

When the detected temperature of the heating roller 71B is equal to or more than the set temperature T4, it is further determined whether the detected temperature is more than the set temperature T5 (Step S993). When the detected temperature of the heating roller 71B is equal to or less than the set temperature T5, the processing moves on to Step S997; and when the detected temperature is more than the set temperature T5, the heating roller 71B is turned off, the flag is set to 1 (Step S995), and then, the processing moves on to Step S997.

At Step S997, the control section 10 determines whether the current flag is 0. When the current flag is not 0, the processing is returned to Step S969. When the flag is 0, the UV lamp 52 is turned on (Step S999), and image formation is started (Step S1001). That is, the control section 10 starts to drive the paper feed motor 63, the paper output motor 64 and the delivering motor 62, and starts suction with the adsorption section 212 of the image forming drum 21. As a result, conveyance of a recording medium P from the paper feed unit 3 is started. The recording medium P is supplied to the image forming drum 21 through the delivering drum 22. Then, the control section 10 drives the recording heads 51 in series in accordance with the data of image to be formed to coincide with the arrival of the recording medium P at the recording heads 51 to perform predetermined image formation.

Subsequently, the control section 10 determines whether the image formation is all completed in accordance with the data of image to be formed (Step S1003). When the image formation is not completed, the control section 10 monitors the detected temperature of the image forming drum 21 (Step S1005). When the detected temperature is equal to or more than the set temperature T1, the processing moves on to Step S1009; and when the detected temperature is less than the set temperature T1, the heating rollers 72A and 72B are turned on (Step S1007), and the processing moves on to Step S1013.

At Step S1009, monitoring of the detected temperature of the image forming drum 21 is continued. When the detected temperature is equal to or less than the set temperature T2, the processing moves on to Step S1013; and when the detected temperature is more than the set temperature T2, the heating rollers 72A and 72B are turned off (Step S1011), and the processing moves on to Step S1013.

At Step S1013, the control section 10 monitors the detected temperature of the heating roller 71A. When the detected temperature is equal to or more than the set temperature T4, the processing moves on to Step S1017; and when the detected temperature is less than the set temperature T4, the heating roller 71A is turned on (Step S1015), and the processing moves on to Step S1021.

At Step S1017, monitoring of the detected temperature of the heating roller 71A is continued. When the detected temperature is equal to or less than the set temperature T5, the processing moves on to Step S1021; and when the detected temperature is more than the set temperature T5, the heating roller 71A is turned off (Step S1019), and the processing moves on to Step S1021.

At Step S1021, the control section 10 monitors the detected temperature of the heating roller 71B. When the detected temperature is equal to or more than the set temperature T4, the processing moves on to Step S1025; and when the detected temperature is less than the set temperature T4, the heating roller 71B is turned on (Step S1023), and the processing moves on to Step S1029.

At Step S1025, monitoring of the detected temperature of the heating roller 71B is continued. When the detected temperature is equal to or less than the set temperature T5, the processing moves on to Step S1029; and when the detected temperature is more than the set temperature T5, the heating roller 71B is turned off (Step S1027), and the processing moves on to Step S1029.

Further, at Step S1029, the detected temperature of the image forming drum 21 is monitored. When the detected temperature is more than the set temperature T3, the cooling fan 53 is operated to cool the image forming drum 21 (Step S1031); and when the detected temperature is equal to or less than the set temperature T3, the cooling fan 53 is stopped (Step S1033).

Then, the processing is returned to Step S1003 again, and it is determined whether the image formation has been completed.

When it is determined that the image formation has been completed in the determination at Step S1003, the UV lamp 53 is turned off (Step S1035), and then, the processing is returned to Step S929. Then, preheating control is performed on the basis of the set temperatures T1, T2, T3, T4 and T5 until the next instruction for printing is inputted.

[Effects of Fifth Embodiment]

As described above, the inkjet recording device 1E has the effects similar to the inkjet recording device 1A. Further, the first heating unit includes the two heating rollers 71A and 71B and heats a recording medium P while the temperature of each of the heating rollers 71A and 71B is maintained within a predetermined range of heating-unit set temperatures T4 and T5. Therefore, for recording media having various thicknesses and types, the temperature of a recording medium P can be raised to an intended temperature in a short period of time.

Further, since the second heating unit also includes the two heating rollers 72A and 72B, the temperature of the image forming drum 21 can be raised to an intended temperature in a short period of time at the time of start-up. Further, the image forming drum 21 can be maintained at an intended temperature during image recording even when the environmental temperature is low.

[Sixth Embodiment]

Figure 35:
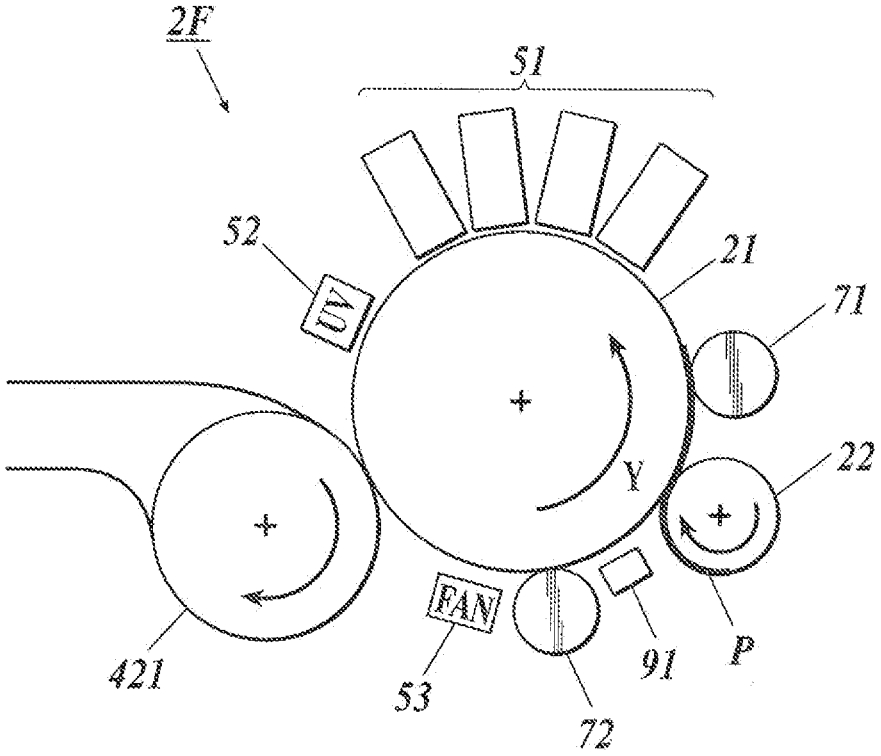
FIG. 35 is a typical view showing the internal configuration of an image forming unit of an inkjet recording device of the sixth embodiment of the present invention.
Figure 36:
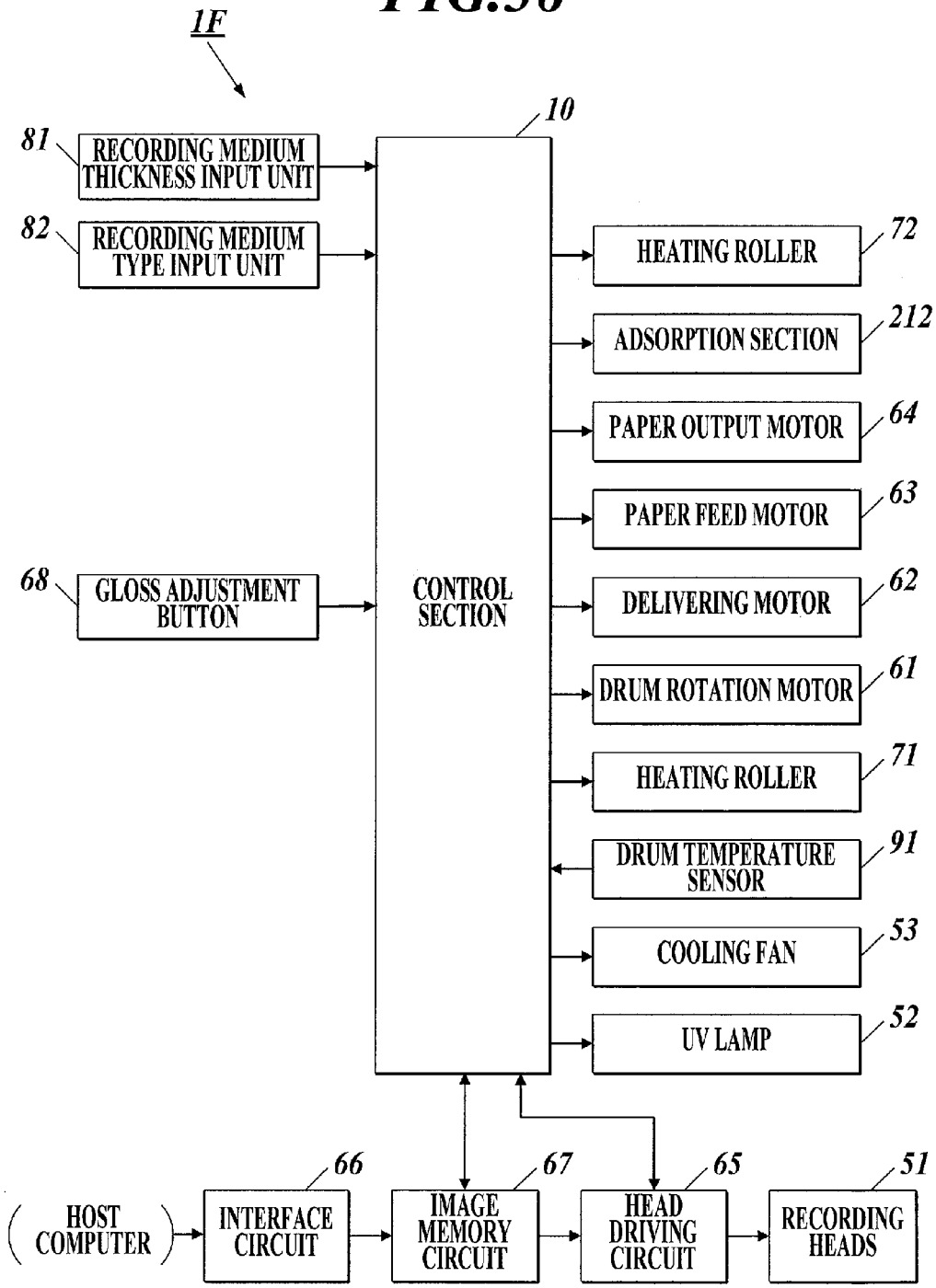
FIG. 36 is a block diagram showing the control system of the sixth embodiment of the present invention.

An inkjet recording device 1F, which is the sixth embodiment of the present invention, is described with reference to the drawings. FIG. 35 is a typical view showing the internal configuration of an image forming unit 2F of an inkjet recording device 1F, and FIG. 36 is a block diagram showing the main control configuration of the inkjet recording device 1F. In the following explanations, only the points where the inkjet recording device 1F is different from the inkjet recording device 1A are described. The same components are indicated by the same reference number/letter, and repetitive explanations are omitted.

The inkjet recording device 1F is different from the inkjet recording device 1A in that the inkjet recording device 1F is not provided with a heating-unit temperature sensor 92 which detects the temperature of a heating roller 71 around an image forming drum 21, and in that the inkjet recording device 1F determines a current value of the current to be applied to a heat source 713 of a heating roller 71 according to the thickness of a recording medium P inputted from a recording medium thickness input unit 81 and the type of recording medium P inputted from a recording medium thickness input unit 82, to control a heating state.

In addition, an electrical voltage or an electrical power may be determined for the heat source 713 of the heating roller 71, instead of an electrical current, according to the thickness and type of recording medium; and the inkjet recording device 1F may perform control so that the determined electrical voltage or electrical power is a target value.

Further, a control section 10 performs heat control in accordance with the thickness and the type of recording medium P. Specifically, the control section 10 stores table data where the current value to be applied to the heat source 713 of the heating roller 71 is determined according to the two parameters of the type and the thickness of a recording medium P, and performs processing of determining the current value to be applied to the heat source 713 in response to the input of these.

Since the amount of heat increases as the current value to be applied to the heat source 713 increases, the current value to be applied is determined according to the thermal conductivity of the heating roller 71, a time of contact with a recording medium P and the like.

In the case where an electrical voltage or an electrical power is supplied to the heat source 713, the processing is performed in the same manner as in the case of electrical current.

When a gloss adjustment of ink dots is executed through a gloss adjustment button 68, the control section 10 changes the set temperatures T1, T2 and T3 and the current value to be applied to the heat source 713 to new set values. For example, a correction value to be added or subtracted to/from each of the set temperatures T1, T2 and T3 and the current value to be applied to the heat source 713 is set in advance in accordance with the amount of increase or decrease in a set value for a gloss adjustment. The set values are changed to new set values using the correction value in accordance with the amount of increase or decrease when an input is made through the gloss adjustment button 68.

Next, the operation control at the time of image formation of the inkjet recording device 1F having the above described configuration is described with reference to the flowcharts of FIGS. 8 to 10 for the inkjet recording device 1A. Only the differences in processing between the inkjet recording devices 1A and 1F are described.

First, an image forming unit 2F of the inkjet recording device 1F is not provided with the heating-unit temperature sensor 92 of the image forming unit 2A. Therefore, the control section 10 reads the set temperatures T1, T2 and T3 and the current value to be applied to the heat source 713, which are set initial values, related to the image forming drum 21, from a ROM at step S101 in the processing of the flowcharts shown in FIGS. 8 to 10.

Further, the processing of Steps S111-S117, Steps S129-S135, Steps S163-S169, Step S173-S179 and Steps S195-S201 are omitted.

Further, at Step S147, the current value to be applied to the heat source 713 is set again according to the inputted thickness and the type of recording medium P.

Further, at Step S151, the set temperatures T1, T2 and T3 and the current value to be applied to the heat source 713 are changed to new set values when a setting has been made for executing gloss adjustment.

[Effects of Sixth Embodiment]

As described above, the inkjet recording device 1F having the above-described configuration has the effects similar to the inkjet recording device 1A.

Further, the current value to be applied to the heat source 713 of the heating roller 71 is determined according to the thickness of a recording medium P inputted from the recording medium thickness input unit 81 and the type of recording medium P inputted from the recording medium type input unit 82, and the current value to be applied to the heat source 713 is adjusted through the adjustment by the gloss adjustment button 68. Therefore, although the image forming unit 2F of the inkjet recording device 1F is not provided with a heating-unit temperature sensor 92 and thus the control of the amount of heat generation of the heat source 713 on the basis of the detected temperature of the heating roller 71 is not performed, stable heating can be performed at a properly-determined current value.

[Seventh Embodiment]

Figure 37:
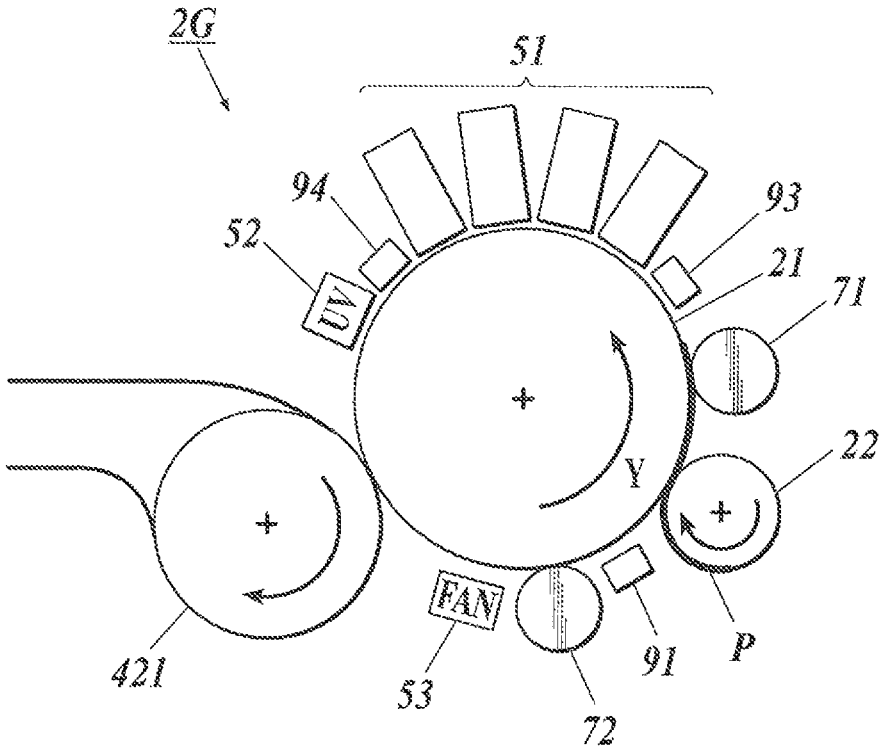
FIG. 37 is a typical view showing the internal configuration of an image forming unit of an inkjet recording device of the seventh embodiment of the present invention.
Figure 38:
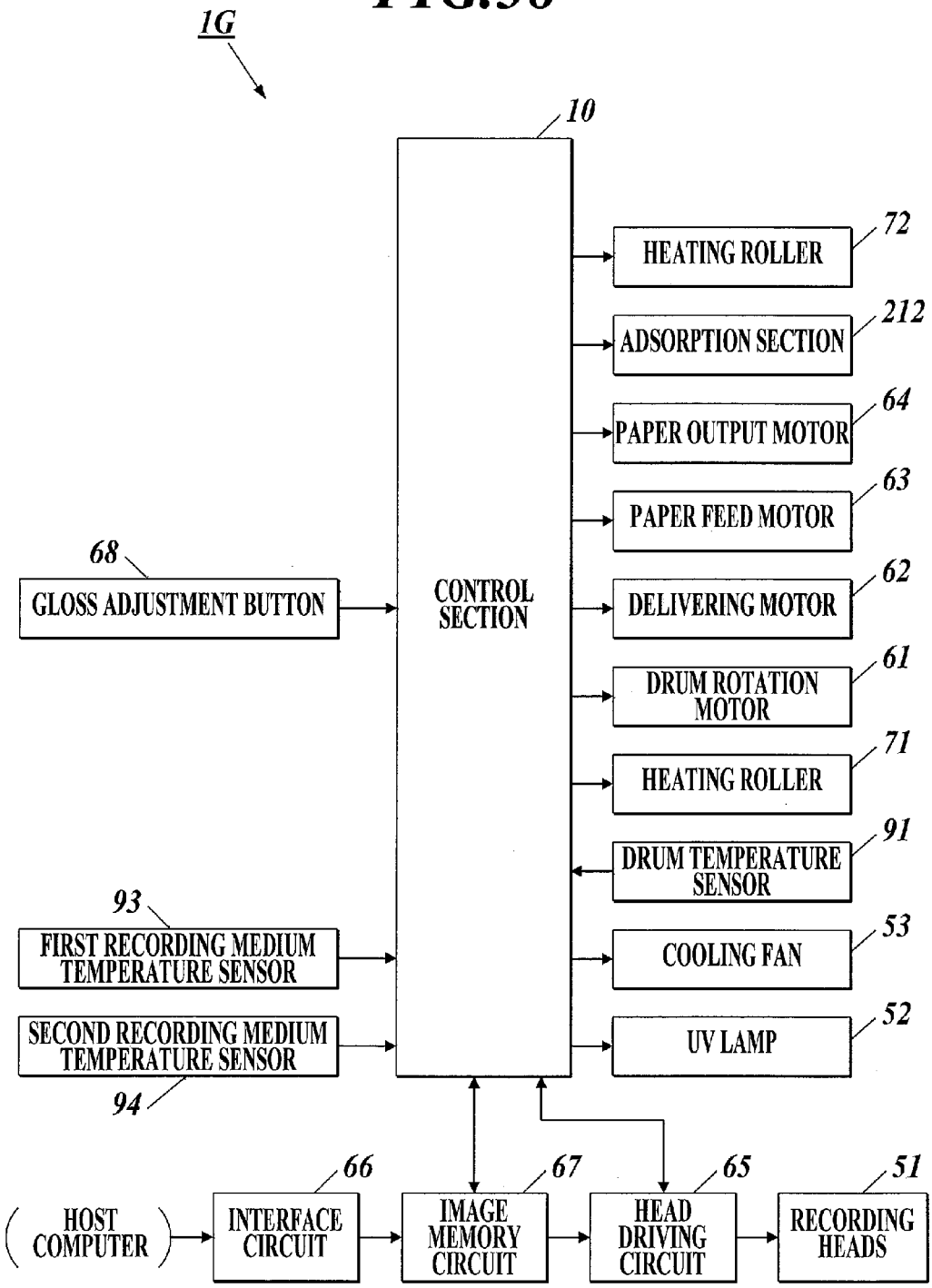
FIG. 38 is a block diagram showing the control system of the seventh embodiment of the present invention.

An inkjet recording device 1G, which is the seventh embodiment of the present invention, is described with reference to the drawings. FIG. 37 is a typical view showing the internal configuration of an image forming unit 2G of an inkjet recording device 1G, and FIG. 38 is a block diagram showing the main control configuration of the inkjet recording device 1G. In the following explanations, only the points where the inkjet recording device 1G is different from the inkjet recording device 1B are described. The same components are indicated by the same reference number/letter, and repetitive explanations are omitted.

The inkjet recording device 1G is not provided with a heating-unit temperature sensor 92 which detects the temperature of the heating roller 71 around an image forming drum 21.

The control section 10 adds a correction value to the current value to be applied to the heat source 713 of the heating roller 71. The correction value is obtained by subtracting the detected temperature, which is obtained by a first recording medium temperature sensor 93, from the set temperature T6 which is the lower limit of the first recording medium temperature sensor 93, and by multiplying the resultant by a predetermined coefficient. Further, the control section 10 subtracts a correction value from the current value to be applied to the heat source 713 of the heating roller 71. The correction value is obtained by subtracting the set temperature T7, which is the upper limit of the first recording medium temperature sensor 93, from the detected temperature obtained by the first recording medium temperature sensor 93, and by multiplying the resultant by a predetermined coefficient.

Further, the control section 10 adds a correction value to the current value to be applied to the heat source 713 of the heating roller 71 and to the set temperatures T1-T3. The correction value is obtained by subtracting the detected temperature, which is obtained by the second recording medium temperature sensor 94, from the set temperature T6 which is the lower limit of the second recording medium temperature sensor 94, and by multiplying the resultant by a predetermined coefficient. Further, the control section 10 subtracts a correction value from the current value to be applied to the heat source 713 of the heating roller 71 and from the set temperatures T1-T3. The correction value is obtained by subtracting the set temperature T7, which is the upper limit of the second recording medium temperature sensor 93, from the detected temperature obtained by the first recording medium temperature sensor 93, and by multiplying the resultant by a predetermined coefficient.

The control of the heat source 713 of the heating roller 71 may be performed on the basis of an electrical voltage or an electrical power instead of an electrical current, and the correction may be performed for them.

Further, the control section 10 changes the set temperatures T1, T2, T3, T6 and T7 and the current value to be applied to the heat source 713 to new set values when a gloss adjustment of ink dots is executed through a gloss adjustment button 68.

Next, the operation control at the time of image formation of the inkjet recording device 1G having the above described configuration is described with reference to the flowcharts of FIGS. 13 to 16 for the inkjet recording device 1B. Only the differences in processing between the inkjet recording devices 1G and 1B are described.

First, the image forming unit 2G of the inkjet recording device 1G is not provided with the heating-unit temperature sensor 92 of the image forming unit 2B. Therefore, the control section 10 reads the set temperatures T1, T2, T3, T6 and T7 and the current value to be applied to the heat source 713, which are set initial values, related to the image forming drum 21, from the ROM at step S301 in the processing of the flowcharts shown in FIGS. 13 to 16.

Further, the processing of Steps S311-S317, Steps S329-S335, Steps S361-S367, Steps S371-S377 and Step S393-S397 are omitted.

Further, at Step S349, the set temperatures T1, T2, T3, T6 and T7 and the current value to be applied to the heat source 713 are changed to new set values when a setting has been made for executing gloss adjustment.

Further, at Step S411, the correction value for the current value to be applied to the heat source 713 is obtained and the correction value is added to the current value when the detected temperature obtained by the first recording medium temperature sensor 93 is less than the set temperature T6. Further, at Step S413, the correction value for the current value to be applied to the heat source 713 is obtained and the correction value is subtracted from the current value when the detected temperature obtained by the first recording medium temperature sensor 93 is more than the set temperature T7.

Similarly, at Step S419, the correction value for the current value to be applied to the heat source 713 and the correction value for each of the set temperatures T1, T2, T3, T6 and T7 are individually obtained, and the correction values are added to the current value and the set temperatures, respectively, when the detected temperature obtained by the second recording medium temperature sensor 94 is less than the set temperature T6. Further, at Step S423, the correction value for the current value to be applied to the heat source 713 and the correction value for each of the set temperatures T1, T2, T3, T6 and T7 are individually obtained, and the correction values are subtracted from the current value and the set temperatures, respectively, when the detected temperature obtained by the second recording medium temperature sensor 94 is more than the set temperature T7.

[Effects of Seventh Embodiment]

As described above, the inkjet recording device 1G having the above-described configuration has the effects similar to the inkjet recording device 1B.

Further, the current value to be applied to the heat source 713 of the heating roller 71 is determined on the basis of the detected temperatures of recording medium before and after recording. Therefore, although the image forming unit 2G of the inkjet recording device 1G is not provided with a heating-unit temperature sensor 92 and thus the control of the amount of heat generation of the heat source 713 on the basis of the detected temperature of the heating roller 71 is not performed as in the case of the above-mentioned inkjet recording device 1F, stable heating can be performed at a properly-determined current value.

[Eighth Embodiment]

Figure 39:
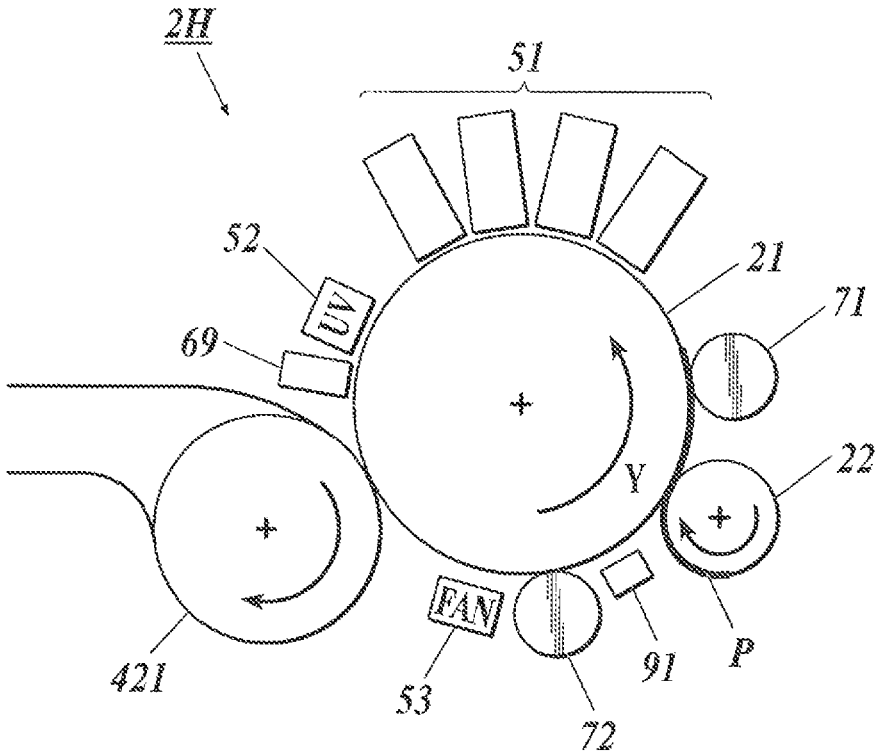
FIG. 39 is a typical view showing the internal configuration of an image forming unit of an inkjet recording device of the eighth embodiment of the present invention.
Figure 40:
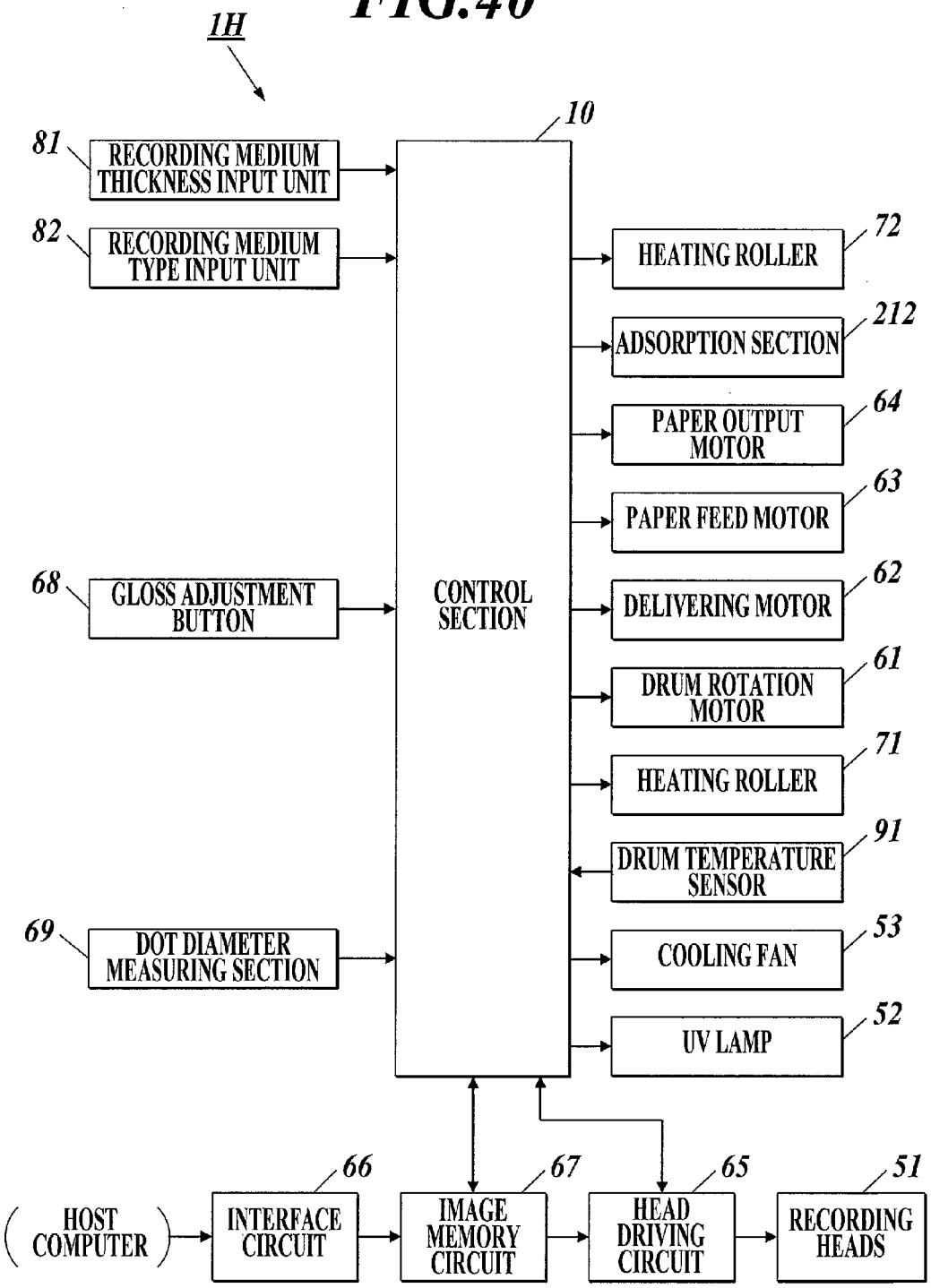
FIG. 40 is a block diagram showing the control system of the eighth embodiment of the present invention.

An inkjet recording device 1H, which is the eighth embodiment of the present invention, is described with reference to the drawings. FIG. 39 is a typical view showing the internal configuration of an image forming unit 2H of an inkjet recording device 1H, and FIG. 40 is a block diagram showing the main control configuration of the inkjet recording device 1H. In the following explanations, only the points where the inkjet recording device 1H is different from the inkjet recording device 1C are described. The same components are indicated by the same reference number/letter, and repetitive explanations are omitted.

The inkjet recording device 1H is not provided with a heating-unit temperature sensor 92 which detects the temperature of a heating roller 71 around an image forming drum 21.

The control section 10 adds a correction value to the current value to be applied to the heat source 713 of the heating roller 71 and to the set temperatures T1-T3. The correction value is obtained by subtracting the value of a dot diameter, which is detected by a dot diameter measuring section 69, from the set value d1 which is the lower limit of the dot diameter, and by multiplying the resultant by a predetermined coefficient. Further, the control section 10 subtracts a correction value from the current value to be applied to the heat source 713 of the heating roller 71 and from the set temperatures T1-T3. The correction value is obtained by subtracting the set value d2, which is the upper limit of the dot diameter, from the value of dot diameter detected by the dot diameter measuring section 69, and by multiplying the resultant by a predetermined coefficient.

The control of the heat source 713 of the heating roller 71 may be performed on the basis of an electrical voltage or an electrical power instead of an electrical current, and the correction may be performed for them.

Further, the control section 10 performs the processing of determining the current value to be applied to the heat source 713 of the heating roller 71 according to the thickness and the type of recording medium P.

Further, the control section 10 changes the set temperatures T1, T2 and T3 and the upper and lower limits d1 and d2 of the above-mentioned dot diameter to new set values when a gloss adjustment of ink dots is executed through a gloss adjustment button 68.

Next, the operation control at the time of image formation of the inkjet recording device 1H having the above described configuration is described with reference to the flowcharts of FIGS. 19 to 22 for the inkjet recording device 1C. Only the differences in processing between the inkjet recording devices 1H and 1C are described.

First, the image forming unit 2H of the inkjet recording device 1H is not provided with the heating-unit temperature sensor 92 of the image forming unit 2C. Therefore, the control section 10 reads the set temperatures T1, T2 and T3; the lower limit d1 and the upper limit d2 of a dot diameter; and the current value to be applied to the heat source 713, which are set initial values, related to the image forming drum 21, from the ROM at step S501 in the processing of the flowcharts shown in FIGS. 19 to 22.

Further, the processing of Steps S511-S517, Steps S529-S535, Steps S563-S569, Steps S573-S579 and Step S595-S601 are omitted.

Further, at Step S547, the current value to be applied to the heat source 713 is set again according to the inputted thickness and the type of recording medium P.

Further, at Step S551, the set temperatures T1, T2 and T3; the lower limit d1 and the upper limit d2 of a dot diameter; and the current value to be applied to the heat source 713 are changed to new set values when a setting has been made for executing gloss adjustment.

Further, at Step S613, the correction value of the current value to be applied to the heat source 713 and the correction value of the set temperatures T1, T2 and T3 are individually obtained and the correction values are added to the current value and the set temperatures, respectively, when the dot diameter detected by the dot diameter measuring section 69 is less than the lower limit d1 of the dot diameter. Further, at Step S617, the correction value of the current value to be applied to the heat source 713 and the correction value of the set temperatures T1, T2 and T3 are individually obtained and the correction values are subtracted from the current value and the set temperatures, respectively, when the dot diameter detected by the dot diameter measuring section 69 is more than the upper limit d2 of the dot diameter.

[Effects of Eighth Embodiment]

As described above, the inkjet recording device 1H having the above-described configuration has the effects similar to the inkjet recording device 1C.

Further, the current value to be applied to the heat source 713 of the heating roller 71 is determined according to the thickness and type of recording medium, the adjustment amount of gloss, and a detected dot diameter. Therefore, although the image forming unit 2H of the inkjet recording device 1H is not provided with a heating-unit temperature sensor 92 and thus the control of the amount of heat generation of the heat source 713 on the basis of the detected temperature of the heating roller 71 is not performed as in the case of the above-mentioned inkjet recording device 1F, stable heating can be performed at a properly-determined current value.

[Ninth Embodiment]

Figure 41:
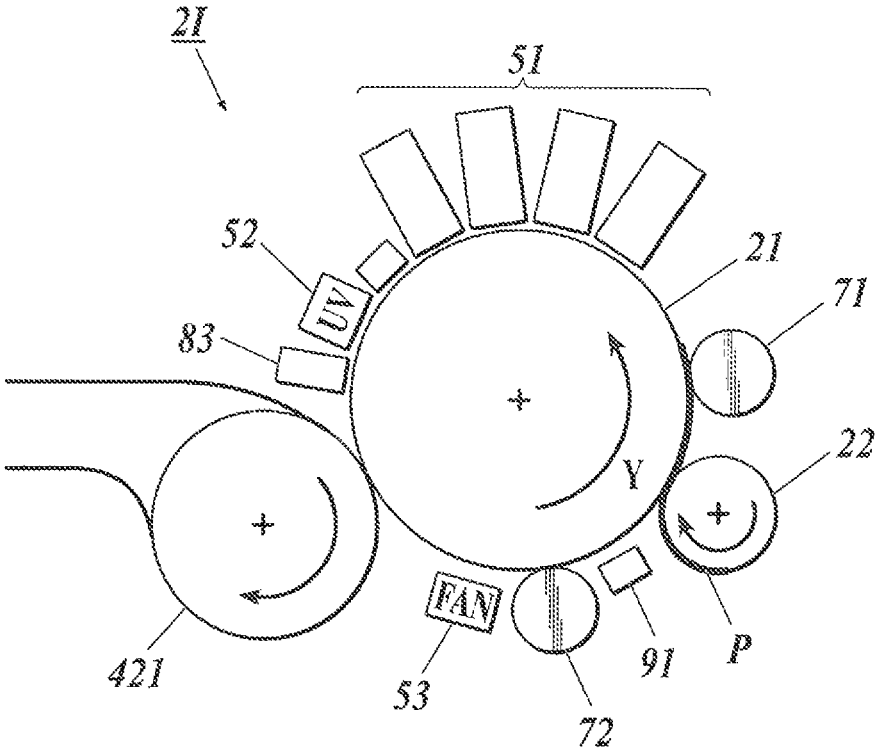
FIG. 41 is a typical view showing the internal configuration of an image forming unit of an inkjet recording device of the ninth embodiment of the present invention.
Figure 42:
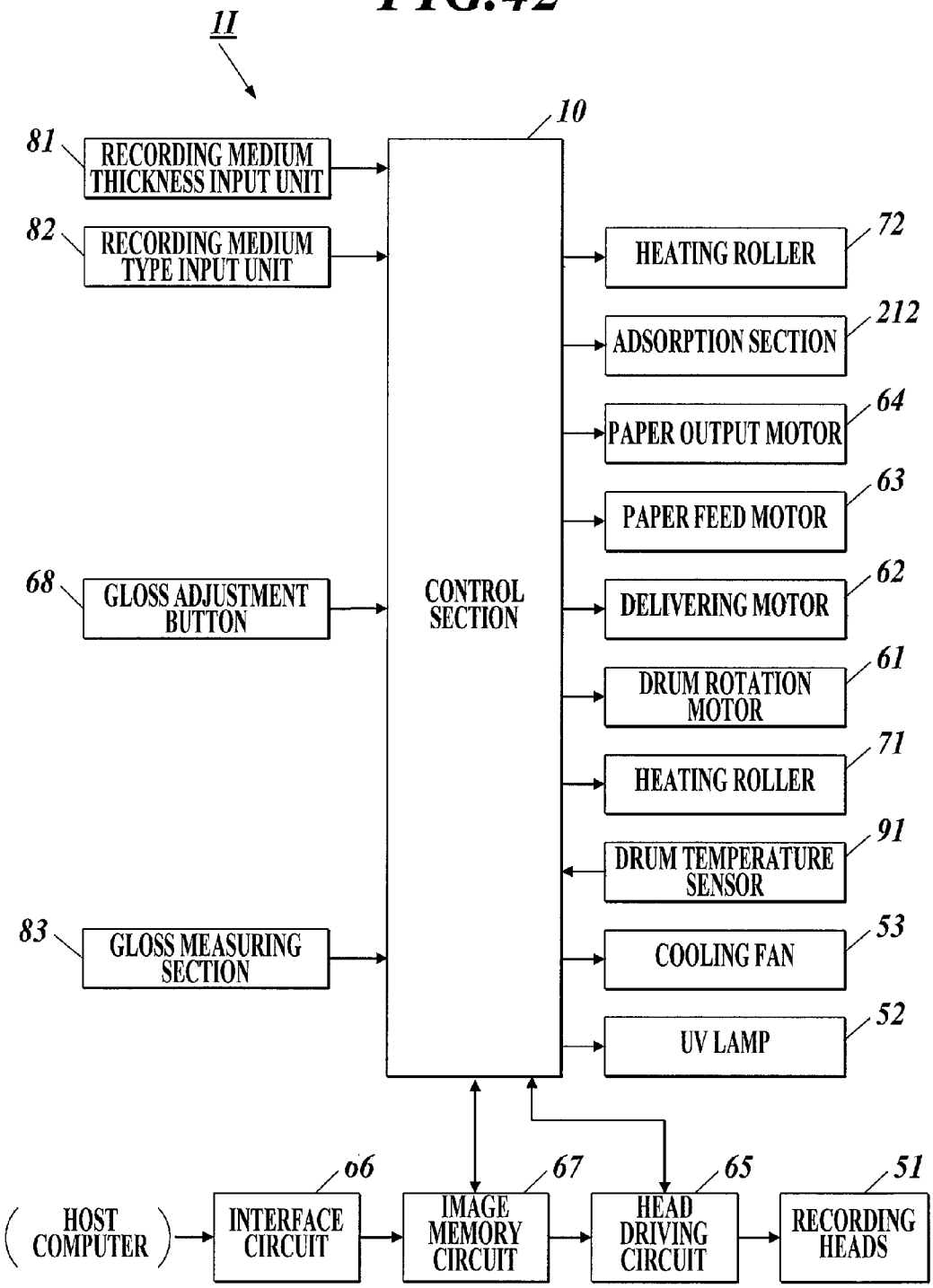
FIG. 42 is a block diagram showing the control system of the ninth embodiment of the present invention.

An inkjet recording device 1I, which is the ninth embodiment of the present invention, is described with reference to the drawings. FIG. 41 is a typical view showing the internal configuration of an image forming unit 2I of an inkjet recording device 1I, and FIG. 42 is a block diagram showing the main control configuration of the inkjet recording device 1I. In the following explanations, only the points where the inkjet recording device 1I is different from the inkjet recording device 1D are described. The same components are indicated by the same reference number/letter, and repetitive explanations are omitted.

The inkjet recording device 1I is not provided with a heating-unit temperature sensor 92 which detects the temperature of a heating roller 71 around an image forming drum 21.

The control section 10 adds a correction value to the current value to be applied to the heat source 713 of the heating roller 71 and to the set temperatures T1-T3. The correction value is obtained by subtracting the gloss value, which is detected by a gloss measuring section 83, from the set value C1 which is the lower limit of the gloss value of dot, and by multiplying the resultant by a predetermined coefficient. Further, the control section 10 subtracts a correction value from the current value to be applied to the heat source 713 of the heating roller 71 and from the set temperatures T1-T3. The correction value is obtained by subtracting the set value C2, which is the upper limit of the gloss value, from the gloss value detected by the gloss measuring section 83, and by multiplying the resultant by a predetermined coefficient.

The control of the heat source 713 of the heating roller 71 may be performed on the basis of an electrical voltage or an electrical power instead of an electrical current, and the correction may be performed for them.

Further, the control section 10 performs the processing of determining the current value to be applied to the heat source 713 of the heating roller 71 according to the thickness and the type of recording medium P.

Further, the control section 10 changes the set temperatures T1, T2 and T3 and the upper and lower limits of the above-mentioned dot diameter to new set values when a gloss adjustment of ink dots is executed through a gloss adjustment button 68.

Next, the operation control at the time of image formation of the inkjet recording device 1I having the above described configuration is described with reference to the flowcharts of FIGS. 26 to 29 for the inkjet recording device 1D. Only the differences in processing between the inkjet recording devices 1I and 1D are described.

First, the image forming unit 2I of the inkjet recording device 1I is not provided with the heating-unit temperature sensor 92 of the image forming unit 2D. Therefore, the control section 10 reads the set temperatures T1, T2 and T3; the lower limit C1 and the upper limit C2 of the gloss value; and the current value to be applied to the heat source 713, which are set initial values, related to the image forming drum 21, from the ROM at step S701 in the processing of the flowcharts shown in FIGS. 26 to 29.

Further, the processing of Steps S711-S717, Steps 729-S735, Steps S763-S769, Steps S773-S779 and Step S795-S801 are omitted.

Further, at Step S747, the current value to be applied to the heat source 713 is set again according to the inputted thickness and the type of recording medium P.

Further, at Step S751, the set temperatures T1, T2 and T3; the lower limit C1 and the upper limit C2 of the gloss value; and the current value to be applied to the heat source 713 are changed to new set values when a setting has been made for executing gloss adjustment.

Further, at Step S813, the correction value of the current value to be applied to the heat source 713 and the correction value of the set temperatures T1, T2 and T3 are individually obtained and the correction values are added to the current value and the set temperatures, respectively, when the gloss value detected by the gloss measuring section 83 is less than the lower limit C1 of the gloss value. Further, at Step S817, the correction value of the current value to be applied to the heat source 713 and the correction value of the set temperatures T1, T2 and T3 are individually obtained and the correction values are subtracted from the current value and the set temperatures, respectively, when the gloss value detected by the gloss measuring section 83 is more than the upper limit C2 of the gloss value.

[Effects of Ninth Embodiment]

As described above, the inkjet recording device 1I having the above-described configuration has the effects similar to the inkjet recording device 1D.

Further, the current value to be applied to the heat source 713 of the heating roller 71 is determined according to the thickness and type of recording medium, the adjustment amount of gloss, and a detected gloss value. Therefore, although the image forming unit 2I of the inkjet recording device 1I is not provided with a heating-unit temperature sensor 92 and thus the control of the amount of heat generation of the heat source 713 on the basis of the detected temperature of the heating roller 71 is not performed as in the case of the above-mentioned inkjet recording device 1F, stable heating can be performed at a properly-determined current value.

[Others]

In each of the above-described embodiments, an inkjet recording device is shown, as an example, which uses an activating beam curable ink where reversible sol-gel phase transitions occur according to a temperature. Alternatively, another ink may also be used whose viscosity decreases when heated. An activating beam curable ink where reversible sol-gel phase transitions do not occur according to a temperature, for example, may be used as the ink for each of the above-described inkjet recording devices, too. That is because such an ink also decreases in viscosity when heated.

Further, in each of the above-described embodiments, the delivering drum 22 is shown as an example of a supplying section which delivers a recording medium P to the image forming drum 21. Alternatively, another supplying section, such as an arm supplying section or belt supplying section may be used. In the case of a drum supplying section (i.e., the delivering drum 22), the supplying section can also serve as a heating roller 71 when a heat source is provided inside of the delivering drum 22.

Further, it is preferable that the moving speed of the outer peripheral surface of the heating rollers 71 and 71B at the time of rotation be equal to or lower than the moving speed of the outer peripheral surface of the image forming drum 21 at the time of rotation. Such a speed relationship prevents a recording medium P from being crumpled when the recording medium P is carried while being sandwiched tightly between the heating roller 71 (71B) and the image forming drum 21.

Figure 43:
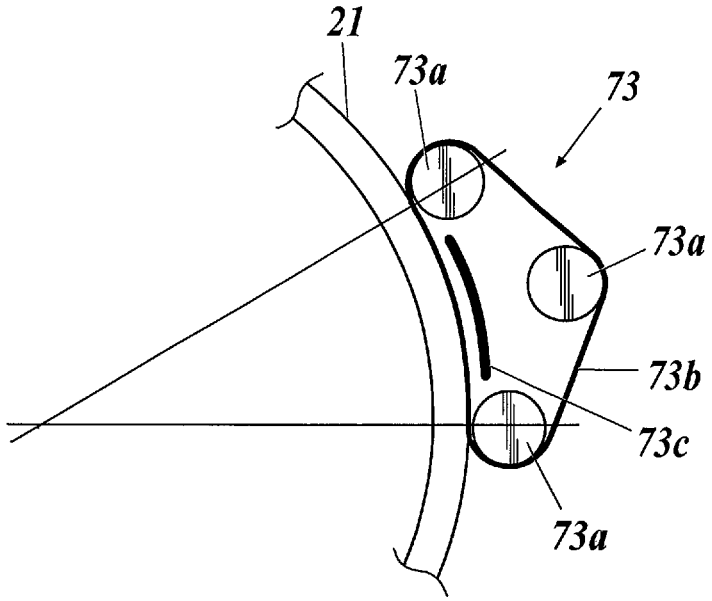
FIG. 43 is an explanatory diagram showing an example where a heating body is a belt type.

Further, in each of the above-described embodiments, the case is shown as an example where the heating body of each of the first heating unit and the second heating unit is a roller. Alternatively, each heating body may be an endless-belt heating body. FIG. 43 is a typical view showing an example of an endless-belt heating body. As shown in FIG. 43, an endless-belt heating body 73 includes three driving rollers 73*a* disposed around the image forming drum 21 and an endless belt 73*b* stretched between the three driving rollers 73*a*. The endless belt 73*b* is a thin metal belt, whose outer periphery is coated with elastic substance. A part of the outer peripheral surface of the endless belt 73*b* is in contact with the surface of the image forming drum 21. A heater 73*c* is disposed inside of the endless belt 73*b* as a heat source. Such an endless-belt heating section 73 can increase area of contact between the heating section 73 and the image forming drum 21, which can perform efficient heating.

Figure 44:
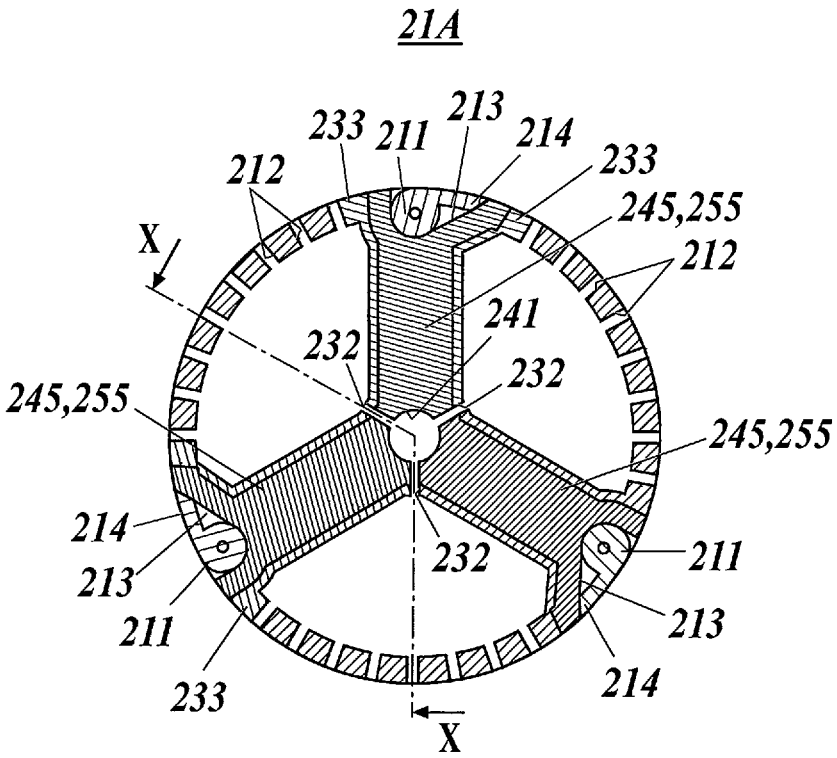
FIG. 44 is a cross-sectional view showing a modification of the image forming drum of each embodiment, and is a cross-sectional view viewed from the cutting plane along the line IX-IX of FIG. 45.
Figure 45:
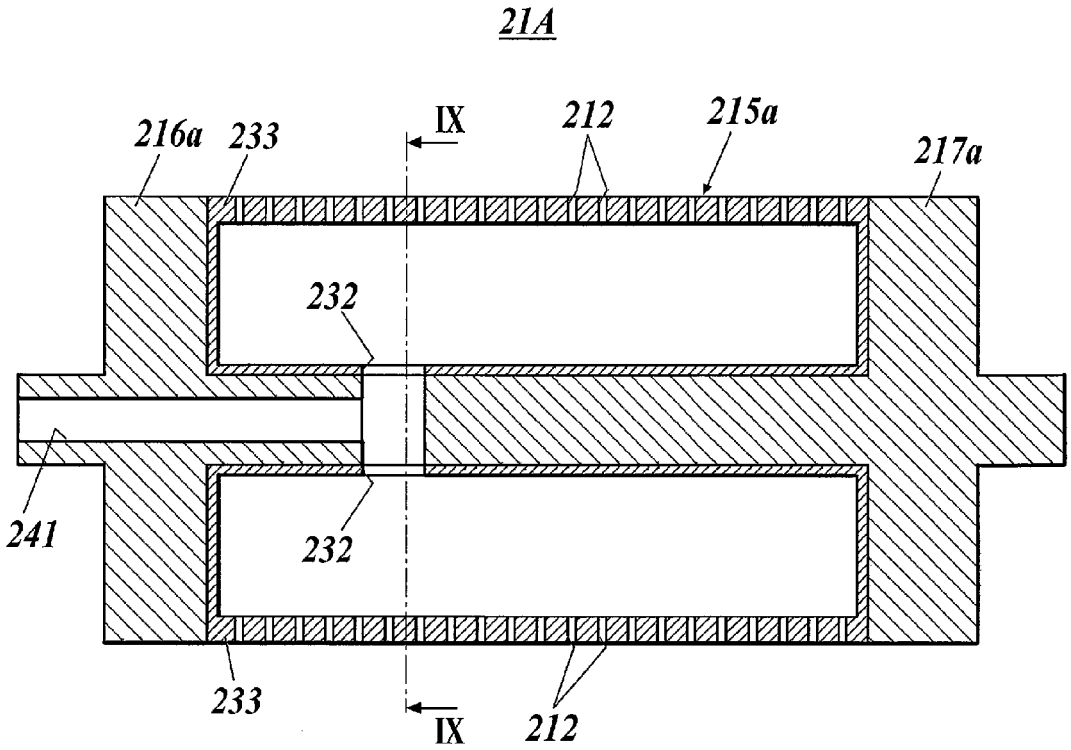
FIG. 45 is a cross-sectional view showing the schematic configuration of the image forming drum of each embodiment, and is a cross-sectional view viewed from the cutting plane along the line X-X of FIG. 44.

Further, in each of the above-described embodiments, a case is shown as an example where the main body section 215 of the image forming drum 21 is a cylinder as a single body. Alternatively, the main body section may be divided. For example, FIG. 44 is a cross-sectional view showing the schematic configuration of a divided image forming drum, and is a cross-sectional view viewed from the cutting plane along the line IX-IX of FIG. 45. FIG. 45 is a cross-sectional view viewed from the cutting plane along the line X-X of FIG. 44. As shown in FIG. 44 and FIG. 45, a main body section 215*a* of an image forming drum 21A includes a plurality of hollow division parts 233 each constituting a part of the outer peripheral surface of the main body section 215*a*. Each of the division parts 233 is formed substantially into a box shape. A plurality of suction holes 212 are formed in the outer peripheral surface of each division part 233. Further, each division part 233 has a through-hole 232 to allow the internal space of the division part 233 and a communication opening 241 to communicate with each other.

Further, a pair of supporting sections 216*a* and 217*a* is provided with a plurality of dividers 245 and 255 to form a plurality of spaces S where the respective division parts 233 are individually contained. The dividers 245 and 255 are formed so as to extend in the radial direction of the main body section 215*a*. Concave portions 213 to house nails 211 are provided at the end surfaces of the dividers 245 and 255.

Thus, since the nails 211 are supported by the dividers 245 and 255, the strength for supporting the nails 211 is enhanced.

Further, since the main body section 215*a* is divided, the size of the die or mold for manufacturing each division part 233 can be reduced.

EXAMPLE

Figure 46:
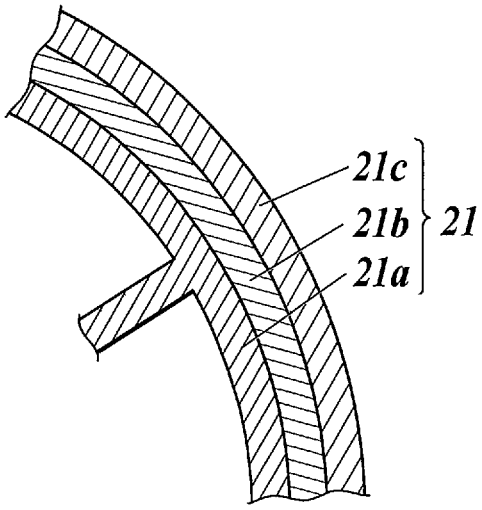
FIG. 46 is a cross-sectional view showing a cross-section surface vertical to the center line of rotation of the image forming drum.

A more detailed and preferable example related to the image forming drum 21 is shown below. FIG. 46 is a cross-sectional view showing a cross-section surface vertical to the center line of rotation of the image forming drum 21. As shown in the drawing, the rotation drum 21 includes a cylindrically-shaped support 21*a* as a core constituted of a rigid body, a heat-insulating layer 21*b* formed on the outer peripheral surface of the support 21*a*, and a heat-storage layer 21*c* formed further outer side of the heat-insulating layer 21*b*.

The support 21*a* is made of SUS304 (stainless steel). The heat-insulating layer 21*b* has a thickness of 2 mm, and is made of epoxy.

As described earlier, the image forming drum 21 is heated from outside with the heating rollers 71 and 72. When the main power supply of the inkjet recording device 1 is turned on, the temperature of the image forming drum 21 needs to rise quickly to a temperature at which the inkjet recording device 1 is ready for use. Here, the target temperature of the image forming drum 21 is (45±3)° C. In general, it is considered that a permissible time from when the main power supply is turned on to when the inkjet recording device 1 is ready for use is 300 sec.

The thermal capacity per unit area of the surface of the image forming drum 21 is a major factor as a parameter to determine the time required for the temperature of the image forming drum 21 to rise.

Figure 47:
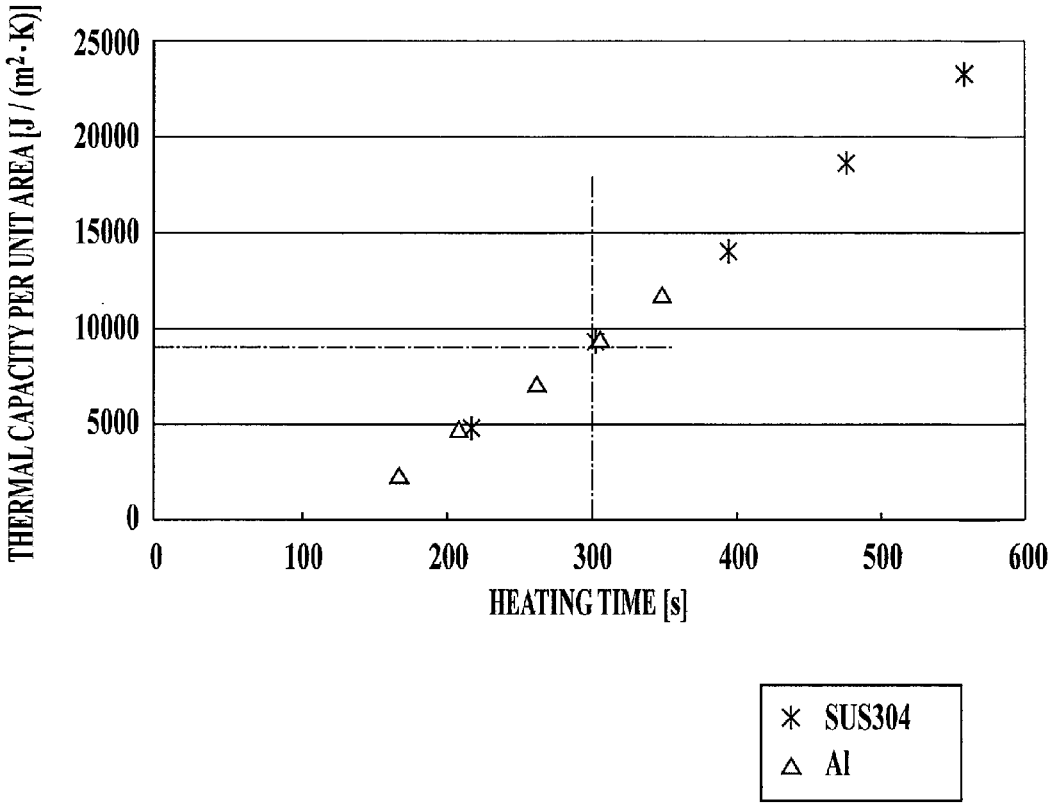
FIG. 47 is a graph showing the measurements of time required for the temperature of the image forming drum to rise to a predetermined temperature, with the thickness of the heat-storage layer of the image forming drum varied to adjust the thermal capacity per unit area.

FIG. 47 is a graph showing the results of measurement of time required for the temperature of the image forming drum 21 to rise from 30° C. to 45° C., with the thickness of the heat-storage layer 21*c* of the image forming drum 21 set to 1 mm, 2 mm, 3 mm, 4 mm, and 5 mm to adjust the thermal capacity per unit area. The temperature of 30° C. is a generally-assumed environmental temperature, and the temperature of 45° C. is the set temperature required at the time of image formation.

In FIG. 47, each of the cases where the heat-storage layer 21*c* is made of SUS304 (indicated by "*") and where the heat-storage layer 21*c* is made of aluminum (indicated by "Δ") is shown. The vertical axis represents the thermal capacity per unit area (unit: J/(m$^2$·K)) of the heat-storage layer 21*c* of each image forming drum 21 used of for the measurement; and the horizontal axis represents the time (unit: s) required for the temperature to rise to the target temperature.

This comparative trial showed that the required heating time was proportional to the thermal capacity per unit area in both cases where the heat-storage layer 21*c* was made of SUS304 and where the heat-storage layer 21*c* was made of aluminum. According to the approximation straight line representing the relation between the required heating time and the thermal capacity per unit area, it was found that the thermal capacity per unit area should be 9000 J/(m$^2$·K) in order to allow the required time to be equal to or less than 300 s.

Therefore, it can be said that the thermal capacity per unit area of the heat-storage layer 21*c* is preferably equal to or less than 9000 J/(m$^2$·K) in terms of a quick temperature rising to the target temperature. Although SUS304 and aluminum are preferable as the material of the heat-storage layer 21*c*, the material is not particularly limited thereto.

When the thermal capacity per unit area of the heat-storage layer 21*c* of the image forming drum 21 is too small, the temperature easily falls when a recording medium P is supplied to the image forming drum 21.

When a recording medium P having a thickness of 600 μm at a temperature of 25° C. is supplied to the image forming drum 21 whose temperature has been risen to 48° C., the thermal capacity per unit area of the heat-storage layer 21*c* required to maintain the temperature of 42° C. or higher is 2890 J/(m$^2$·K) according to a theoretical computing. (The thickness of 600 μm is the thickest conceivable paper which would decrease the temperature of the image forming drum 21 most largely. The temperature of 25° C. is the ordinary temperature of a recording medium P. The temperature of 48° C. is the upper limit of the set temperature of the image forming drum 21. The temperature of 42° C. is the lower limit of the temperature permissible for image formation.) When the thermal capacity per unit area of the heat-storage layer 21*c* is less than 2890 J/(m$^2$·K), high image quality cannot be maintained for a thick recording medium P. Therefore, it can be said that the thermal capacity per unit area of the heat-storage layer 21*c* of the image forming drum 21 is preferably equal to or more than 3000 J/(m$^2$·K) taking a change in environmental temperature into consideration, too.

That is, the thermal capacity per unit area of the heat-storage layer 21*c* of the image forming drum 21 preferably falls within the range of equal to or more than 3000 J/(m$^2$·K) and equal to or less than 9000 J/(m$^2$·K) in terms of both the time required for temperature rise and the decrease in temperature when a recording medium P is supplied.

The heat-storage layer 21*c* of the image forming drum 21 needs to transfer heat quickly from the image forming drum 21 to a supplied recording medium P to raise the temperature of the recording medium P. To accomplish this, the thermal conductivity of the heat-storage layer 21*c* is preferably equal to or more than 15 W/(m·K). When the thermal conductivity is less than 15 W/(m·K), the heat transfer from the image forming drum 21 to the recording medium P is not performed appropriately, which has an influence on stabilization in image quality.

Figure 48:
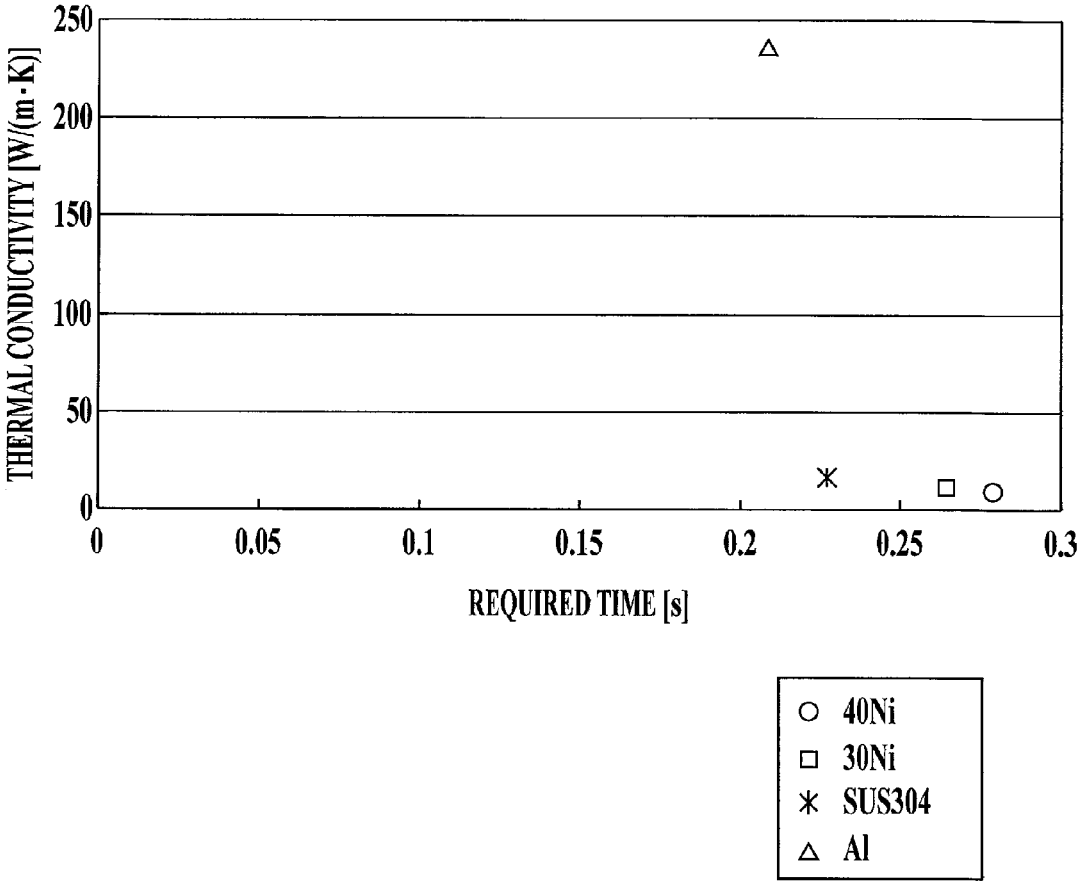
FIG. 48 is a graph showing the measurements of time required for the temperature to rise in a predetermined range of temperature, with each of the materials for the heat-storage layer of the image forming drum adjusted so as to adjust its thermal conductivity.

FIG. 48 is a graph showing the measurements of required time for the temperature of a recording medium P to rise from 25° C. to 42° C. The thermal conductivity of the material for the heat-storage layer 21*c* of the image forming drum 21 is adjusted by using SUS304 (thermal conductivity: 17 W/(m·K)), aluminum (thermal conductivity: 235 W/(m·K)), nickel steel 30 Ni (thermal conductivity: 12 W/(m·K)), and nickel steel 40 Ni (thermal conductivity: 10 W/(m·K)) as the material. The temperature of 25° C. is an ordinary temperature of a recording medium P, and the temperature of 42° C. is the lower limit of the temperature permissible for image formation.

The vertical axis represents the thermal conductivity (unit: W/(m·K)) of the heat-storage layer 21*c* of each image forming drum 21 used of for the measurement; and the horizontal axis represents the time (unit: s) required for the temperature to rise to the target temperature.

Although the thermal conductivity of the heat-storage layer 21*c* greatly exceeds 15 W/(m·K) in the case of aluminum, the time required for the temperature of a recording medium P to rise is not shortened largely.

The thermal conductivity of a recording medium P is 2.83 W/(m·K) in the case where the recording medium P is paper. It is preferable that the ratio of the thermal conductivity of the heat-storage layer 21*c* to the thermal conductivity of recording medium P be equal to or more than 5, which is calculated by 15÷2.83≈75.

Further, the heat-insulating layer 21*b* of the image forming drum 21 preferably has a thermal conductivity of 0.20 W/(m·K) or less. The heat-insulating layer 21*b* of the image forming drum 21 having a thermal conductivity of 0.20 W/(m·K) or less inhibits heat transfer from the heat-storage layer 21*c* to the support 21*a*, which means the heat-storage layer 21*c* is constantly maintained at an intended temperature. Thus, the image quality of a formed image is maintained at a high level. Further, the electrical power for each heating roller can be saved.

Further, the heat-insulating layer 21*b* preferably has a thickness of 100 μm or more. In this case, too, a heat transfer from the heat-storage layer 21*c* to the support 21*a* is inhibited, which leads to maintenance of high image quality and electrical power saving.

It is more preferable that the heat-insulating layer 21*b* has a thickness of 2 mm or more as described above because a thicker layer has a better insulation effect.

As described above, preferable configuration of the image forming drum 21 described in each embodiment is particularly effective when heating the image forming drum 21 with an external heating section to perform heat storage in advance and to raise the temperature of a supplied recording medium P as in the case of the inkjet recording device 1. Those configurations are particularly effective and preferable in a quick temperature rise of the image forming drum, temperature rise of a recording medium P, and stabilization in image quality owing to the quick and effective temperature rises.

Industrial Applicability

The device is applicable in the field of ejecting energy-ray curable ink onto a recording medium to perform image formation.

| REFERENCE NUMERALS | |
|---|---|
| 1A, 1B, 1C, 1D and 1E | inkjet recording device (image forming device) |
| 2A, 2B, 2C, 2D and 2E | image forming unit |
| 3 | paper feed unit |
| 4 | accumulation unit |
| 10 | control section (heating control section) |
| 21 | image forming drum |
| 22 | delivering drum (recording medium supplying section) |
| 51 | recording heads |
| 52 | UV lamp (energy-ray irradiation section) |
| 53 | cooling fan (cooling section which cools image forming drum) |
| 68 | gloss adjustment button (gloss adjustment input section) |
| 69 | dot diameter measuring section |
| 71, 71A and 71B | heating roller (heating body of first heating unit) |
| 72, 71A and 71B | heating roller (heating body of second heating unit) |
| 81 | recording medium thickness input unit |
| 82 | recording medium type input unit |
| 91 | drum temperature sensor (drum temperature detector) |
| 92, 92A and 92B | heating-unit temperature sensor (heating-unit temperature detector) |
| 93 | first recording medium temperature sensor (recording medium temperature detector) |
| 94 | second recording medium temperature sensor (recording medium temperature detector) |
| P | recording medium |
| T1, T2 and T3 | image-forming-drum set temperature |
| T4 and T5 | heating-unit set temperature |

The invention claimed is:

1. An inkjet recording device which ejects ink to perform recording on a recording medium, the inkjet recording device comprising:

an image forming drum which holds the recording medium on an outer peripheral surface thereof;

a recording medium supplying section which supplies the recording medium to the image forming drum;

a recording head which ejects the ink onto the recording medium supplied to the image forming drum to perform image formation;

a first heating unit which heats the recording medium held on the image forming drum, the first heating unit heating the recording medium before the recording is performed thereon by the recording head;

a second heating unit which heats the outer peripheral surface of the image forming drum downstream of the position at which the recording medium is outputted after the recording is performed on the recording medium by the recording head and upstream of the recording medium supplying section in a rotation direction of the image forming drum;

a heating-unit temperature detector which detects the temperature of the first heating unit;

a drum temperature detector which detects the temperature of the image forming drum; and a heating control section which controls each of the first heating unit and the second heating unit, wherein the heating control section performs heat control of the first heating unit such that the temperature detected by the heating-unit temperature detector falls within a predetermined range of heating-unit set temperature; and wherein the heating control section performs heat control of the second heating unit such that the temperature detected by the drum temperature detector falls within a predetermined range of image-forming-drum set temperature.

2. The inkjet recording device according to claim 1, wherein the first heating unit includes a plurality of heating bodies;

wherein the heating-unit temperature detector includes a plurality of detecting units each of which detects the temperature of a heating body of the heating bodies; and wherein the heating control section performs heat control of each of the heating bodies such that the temperature detected by the detecting unit falls within the range of heating-unit set temperature predetermined for the heating body.

3. The inkjet recording device according to claim 1, wherein the second heating unit includes a plurality of heating bodies; and wherein the heating control section performs heat control of each of the heating bodies of the second heating unit such that the temperature detected by the drum temperature detector falls within the predetermined range of image-forming-drum set temperature.

4. The inkjet recording device according to claim 1, further comprising a recording medium thickness acquiring section which acquires the thickness of the recording medium, wherein the heating control section determines the range of heating-unit set temperature according to the thickness of the recording medium acquired by the recording medium thickness acquiring section.

5. The inkjet recording device according to claim 1, further comprising a recording medium type acquiring section which acquires the type of the recording medium, wherein the heating control section determines the range of heating-unit set temperature according to the type of the recording medium acquired by the recording medium type acquiring section.

6. The inkjet recording device according to claim 1, further comprising a first recording medium temperature detector which detects the temperature of the recording medium heated by the first heating unit, the first recording medium temperature detector detecting the temperature of the recording medium before the recording is performed thereon by the recording head, wherein the heating control section changes the range of heating-unit set temperature of the first heating unit on the basis of the temperature detected by the first recording medium temperature detector.

7. The inkjet recording device according to claim 1, further comprising a second recording medium temperature detector which detects the temperature of the recording medium after the recording is performed thereon by the recording head, wherein the heating control section changes at least one of the range of heating-unit set temperature of the first heating unit and the range of image-forming-drum set temperature on the basis of the temperature detected by the second recording medium temperature detector.

8. The inkjet recording device according to claim 1, further comprising a dot diameter measuring section which measures the dot diameter of the ink recorded on the recording medium by the recording head, wherein the heating control section changes at least one of the range of heating-unit set temperature and the range of image-forming-drum set temperature on the basis of the dot diameter measured by the dot diameter measuring section.

9. The inkjet recording device according to claim 1, further comprising a gloss measuring section which measures the gloss of an image recorded on the recording medium by the recording head, wherein the heating control section changes at least one of the range of heating-unit set temperature and the range of image-forming-drum set temperature on the basis of the gloss measured by the gloss measuring section.

10. The inkjet recording device according to claim 1, further comprising a gloss adjustment input section with which the degree of gloss of an image to be recorded on the recording medium is inputted to be set by an operator, wherein the heating control section changes at least one of the range of heating-unit set temperature and the range of image-forming-drum set temperature on the basis of the gloss set with the gloss adjustment input section.

11. The inkjet recording device according to claim 1, further comprising a cooling section which cools the image forming drum, wherein the heating control section performs cooling control of the cooling section such that the temperature detected by the drum temperature detector falls within the predetermined range of image-forming-drum set temperature.

12. The inkjet recording device according to claim 1, wherein the heating control section performs heat control of the first heating unit so as to perform preheating of the image forming drum to which the recording medium is not supplied when a main power supply is turned on.

13. The inkjet recording device according to claim 1, wherein the ink is cured by being irradiated with energy rays;

wherein the inkjet recording device comprises an energy-ray irradiation section which irradiates the recording medium on the image forming drum with the energy rays, the recording medium having an image recorded thereon by the recording head;

wherein the heating control section performs irradiation control of the energy-ray irradiation section so as to perform preheating of the image forming drum to which the recording medium is not supplied when a main power supply is turned on.

14. An inkjet recording device which ejects ink to perform recording on a recording medium, the inkjet recording device comprising:

an image forming drum which holds the recording medium on an outer peripheral surface thereof;

a recording medium supplying section which supplies the recording medium to the image forming drum;

a recording head which ejects the ink onto the recording medium supplied to the image forming drum to perform image formation;

a first heating unit which electrically heats the recording medium held on the image forming drum, the first heating unit heating the recording medium before the recording is performed thereon by the recording head;

a second heating unit which heats the outer peripheral surface of the image forming drum downstream of the position at which the recording medium is outputted after the recording is performed on the recording medium by the recording head and upstream of the recording medium supplying section in a rotation direction of the image forming drum;

a drum temperature detector which detects the temperature of the image forming drum;

at least one of a recording medium thickness acquiring section which acquires the thickness of the recording medium, and a recording medium type acquiring section which acquires the type of the recording medium; and a heating control section which controls each of the first heating unit and the second heating unit, wherein the heating control section controls one of an electrical power, an electrical voltage and an electrical current which are supplied to the first heating unit according to at least one of the thickness of the recording medium acquired by the recording medium thickness acquiring section and the type of the recording medium acquired by the recording medium type acquiring section; and wherein the heating control section performs heat control of the second heating unit such that the temperature detected by the drum temperature detector falls within a predetermined range of image-forming-drum set temperature.

15. The inkjet recording device according to claim 14, further comprising a first recording medium temperature detector which detects the temperature of the recording medium heated by the first heating unit, the first recording medium temperature detector detecting the temperature of the recording medium before the recording is performed thereon by the recording head, wherein the heating control section changes at least one of (i) the electrical power, (ii) the electrical voltage and (iii) the electrical current which are supplied to the first heating unit and (iv) the range of image-forming-drum set temperature on the basis of the temperature detected by the first recording medium temperature detector.

16. The inkjet recording device according to claim 14, further comprising a second recording medium temperature detector which detects the temperature of the recording medium after the recording is performed thereon by the recording head, wherein the heating control section changes at least one of (i) the electrical power, (ii) the electrical voltage and (iii) the electrical current which are supplied to the first heating unit and (iv) the range of image-forming-drum set temperature on the basis of the temperature detected by the second recording medium temperature detector.

17. The inkjet recording device according to claim 14, further comprising a dot diameter measuring section which measures the dot diameter of the ink recorded on the recording medium by the recording head, wherein the heating control section changes at least one of (i) the electrical power, (ii) the electrical voltage and (iii) the electrical current which are supplied to the first heating unit and (iv) the range of image-forming-drum set temperature on the basis of the dot diameter measured by the dot diameter measuring section.

18. The inkjet recording device according to claim 14, further comprising a gloss measuring section which measures the gloss of an image recorded on the recording medium by the recording head, wherein the heating control section changes at least one of (i) the electrical power, (ii) the electrical voltage and (iii) the electrical current which are supplied to the first heating unit and (iv) the range of image-forming-drum set temperature on the basis of the gloss measured by the gloss measuring section.

19. The inkjet recording device according to claim 14, further comprising a gloss adjustment input section with which the degree of gloss of an image to be recorded on the recording medium is inputted to be set by an operator, wherein the heating control section changes at least one of (i) the electrical power, (ii) the electrical voltage and (iii) the electrical current which are supplied to the first heating unit and (iv) the range of image-forming-drum set temperature on the basis of the gloss set with the gloss adjustment input section.

20. The inkjet recording device according to claim 14, further comprising a cooling section which cools the image forming drum, wherein the heating control section performs cooling control of the cooling section such that the temperature detected by the drum temperature detector falls within the predetermined range of image-forming-drum set temperature.

21. The inkjet recording device according to claim 14, wherein the heating control section performs heat control of the first heating unit so as to perform preheating of the image forming drum to which the recording medium is not supplied when a main power supply is turned on.

22. The inkjet recording device according to claim 14, wherein the ink is cured by being irradiated with energy rays;

wherein the inkjet recording device comprises an energy-ray irradiation section which irradiates the recording medium on the image forming drum with the energy rays, the recording medium having an image recorded thereon by the recording head;

wherein the heating control section performs irradiation control of the energy-ray irradiation section so as to perform preheating of the image forming drum to which the recording medium is not supplied when a main power supply is turned on.

* * * * *